United States Patent [19]

Ihama et al.

[11] Patent Number: 5,043,258

[45] Date of Patent: Aug. 27, 1991

[54] SILVER HALIDE PHOTOGRAPHIC EMULSION

[75] Inventors: Mikio Ihama; Yuji Kume; Koji Tamoto; Hiroshi Takehara; Hiroshi Ayato; Yoichi Suga; Seiichiro Kishida, all of Kanagawa, Japan

[73] Assignee: Fuji Photo Film Co., Tokyo, Japan

[21] Appl. No.: 536,034

[22] Filed: Jun. 12, 1990

Related U.S. Application Data

[63] Continuation of Ser. No. 258,734, Oct. 17, 1988, abandoned.

[30] Foreign Application Priority Data

| | | | |
|---|---|---|---|
| Oct. 16, 1987 | [JP] | Japan | 62-261047 |
| Oct. 16, 1987 | [JP] | Japan | 62-261048 |
| Dec. 18, 1987 | [JP] | Japan | 62-320706 |

[51] Int. Cl.[5] ..... G03C 1/02; G03C 1/34; G03C 1/10

[52] U.S. Cl. ..... 430/567; 430/569; 430/618

[58] Field of Search ..... 430/567, 569, 618, 217

[56] References Cited

U.S. PATENT DOCUMENTS

| | | | |
|---|---|---|---|
| 3,622,318 | 11/1971 | Evans | 430/552 |
| 3,976,486 | 8/1976 | Land | 430/217 |
| 4,070,190 | 1/1978 | Friedrich et al. | 96/94 R |
| 4,075,020 | 2/1978 | Saleck et al. | 430/569 |
| 4,210,450 | 7/1980 | Corben | 430/569 |

FOREIGN PATENT DOCUMENTS

| | | |
|---|---|---|
| 1155325 | 10/1983 | Canada . |
| 1155325 | 10/1983 | Canada . |
| 0006543 | 1/1980 | European Pat. Off. . |
| 0190625 | 8/1986 | European Pat. Off. . |
| 0244356 | 1/1987 | European Pat. Off. . |
| 2344331 | 4/1975 | Fed. Rep. of Germany . |

OTHER PUBLICATIONS

Berry et al, "Journal of Applied Physics", vol. 35 (7), 2165–2169 (1964).

James, "Theory of the Photographic Process", 4th edition, chapter 3, part B, pp. 94–98, MacMillan Publications, Inc., New York (1977).

*Primary Examiner*—Richard L. Schilling

*Attorney, Agent, or Firm*—Sughrue, Mion, Zinn, Macpeak & Seas

[57] ABSTRACT

A silver halide photographic emulsion is described which has excellent color-sensitizing efficiency by sensitizing dyes, sharpness, covering power, and pressure resistant properties, wherein the grains are comprised of core/shell type grains having contained therein a partially halogen-converted silver salt phase, the silver salt comprising silver halochloride, silver thiocyanate or silver citrate.

20 Claims, 2 Drawing Sheets

SILVER HALIDE PHOTOGRAPHIC EMULSION

This is a continuation of application Ser. No. 07/258,734 filed Oct. 17, 1988, now abandoned.

FIELD OF THE INVENTION

This invention relates to a silver halide photographic emulsion. More particularly, the invention relates to a silver halide photographic emulsion containing silver halide grains having therein a partially halogen-converted silver halochloride phase and a silver thiocyanate phase or a silver citrate phase.

BACKGROUND OF THE INVENTION

In general, various kinds of pressures are applied to a photographic light-sensitive material formed by coating silver halide emulsion(s) on a support. For example, a photographic negative film is generally rolled into a cartridge and is loaded into a camera, and in these cases the film is bent or pulled for advancing it in the camera.

On the other hand, since sheet film such as photographic light-sensitive films for printing and direct medical radiographic light-sensitive films are handled directly, it frequently occurs that the sheet films are broken or curved in these cases.

Also, large pressures are applied to photographic light-sensitive materials during the cutting and working thereof.

If these various pressures are applied to photographic light-sensitive materials, the pressures are applied to the silver halide grains through gelatin as a binder for the silver halide grains and a plastic film as the support thereof.

It is known that when pressures are applied to silver halide grains, the photographic characteristics of the silver halide materials are changed as reported, for example, in K. B. Mather, *Journal of Optical Society of America,* 38, 1054 (1948), P. Faelens and P. de Smet, *Scie. et Ind. Phot.,* 25, No. 5, 178 (1954), and P. Faelens, *Journal of Photographic Science,* 2, 105 (1954).

Accordingly, it has been earnestly desired to provide a photographic light-sensitive material, the photographic properties of which are not adversely influenced by such pressures.

As a means for improving the pressure characteristics of photographic light sensitive materials, it is known to prevent these pressures from affecting silver halide grains by incorporating a plasticizer such as a polymer or an emulsified material in the photographic light-sensitive materials or reduce the silver halide/gelatin ratio of the silver halide emulsion.

For example, British Patent 738,618 discloses a method of using a heterocyclic compound, British Patent 738,637 an alkylphthalate, British Patent 730,030 an alkyl ester, U.S. Pat. No. 2,960,404 a polyhydric alcohol, U.S. Pat. No. 3,121,060 a carboxyalkyl cellulose, JP-A-49-5017 a paraffin and a carboxylate, and JP-B-28086 an alkylacrylate and an organic acid (the term "JP-A" as used herein means an "unexamined published patent application", and "JP-B" as used herein means an "examined published Japanese patent application").

However, in the method of using a plasticizer, the amount that can be used is limited because the plasticizer reduces the mechanical strength of the silver halide photographic emulsion layers containing it and if the amount of gelatin is increased accordingly to prevent the reduction of the layer strength, the photographic processing speed of the photographic light-sensitive materials containing the emulsion is delayed. Thus, the aforesaid methods do not provide satisfactory results.

On the other hand, recently, the sensitivity of silver halide photographic materials has been dramatically increased and the photographic materials have been reduced in size.

Thus, a photographic light-sensitive material having a higher sensitivity and giving excellent image quality has been strongly desired.

Accordingly, the desire for silver halide emulsions for photography which have superior photographic performance in terms of high sensitivity, high contrast, excellent graininess, and excellent sharpness has increased. To this end, techniques of producing and using tabular grain silver halide emulsions aimed at increasing sensitivity including the increase of the color sensitizing effect by sensitizing dye, the improvement of the relation of sensitivity/graininess, and improvement of sharpness, and the improvement of covering power are disclosed in U.S. Pat. Nos. 4,386,156, 4,504,570, 4,478,929, 4,414,304, 4,411,986, 4,400,463, 4,414,306, 4,439,520, 4,433,048, 4,434,226, 4,413,053, 4,439,353, 4,490,458, and 4,399,215.

In general, hexahedral, octahedral or potato-like silver halide grains have been known to be susceptible to deformation by external forces as compared to the tabular silver halide grain having a large diameter/thickness ratio.

However, in general, tabular silver halide grains having a large diameter/thickness ratio (aspect ratio) have also proven very weak to external pressure and thus have not provided satisfactory pressure resistant characteristics.

For example, if tabular silver halide grains are formed by adding silver nitrate to an aqueous solution containing gelatin, potassium bromide, and potassium iodide, the silver halide emulsion obtained has greatly reduced sensitivity due to the action of external pressure and hence is very inconvenient for practical and commercial use.

On the other hand, the aforesaid tendency of causing desensitization by the action of external pressure can be improved in pure silver bromide grains or silver iodobromide grains composed of a completely uniform halogen composition throughout the whole grain formed by adding an aqueous silver nitrate solution and an aqueous solution of halides to an aqueous gelatin solution by a double jet method so that the re growth of nuclei does not occur. However, these silver halide grains are very liable to fog by the action of external pressure and hence are undesirable for practical use.

U.S. Pat. No. 2,592,250 discloses a silver halide emulsion formed by subjecting silver chloride emulsion grains to a halogen conversion using bromide ions or iodide ions. JP-B-50-36978 discloses a method of using the aforesaid silver halide emulsion, the surface of which has been chemically sensitized. JP-A-61-122641 discloses a silver halide emulsion formed by subjecting an emulsion containing chloride ions to a halogen conversion using bromide ions or iodide ions in the presence of a solvent. Also, JP-A-51-2417 discloses a method of growing silver halide grains by adding bromide ions or iodide ions to a silver halide emulsion within 20 minutes after the formation of the silver chloride grains and then physically ripening them.

However, in the aforesaid production method for silver halide grains, it is virtually impossible to control the form of the grains and as described in the aforesaid patents and patent applications, the sizes and forms of the silver halide grains are completely changed by the halogen conversion. Accordingly, it is difficult to apply such a technique to the formation of tabular silver halide grains.

JP-B-61-31454 discloses a method of depositing silver bromide on silver chloride grains not in a halogen conversion type but in a laminated layer type.

JP-A-58-111936 and U.S. Pat. No. 4,414,306 disclose a method of obtaining tabular silver chlorobromide grains by growing silver chlorobromide at the annular domains of tabular silver bromide grains. However, in the tabular grains obtained by this method, some properties of the silver chloride produced such as the fast developing property, etc., may be obtained; however the tabular grains have a problem that the properties of silver iodobromide itself, such as the improved relation of sensitivity and graininess, etc., are lost.

JP-A-59-99433 discloses that the pressure resistant characteristics of tabular silver halide grains are improved by forming a high iodide-containing layer in the interior of the tabular grains. JP-A-61-14636 discloses that the pressure resisting characteristics of tabular silver halide grains can be improved by increasing the iodide content in the central domain of the tabular grains over that in the outer domain thereof. Also, Japanese Patent Application No. 62-54640 discloses a method of introducing dislocation lines in the annular domains of the tabular grains by iodide ions. However, although the aforesaid methods of using iodide ions may improve the pressure resistant characteristics, at the same time, they adversely influence photographic characteristics such as developing property, etc., and hence they are restricted in their use.

Also, it is known that a mono-dispersed emulsion is excellent for providing a high sensitivity, high contrast, and excellent graininess. However, this type of emulsion has not been satisfactory in regard to the pressure resistant characteristics. Various methods have been proposed to remedy this problem.

For example, as a method of using iodide ions, JP A-59-178447 discloses a silver halide photographic of emulsion locally containing iodide ions. Also, U.S. Pat. No. 4,210,450 discloses a method of producing silver halide grains halogen-converted by iodide ions during the formation of the grains as described hereinabove. However, although methods of using iodide ions may improve the pressure resistant characteristics of the silver halide emulsion, they adversely influence the photographic characteristics thereof, such as the developing property, etc., thereof and hence the use of such methods is restricted.

On the other hand, as a method of using silver chloride, U.S. Pat. No. 4,495,277 discloses a silver halide emulsion having a silver chloride layer as one layer in the inside nucleus of the silver halide grains. However, although this method may improve the pressure resistant properties, it causes the deterioration of the graininess thereof.

Furthermore, for the requirements of a photographic light-sensitive material to have a high sensitivity excellent image quality, JP-A-60-143331 discloses that a silver halide emulsion having a high sensitivity, excellent graininess and causing less fog is obtained by forming silver halide grains having a clear double structure and increasing the iodine content in the core portion thereof. Also, it is known that the absorption of dyes onto silver halide grains is increased by increasing the iodine content at the surface portion thereof as described, for example, in T. H. James, *The Theory of the Photographic Process,* page 241. This technique is also convenient for color sensitization. Also, a silver halide emulsion having a high content of iodide in the surface portions of the silver halide grains shows a large edge effect and is effective in providing photographic light-sensitive material having excellent image sharpness.

However, the silver halide emulsion having high iodide content at the surface portions of the grains generally shows pressure fog and pressure sensitization, and hence a counterplan therefor has been required.

SUMMARY OF THE INVENTION

A first object of this invention is to provide a silver halide emulsion which simultaneously attains an improvement in each of color sensitizing efficiency by sensitizing dye(s), the relation between sensitivity and graininess, sharpness, covering power, and pressure resistant characteristics.

A second object of this invention is to provide silver halide emulsion comprising silver halide grains having high sensitivity, excellent contrast, excellent graininess and sharpness, improved pressure resistant characteristics.

As the result of various investigations, it has been discovered that the aforesaid objects can be attained by the present invention as set forth hereinbelow.

That is, the present invention provides a silver halide photographic emulsion containing silver halide grains, wherein the silver halide grains have a halogen-converted silver halo-chloride phase and a silver thiocyanate phase or a silver citrate phase in the interior thereof.

DETAILED DESCRIPTION OF THE INVENTION

Figure 1:
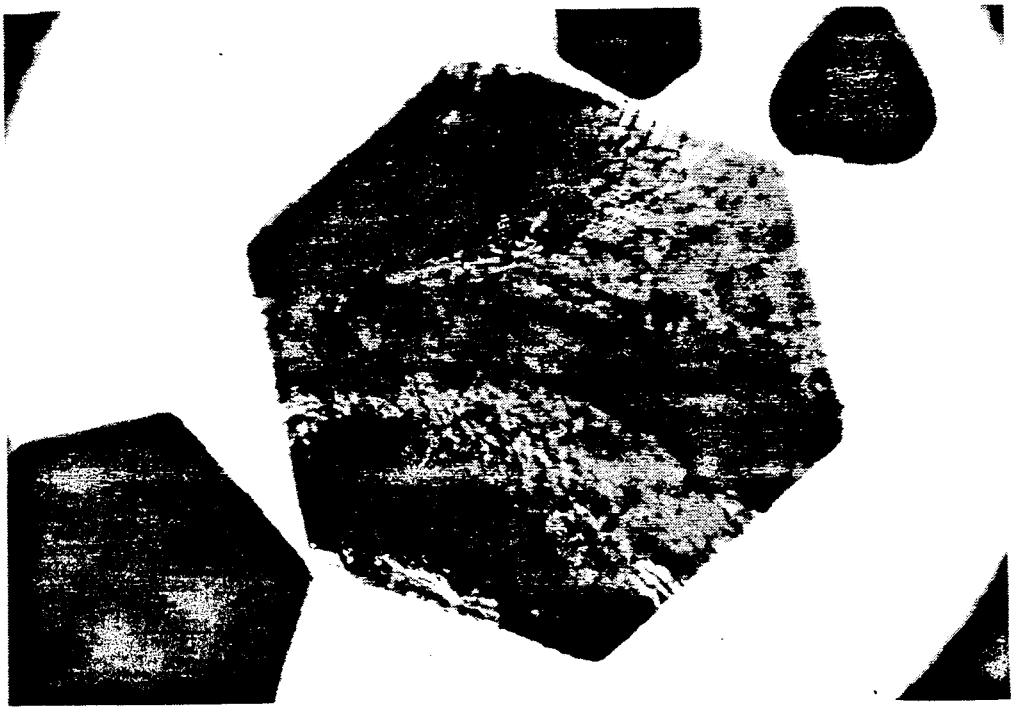
FIG. 1 is a low-temperature transmission electron microphotograph of 50,000 magnifications showing the crystal structure of the silver halide grains of Emulsion Em-A prepared in Example 1

The silver halide grains for use in this invention have preferably a core/shell type structure, and more preferably mono-dispersed silver halide grains or tabular silver halide grains having a core/shell type structure.

The silver halide grains for use in this invention are preferably silver bromide series grains which are obtained by first forming silver halide grains substantially composed of silver bromide, depositing thereon a silver salt having a higher solubility in water than silver bromide, and after halogen-converting the phase of the silver salt having the high solubility, depositing thereon a silver halide substantially composed of silver bromide.

In this invention the silver bromide series grains mean that the grains contain at least about 40 mole %, preferably at least about 50%, and most preferably at least about 60 mole % silver bromide.

In this embodiment, the core portions of the silver halide grains is composed of a silver halide containing from about 10 to 45 mole % silver iodide and more preferably about from 15 to 40 mol %, and the silver halide grains have a silver halo-chloride phase, a thiocyanate phase, or a citrate phase, each being partially halogen-converted in the inside of the grains. In this case it is particularly preferred that the silver iodide content at the surface portion of the final emulsion grains is at least about 3 mole %, more preferably at least 5 mole %.

The core portion in the core/shell type silver halide grains in this invention is a silver halide phase disposing inside the partially halogen-converted phase and the shell portion in this invention is a silver halide phase disposed outside the partially halogen-converted phase.

The "surface portion" of the silver halide grains in this invention has a depth (about 50 Å from the surface) measurable by ESCA (or EPS) described hereinafter.

The deposition of a silver salt having a higher solubility than that of silver bromide is carried out after forming base grains (core portions) substantially composed of silver bromide. In this case the volume of the base grains substantially composed of silver bromide is preferably at least about 5%, more preferably at least about 10%, and most preferably at least about 20% of the volume of the final grains. Also, the base grains substantially composed of silver bromide account for preferably at most about 95%, more preferably at most about 90%, and most preferably no more than about 85% of the volume of the final grains. Only when the silver bromide series grains satisfy the aforesaid factors, can the change in grain size and form in the subsequent step of halogen conversion be minimized.

The base grains in this invention are substantially composed of silver bromide. The term "substantially composed of silver bromide" means that the grains contain at least about 40 mole %, preferably at least about 50 mole %, and more preferably at least about 60 mole % bromide ions based on silver. If the base grains satisfy this factor, the grains may be composed of silver bromide, silver iodobromide, silver iodochlorobromide, or silver chlorobromide. The effect of this invention is remarkable when the base grains contain an iodide ion and the content of the iodide ion is preferably at least 0.5 mole %, more preferably at least about 1 mole %, and most preferably at least about 2 mole % based on silver of base grain. The upper limit of the iodide ion is about 40 mole %.

The silver halide grains for use as the base grains in this invention are preferably mono-dispersed grains, or tabular grains.

After forming grains substantially composed of silver bromide, a silver salt having a higher solubility than that of the silver bromide is deposited thereon Such a silver salt has a solubility in water higher than that of silver bromide and the solubility of the silver salt in 100 ml of water at 20° C. is less than 0.02 g, and preferably less than about 0.0002 g. Useful silver salts having a higher solubility than silver bromide include silver halo-chloride, silver thiocyanate, and silver citrate. As the silver halo-chloride, there are silver chloride, silver chlorobromide, silver chloroiodide and silver chloroiodo-bromide, each containing at least about 10 mole %, and preferably at least about 60 mole % silver chloride.

As the silver salt having a higher solubility than that of silver bromide, a silver halo-chloride or silver thiocyanate is preferred. In particular, silver chloride or silver chlorobromide and silver chloroiodo-bromide each having a silver chloride content of at least about 60 mole % are preferred, and among these, silver chloride is most preferred.

The deposition of the silver salt on the grains substantially composed of silver bromide can be carried out by separately or simultaneously adding thereto an aqueous silver nitrate solution and an aqueous solution of a proper alkali metal salt (e.g., potassium chloride, potassium citrate, and potassium thiocyanate) or the silver salt may be deposited thereon by adding an emulsion containing the silver salt followed by ripening. Also, in simultaneous with the deposition of the silver salt, a proper amount of silver bromide, silver iodide, or silver iodobromide may be deposited thereon.

The deposition amount of the silver salt having a higher solubility than silver bromide is preferably about 80 mole % or less, more preferably about 60 mole % or less, and most preferably about 40 mole % or less as silver based on the amount of the grains which become the base grains. The most preferable deposition amount of the silver salt is about 30 mole % or less. Also, the deposition amount of the silver salt is preferably at least about 1 mole %, more preferably at least about 2 mole %, and most preferably at least about 3 mole % as silver based oh the amount of the grains which become the base grains.

Only when the aforesaid factors are satisfied, can the change in the grain size and form of the silver halide grains in the subsequent step of halogen conversion be minimized and the pressure resistant characteristics be simultaneously improved, which is one of the objects of this invention.

After depositing the silver salt having a higher solubility than silver bromide, the deposited layer substantially composed of the silver bromide is applied on the deposited layer of the silver salt by a halogen conversion. The halogen conversion is carried out by bromide ions, iodide ions, chloride ions or a mixture of these ions.

In the case of using chloride ions, it is necessary that the amount of the chloride ions which are used for the halogen conversion is less than the content of the chloride of the layer being subjected to the halogen conversion.

If this factor is satisfied, the halogen conversion can be carried out using bromide ions, iodide ion, chloride ions or a mixture thereof. The halogen conversion is performed by adding the aforesaid halogen ions and ripening.

That is, for halogen-converting the deposited layer of the silver salt having higher solubility than silver bromide by adding thereto an aqueous halogen solution, it is preferred to perform the conversion by adding thereto an aqueous solution of potassium bromide, potassium iodide or a mixture thereof. In this case the aqueous halogen solution may contain a proper amount of sodium chloride.

On the other hand, for performing the halogen consion by depositing a silver halide on the layer of the silver salt having a higher solubility than silver bromide, it is preferred to use silver bromide, silver iodide or silver iodobromide as the silver halide being deposited. In this case, the silver halide being deposited may contain a proper amount of silver chloride.

The pAg condition for the halogen-conversion is generally 7.0 or more, preferably 8.0 or more. Especially, the pAg condition for the deposition of the silver halide depends upon the deposition temperature, the deposition rate, and the halogen composition of the silver halide being deposited. Generally, the pAg is higher than 7.5, preferably higher than 8.0, and more preferably higher than 8.5 at 50° C. At 75° C., pAg is generally higher than 7, preferably higher than 7.5, and more preferably higher than 8.0.

At a deposition temperature between 50° C. and 75° C., pAg is preferably a value within a range of the aforesaid pAg values.

The deposition rate of the silver halide is preferably below the critical growing rate and more preferably below ½ of the critical growing rate.

For depositing the silver halide, it is preferred to add an aqueous solution of silver nitrate and an aqueous solution of a halide, to add an aqueous solution of a halide or to add a fine grain silver halide. In the first case, the aqueous silver nitrate solution may be added after the addition of the aqueous halide solution or simultaneously with the addition of the halide solution.

The halogen conversion in this invention does not mean that the whole silver salt having a higher solubility than silver bromide is substantially replaced with the silver halide. Thus, the silver salt having a higher solubility than silver bromide is replaced with the silver halide in an amount of preferably more than about 5 mole % based on silver of salt having a higher solubility, more preferably more than about 10 mole %, and most preferably more than about 20 mole %. The extent of the halogen conversion can be easily determined by comparing the deposited amount of the silver salt having a higher solubility than silver bromide with the analyzed content of the silver salt after the halogen conversion. For example, the amount of the silver salt after the halogen conversion can be confirmed by X-ray diffraction, an EPMA method or XMA method (a method of detecting a silver halide composition by scanning silver halide grains with electron rays, an ESCA method or XPS method (a method of spectroscopically analyzing the photo electrons emitted from the surface of silver halide grains by the irradiation of X rays), or a combination thereof.

The silver halide emulsion of this invention is obtained by further depositing the silver salt after performing the aforesaid halogen conversion and growing the silver halide grains (a formation of shell portions). The growth of the grains can be attained by adding silver ions and bromide ions, iodide ions and/or chloride ions to the reaction system according to a well-known technique.

The halogen composition of the shell portion after the halogen conversion may be uniform or of a layer structure. In the case of a layer structure, it is desirable that the surface layer of the grains contains at least about 3 mole %, and preferably at least about 5 mole % silver iodide and that the layer adjacent to the aforesaid silver iodide-containing surface layer have a lower iodide content than the aforesaid content of silver iodide. Also, after the formation of silver halide grains, the content of iodide in the surface portion may be increased by the addition of silver iodide. By increasing the iodide content in the surface portion of the silver halide grains, the silver halide emulsion showing high sharpness and having improved pressure resistance can be obtained. The silver halide content in the shell portion being deposited after the halogen conversion is from about 10 to about 90 mole %, and preferably from about 30 to about 70 mole % of th whole silver halide grains.

The silver halide grains in this invention may be silver bromide, silver iodobromide, silver iodochlorobromide, or silver chlorobromide.

The core portion of the silver halide grains in this invention contains a high iodide-containing silver halide and the iodide content is in the range of from about 10 mole % to about 45 mole %, and preferably from about 15 mole % to about 40 mole %.

The core portion ma be composed of a uniform phase of silver iodobromide or silver chloroiodo-bromide having an iodide content of from about 10 to about 45 mole % or may have either inside or outside thereof a layer of silver iodobromide or silver chloroiodo-bromide having an iodide content of from about 10 to about 45 mole % a layer of silver halide having a different halogen composition from the aforesaid layer. For example, a layer of silver bromide or a layer of a silver halide having an iodide content of less than about 10 mole % may exist at the inside or outside of the layer of silver iodobromide having an iodide content of from about 10 to about 45 mole %. It is preferred that the ratio of the high-iodide containing silver halide existing in the core is from about 20 to 100 mole %.

The core grains can be formed by an acid method, a neutralization method, an ammonia method, etc., and as the system for reacting a soluble silver salt and soluble halide(s), a single jet method, a double jet method, or a combination thereof can be used. As one type of double jet method, a controlled double jet method wherein pAg in the liquid phase forming silver halide is kept constant, can be used. Also, as another type of double jet method, a triple jet method separately adding soluble halides, each having a different halogen composition (e.g., soluble bromide and soluble iodide), together with a soluble silver salt can be employed. At the formation of the cores, a silver halide solvent such as ammonia, rhodanates, thioureas, thioethers, amines, etc., may be used.

It is preferred that the form of the silver halide grains in the present invention is a normal crystal form. The normal crystal grains mean single crystal grains having no twin plane. Details of such crystal grains are described in T. H. James, *The Theory of the Photographic Process,* 4th edition, published by Macmillan Publishing Co. Inc. 1977.

Examples of the practical crystal form of the silver halide grains in this invention are cubic, octahedral, tetradecahedral, dodecahedral, etc. Also, the silver halide grains having higher order planes described in JP-A-62-123446, JP-A-62-123447, JP-A-62-124550, JP-A-62-124551, and JP-A-62-124552 are included in the normal crystal grains in this invention if they have no twin planes.

In an embodiment of this invention, the silver halide emulsion of this invention is composed of mono-dispersed silver halide grains. Practically speaking, if a mean grain size is shown by $\bar{\gamma}$ and the standard deviation thereof is shown by $\sigma$, the mono-dispersed grains having a coefficient of variation ($\sigma/\bar{\gamma}$) about 30% or less, preferably about 25% or less, and most preferably about 20% or less. In this case, the values of $\bar{\gamma}$ and $\sigma$ are determined by measuring the circle-corresponding diameter of each grain on 600 grains or more by electron microphotograph.

The mono-dispersed silver halide grains as base grains in the present invention may have a structure of two or more phases each having substantially different halogen composition in the grains or may have a uniform composition throughout the whole grains.

In the mono-dispersed silver halide grains having a phase structure of different halogen compositions, the grains may have a high iodine-containing phase at the core portion and a low iodine phase at the outermost phase or may have a lower iodine phase at the core portion and a high iodine phase at the outermost phase. Furthermore, the phase structure may be composed of three or more phases. The difference of iodine content in the high iodine-containing phase and the low iodine-containing phase is at least about 1 mol %.

The mono-dispersed grains in this invention may be composed of a mixture of two or more kinds of mono-dispersed grains each having different grain sizes or may be composed of a mixture with poly-dispersed grains.

In another embodiment of this invention, tabular silver halide grains are used as the base grains. In this case, the deposition of the silver salt having a higher solubility than silver bromide usually occurs not in the annular direction but in the plane direction to the tabular grains. In this invention the deposition of the silver salt in the plane direction is effective.

For example, for depositing silver chloride onto the plane direction of tabular silver halide grains, the deposition is possible in any pAg (the logarithm of the reciprocal of the silver ion concentration in a reaction solution) range when the content of bromide ions or iodide ions in the silver chloride layer thus deposited is about 60% or less.

In this embodiment, the tabular silver halide grains as the base grains in this invention are preferably tabular grains having an aspect ratio of at least 2. In the present invention, the tabular grains generally mean silver halide grains having one twin plane or two or more parallel twin planes. The twin plane in this case means a (111) plane when all the ions at latice points at both the sides of the (111) plane are in a mirror image relationship. When viewed from above, the tabular grains appear to have a triangular form, hexagonal form, or a roundish circular from of the aforesaid form and the triangular tabular grains have triangular outer surfaces which are parallel to each other, the hexagonal tabular grains triangular outer surfaces which are parallel to each other, and the circular tabular grains circular outer surfaces which are parallel to each other.

The grain size distribution of the tabular silver halide grains for use in the present invention is influenced by the size distribution of the tabular grains substantially composed of silver bromide, which are the base grains, onto which a silver salt having a higher solubility than silver bromide is deposited. It is also largely influenced by the growing condition of tabular grains after the deposited silver salt has been subjected to a halogen conversion, that is, by the concentration of a bromide and/or iodide at the growing stage of the tabular grains. For example, if pBr is too low, tabular silver halide grains having a high aspect ratio are formed but the coefficient of variation of the projected areas becomes very large. By keeping pBr at the range of from 2.2 to 5, tabular grains having a small coefficient of variation of projected areas can be obtained.

In order to satisfy the pBr condition, the concentrations of silver salt, bromide and/or iodide and also the addition rates thereof may be same as conventional ones. It is preferred that the silver salt and halides are added each at a concentration of from about 0.1 to 5 moles per liter but a broader concentration range that conventional one, e.g., the range of from about 0.01 mole per liter to saturation, can be employed. In a particularly preferred precipitation forming technique, the addition rates of silver salt and halides are increased to shorten the precipitation forming time. The addition rates of the silver salt and halides can be increased by increasing the rates of introducing the dispersion medium, the silver salt, and the halides, and/or by increasing the concentration of the silver salt and the halides in the dispersion medium. By keeping the addition rates of the silver salt and the halides at about the critical value of causing the growth of new grain nuclei as described in JP-A-55-142329, the coefficient of variation of the projected areas of the grains can be greatly reduced.

Now, tabular silver halide grains substantially composed of silver bromide, which become the base grains onto which a silver salt having a higher solubility than silver bromide is deposited, are explained in further detail.

The tabular silver halide which are base grains in this invention may have a structure of two or more phases, each having substantially different halogen composition in the silver halide grains or may have a uniform halogen composition throughout the whole grains.

In the tabular silver halide grains having the multiphase structure of different halogen compositions, the silver halide grains may have a high iodine-containing phase at the core portion and a low iodine phase at the outermost phase or may have a low iodine phase at the core portion and a high iodine phase at the outermost phase. Furthermore, the silver halide grains may have a structure of three or more phases. The difference of iodine content in the high iodine-containing phase and the low iodine containing pahse is at least about 1 mol %.

The tabular grain silver halide emulsion which is used as the base grains in this invention can be prepared by the following precipitation method. That is, a dispersion medium is placed in a reaction vessel for forming the precipitations of silver halide equipped with a stirring mechanism. The amount of the dispersion medium placed in the reaction vessel in the initial stage is at least about 10%, and preferably from 20 to 80% of the amount of the dispersion medium existing in the silver halide emulsion in he final stage of forming the precipitations of the silver halide grains.

The dispersion medium initially placed in the reaction vessel is water or a medium composed of a deflocculant dissolved in water. The dispersion medium contains, if desired, one or two kinds of silver halide ripening agents and/or metal doping agent as described hereinafter. In the case of initially dissolving the deflocculant in water, the concentration thereof is at least about 10%, and preferably at least 20% of the total amount of the deflocculant existing at the final stage of forming the precipitations of silver halide. In the case of adding the additional deflocculant together with a silver salt and halides to the reaction vessel, it can be introduced by a different jet. In general, for increasing the content of the deflocculant, the concentration of the deflocculant is controlled after completing the introduction of the halides.

A bromide which is used for growth of silver halide grains is usually placed in the reaction vessel in the amount of less than about 10% by weight based on bromide which is used for preparation of silver halide grains at the beginning to control the concentration of bromide ions in the dispersion medium at the initiation of the formation of the precipitations of silver halide. Also, the dispersion medium in the reaction medium initially contains substantially no iodide ions. This is because if iodide ions exist before simultaneously adding a silver salt and a bromide, non-tabular grains are liable to form.

In this invention the term "containing substantially no iodide ions" means that iodide ions exist in an insufficient amount only for precipitating as a different silver iodide phase. It is preferred that the iodide concentration in the reaction vessel before the addition of a silver salt is kept below about 0.5 mole % of the total halide ion concentration in the reaction vessel. If the initial pBr of the dispersion medium is too high, the thickness of the tabular silver iodobromide grains formed becomes excessively high and the thickness distribution of the grains becomes too broad. Also, in this case, the amount of non-tabular grains formed is increased. On the other hand, if the pBr is too low, non-tabular grains are also liable to form. The pBr used in this case is defined as a negative value of the logarithm of the bromide ion concentration.

During the formation of precipitations, a silver salt, a bromide and an iodide are supplied to the reaction vessel according to well-known techniques. Usually, an aqueous solution of a soluble silver salt such as silver nitrate is introduced into the reaction vessel simultaneously with the introduction of a bromide and an iodide. Also, the bromide and iodide are introduced therein as an aqueous solution of salts such as an aqueous solution of soluble ammonium salts, soluble alkali metal halides (e.g., sodium salts and potassium salts), or soluble alkaline earth metal halides (e.g., magnesium halides and calcium halides). The silver salt is at least initially introduced into the reaction vessel separately from the bromide and iodide. Bromide ions and iodide ions are added independently or in combination.

When a silver salt is introduced into the reaction vessel, the nucleus formation stage for silver halide grains is initiated. When the introduction of the silver salt, bromide and iodide is continued, the mother groups for silver halide grain nuclei serving as the precipitation forming sites of silver bromide and silver iodide. Then, by the formation of the precipitations of silver bromide and silver iodide on the existing silver halide grain nuclei, the grains enter the growing stage. For the condition of forming the nuclei, the method described in Japanese Patent Application No. 62-48950 can be referred to but without being limited to the method, for example, the nucleus forming temperature may be in the range of from 5° C. to 55° C.

The amount of the deflocculant such as gelatin in the reaction vessel at the formation of the nuclei greatly influences the distribution of the grain size. The concentration of gelatin is preferably from about 0.5 to about 10% by weight, and more preferably from 0.5 to 6% by weight based on the reaction solution in the reaction vessel.

Also, the rotation number of the stirrer and the shape of the reaction vessel influences the distribution of the grain size.

As a stirring mixer, an apparatus for adding reaction solutions into a liquid followed by mixing as described in U.S. Pat. No. 3,785,777 is preferred. A stirring rotation number which is too low or too high is undesirable. If the stirring rotation number is too low, the formation ratio of non-tabular twin grains is increased; if it is too high, the amount of tabular grains formed is reduced and the grain size distribution is too broad.

Also, a reaction vessel having a semi-spherical bottom is most preferred.

The tabular silver halide grains in this invention formed by depositing a silver salt having a higher solubility than silver bromide onto the aforesaid tabular silver halide grains as the base grains and thereafter depositing thereon a silver halide substantially composed of silver bromide through a halogen conversion has a mean aspect ratio of preferably at least 2, more preferably at least 3, and particularly preferably at least 4. The upper limit of the aspect ratio of preferably 30, and more preferably 20.

The mean aspect ratio of tabular grains in the present invention is at least 0.1 μm (the mean value of the values obtained by dividing the grain sizes by the thicknesses). The measurement of the thickness of grains can be easily made by vapor depositing a metal onto the grains in the slant direction together with a reference latex, measuring the length of each shadow on an electron microphotograph, and calculating the thickness by referring to the length of the shadow of the latex.

The diameter of the tabular grain in this invention is the diameter of a circle having the same area as the projected area of the outer parallel outer surfaces of the grain.

The projected area of the tabular grain is obtained by measuring the area on an electron microphotograph and correcting the photographed magnification.

The diameter of the tabular grains is preferably from 0.15 to 5.0 μm and the thickness of the tabular grains is preferably from 0.05 to 1.0 μm.

The tabular grains account for preferably at least 30%, more preferably at least 50%, and most preferably at least 80% of the total projected area of silver halide grains.

Also, the use of mono-dispersed tabular silver halide grains sometimes gives preferred results. The mono-dispersed tabular silver halide grains having a coefficient of variation of about 30% or less are preferably used. Details of the structure, shapes and the production method of mono-dispersed tabular silver halide grains are described in Japanese Patent Application No. 61-299155. That is, a tabular silver halide grain having a hexagonal form wherein the ratio of he side having the longest length to the side having the shortest length is less than 2 and having two parallel outer surfaces accounts for at least 70% of the total projected area of the silver halide grains, and the tabular grain silver halide has a mono-dispersibility of less than 20% in the coefficient of variation [the value of the deviation (standard deviation) of the grain sizes shown by circularcalculated diameters of the projected areas divided by the mean grain size] of the grain size distribution of the hexagonal tabular silver halide grains. Also, the aspect ratio is at least 2.5 and the grain sizes are at least 0.2 μm.

The tabular silver bromide series grains of this invention having therein a halogen-converted halochloride phase, thiocyanate phase or citrate phase having an aspect ratio of at least 2 has a dislocation in the crystals.

The dislocation of the tabular silver halide grains can be observed by a direct method of using a transmission type electron microscope as described in J. F. Hamilton, *Phot. Sci. Eng.*, 11, 57 (1967) and T. Shiozawa, *J. Soc. Phot. Sci. Japan*, 35, 213 (1972). That is, silver halide grains are carefully recovered from a tabular grain silver halide emulsion so that a pressure of causing the dislocation of the grains is not applied to the grains, placed on a mesh for electron microscopic observation, and then observed by a transmission method in a state of cooling the salt for preventing the sample from being damages (printout, etc.) by electron rays. In this case, as the thickness of the tabular grains increases, the electron rays become more reluctant to transmit and hence the sample can be more clearly observed by using a high-potential type (higher than 200 KV to the grains having a thickness of 0.25 μm) electron microscope. From the photograph of the grains obtained by the aforesaid method, the positions and the numbers of the dislocations can be determined on each grain in the case of viewing from the perpendicular direction to the main plane.

The position of the dislocation of the tabular silver halide grains exists in the main surface of the tabular grains. In the present invention, it is preferred that the dislocations exist in the whole domain of the main surface of the tabular grains.

In the case of producing the tabular grain silver halide emulsion of the present invention, a cadmium salt, a zinc salt, a thallium salt, an iridium salt or a complex salt thereof, a rhodium salt or a complex salt thereof, or an iron salt or a complex salt thereof may be present during the formation and physical ripening of the grains.

At the production of the tabular silver halide grains, the grain sizes, the form of the grains (such as diameter/thickness ratio), the grain size distribution, and the growing rate of the grains can be controlled by using, if necessary, a silver halide solvent. In this case it is preferred that the amount of the silver halide solvent is from $10^{-3}$ to 1.0% by weight, and more preferably from $10^{-2}$ to $10^{-1}$% by weight of the reaction solution.

For example, with the increase of the addition amount of the silver halide solvent, the growing rate of the silver halide grains can be increased and the grain size distribution can be mono-dispersed. On the other hand, the increase of the amount of the silver halide solvent tends to increase the thickness of the tabular grains.

Examples of the silver halide solvent frequently used for the purpose include ammonia, thioether, and thioureas. As the thioether, the disclosures of U.S. Pat. Nos. 3,271,157, 3,790,387, and 3,574,628 can be referred to for examples thereof.

The silver halide grains in the embodiment of this invention may have a normal crystal form such as cubic, octahedral, dodecahedral, and tetradecahedral, or may have a twin form such as spherical, potato-like, and tabular.

In general, silver halide emulsion with the exception of the aforesaid structural features of the silver halide grains in this invention can be easily prepared by the methods described, e.g., in P. Glafikes, *Chime et Physique Photographic* (published by Paul Montel, 1967), G. F. Duffin, *Photographic Emulsion Chemistry,* (published by The Focal Press, 1966), and V. L. Zelikman et al, *Making and Coating Photographic Emulsion,* (published by The Focal Press, 1964).

That is, the emulsion can be prepared by an acid method, a neutralization method, an ammonia method, etc., and as the system used for reacting a soluble silver salt and soluble halide(s), a single jet method, a double jet method, or a combination thereof can be used.

A so-called reverse mixing method for forming silver halide grains in the existence of excessive silver ions can be employed. As one of the double jet method, a so-called controlled double jet method for keeping the pAg in the liquid phase forming silver halide therein at a constant value can be employed.

In the process of forming or physically ripening silver halide grains, a cadmium salt, a zinc salt, a lead salt, a thallium salt, a rhodium salt or a complex salt thereof, an iron salt or a complex salt thereof, etc., may be present in the system.

In this case when physical ripening is carried out in the presence of a silver halide solvent (e.g., ammonium, potassium rhodanate as well as the thioethers and thione compounds described in U.S. Pat. No. 3,271,157 and JP-A-51-12360, JP-A-53-82408, JP-A-53-144319, JP-A-54-100717, and JP-A-54-155838), a mono-dispersed silver halide emulsion containing silver halide grains having a regular crystal form and an almost uniform grain size distribution is obtained.

After the completion of the formation of silver halide grains (i.e., after the formation of precipitates or after physical ripening), soluble salts are usually removed (desalting step) and for this purpose, a well-known noodle washing method of performing the desalting after gelling gelatin or a flocculation method utilizing inorganic salts composed of polyvalent anions (e.g., sodium sulfate), anionic surface active agents, anionic polymers (e.g., polystyrenesulfonic acid), or gelatin derivatives (e.g., aliphatic acylated gelatin, aromatic acylated gelatin, aromatic carbamoylated gelatin, etc.) may be used.

The silver halide emulsions of this invention are usually spectrally sensitized.

As spectral sensitizing dyes, methine dyes are usually used, examples of which include cyanine dyes, merocyanine dyes, complex cyanine dyes, complex merocyanine dyes, holopolar cyanine dyes, hemicyanine dyes, styryl dyes, and hemioxonole dyes. To these dyes can be applied nuclei which are usually utilized as basic heterocyclic nuclei for cyanine dyes, etc. Examples include pyrroline nuclei, oxazole nuclei, thiazole nuclei, selenazole nuclei, imidazole nuclei, tetrazole nuclei, pyridine nuclei, etc.; the nuclei formed by fusing an aliphatic hydrocarbon ring to the aforesaid nuclei, and the nuclei formed by fusing an aromatic hydrocarbon ring to the .aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc., can be applied for the dyes described above. These nuclei may have at least one substituent.

For merocyanine dyes or complex merocyanine dyes, 5-membered or 6-membered heterocyclic nuclei, such as pyrazoline-5-one nuclei, thiohydantoin nuclei, 2-thiooxazolidine 2,4-dione nuclei, thiazolidine-2,4-dione nuclei, rhodanine nuclei, thiobarbituric acid nuclei, etc., as a nucleus having a ketomethylene structure may be applied.

The amount of the sensitizing dyes added to the silver halide emulsions during the preparation thereof depends upon the kinds of additives and the amount of silver halide, etc., but the amount is generally the same as that in conventional cases. That is, a preferred amount of the sensitizing dye is from 0.001 to 100 mmoles, and a more preferred amount is from 0.01 to 10 mmoles per mole of silver halide.

The sensitizing dye(s) are added to the silver halide emulsion either after, during or before chemical ripening. For the silver halide emulsions of the present invention, the sensitizing dye is added most preferably during chemical ripening or before chemical ripening (e.g., at the formation of silver halide grains and at physical ripening).

Of the aforesaid dyes, particularly useful sensitizing dyes are cyanine dyes. Specific examples of useful cyanine dyes for use in the present invention are represented by formula (I);

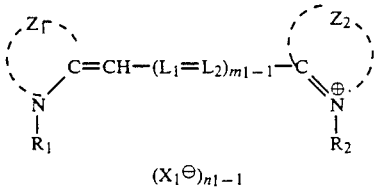

(I)

wherein $Z_1$ and $Z_2$ each independently represents an atomic group necessary for completing a heterocyclic nucleus which is usually used for cyanine dyes, such as a thiazole nucleus, a thiazoline nucleus, a benzothiazole nucleus, a naphthothiazole nucleus, an oxazole nucleus, an oxazoline nucleus, a benzoxazole nucleus, a naphthoxazole nucleus, a tetrazole nucleus, a pyridine nucleus, a quinoline nucleus, an imidazoline nucleus, an imidazole nucleus, a benzimidazole nucleus, a naphthimidazole nucleus, a selenazoline nucleus, a selenazole nucleus, a benzoselenazole nucleus, a naphthoselenazole nucleus, an indolenine nucleus, etc., wherein each of these nuclei may be substituted by a lower alkyl group (e.g., methyl), a halogen atom, a phenyl group, a hydroxy group, an alkoxy group having from 1 to 4 carbon atoms, a carboxy group, an alkoxycarbonyl group, an alkylsulfamoyl group, an alkylcarbamoyl group, an acetyl group, an acetoxy group, a cyano group, a trichloromethyl group, a trifluoromethyl group, a nitro group, etc.

In formula (I) $L_1$ and $L_2$ each independently represents a methine group or a substituted methine group and examples of the substituent of the substituted methine group are a lower alkyl group (such as methyl, ethyl, etc.), a phenyl group, a substituted phenyl group, a methoxy group, and an ethoxy group.

$R_1$ and $R_2$ each independently represents an alkyl group having from 1 to 5 carbon atoms, a substituted alkyl group having a carboxy group, a substituted alkyl group having a sulfo group (such as β-sulfoethyl, γ-sulfopropyl, δ-sulfobutyl, 2-(3-sulfopropoxy)ethyl, 2-[2-(3-sulfopropoxy)ethoxy]ethyl, 2-hydroxysulfopropyl, etc.), an allyl group, or other substituted alkyl group which is usually used as N-substituent for cyanine dyes.

$m_1$ represents 1, 2, or 3; $X_1^-$ represents an acid anion which is usually used for cyanine dyes (such as iodide ions, bromide ions, p-toluenesulfonate ions, perchlorate ions, etc.); $n_1$ represents 1 or 2, further provided that when the dye shown by formula (I) forms a betaine structure, $n_1$ is 1.

Preferred examples of the spectral sensitizing dyes for use in the present invention are illustrated below.

I-1

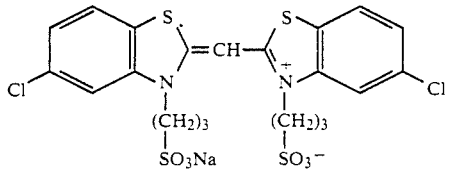

I-2

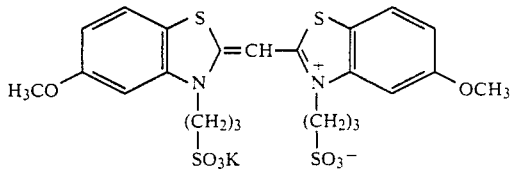

I-3

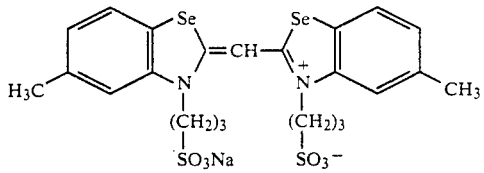

I-4

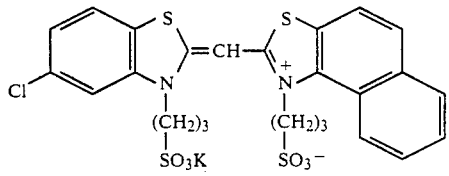

I-5

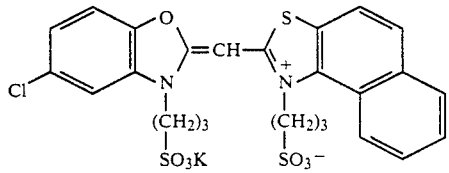

-continued
I-6
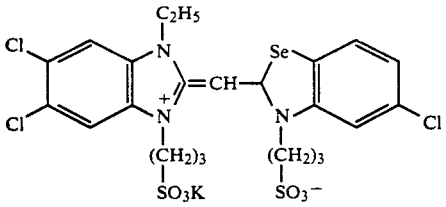
I-7
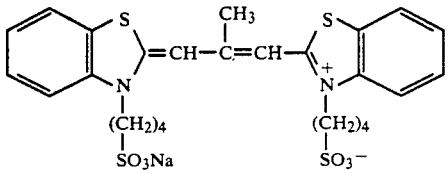
I-8
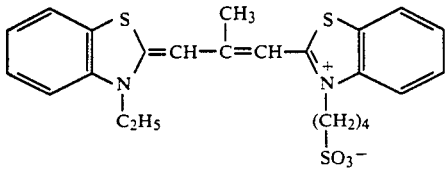
I-9
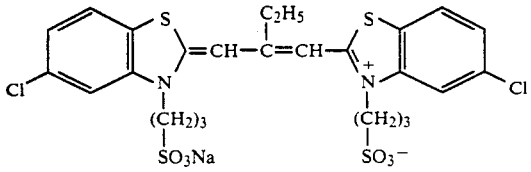
I-10
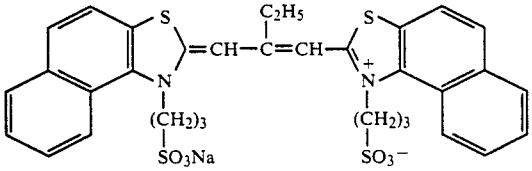
I-11
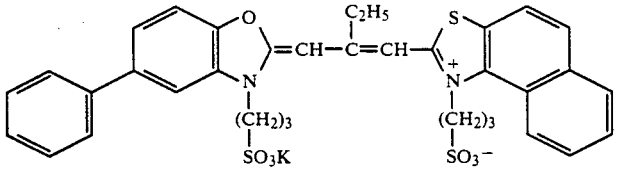
I-12
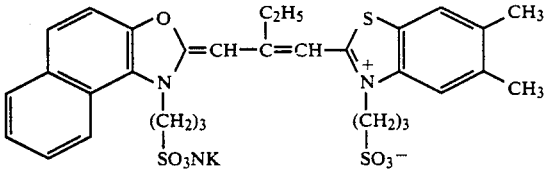
I-13
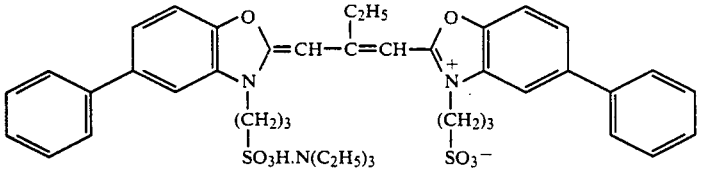

-continued
I-14
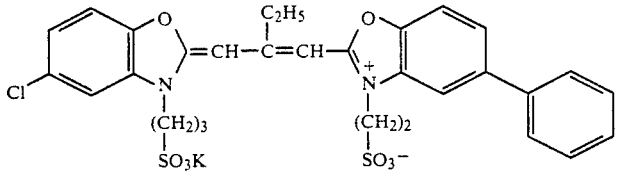
I-15
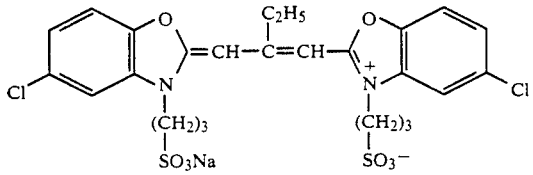
I-16
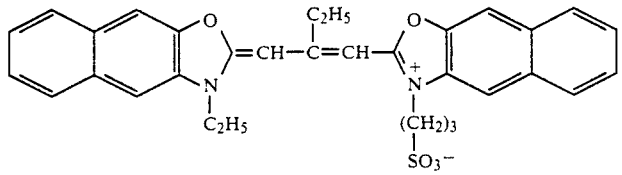
I-17
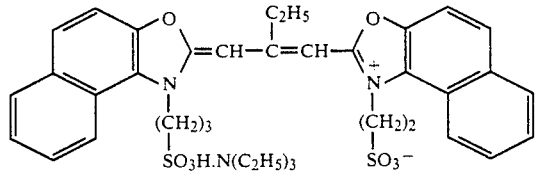
I-18
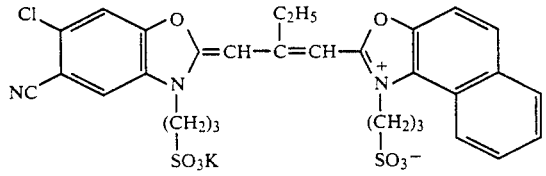
I-19
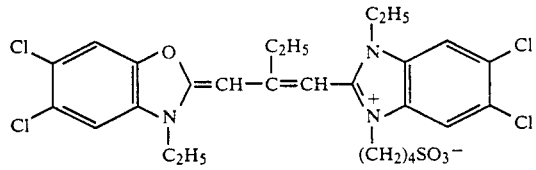
I-20
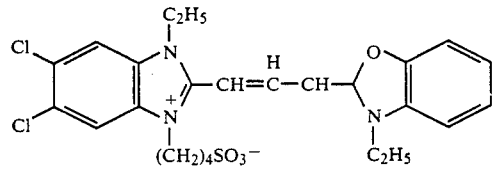
I-21
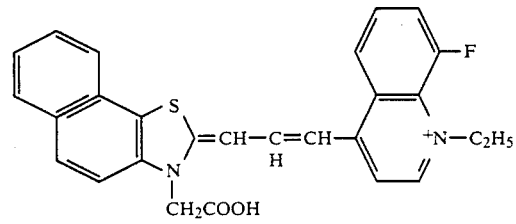

-continued

I-22

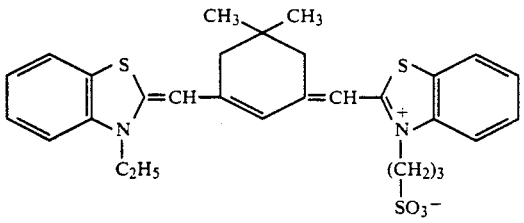

I-23

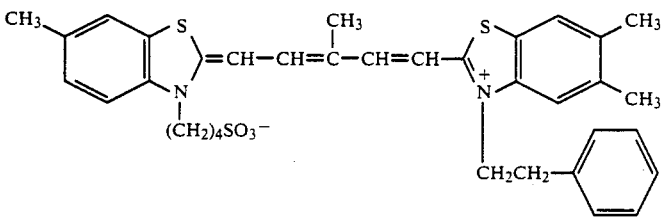

I-24

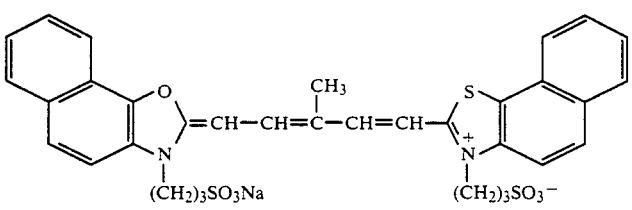

I-25

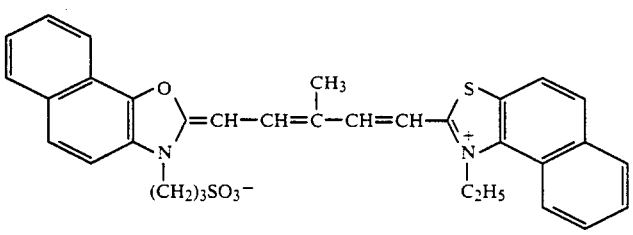

I-26

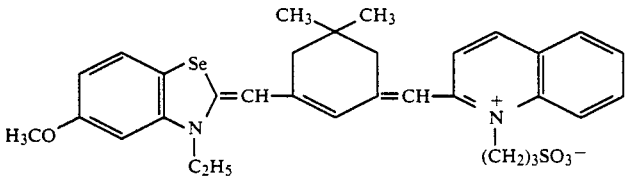

The silver halide emulsion may also contain a dye having no spectral sensitizing action by itself or a material which does not substantially absorb visible light and shows superior color sensitization together with the sensitizing dye(s). For example, the emulsion may contain an aminostyryl compound substituted by a nitrogen-containing heterocyclic group (e.g., those described in U.S. Pat. Nos. 2,933,390 and 3,635,721), an aromatic organic acid-formaldehyde condensate (as described in U.S. Pat. No. 3,743,510), a cadmium salt, or an azaindene compound. The combinations described in U.S. Pat. Nos. 3,615,613, 3,615,641, 3,617,295, and 3,635,721 are particularly useful as the aforesaid material.

The silver halide emulsion of this invention is usually chemically sensitized.

In the most preferred embodiment of the silver halide emulsion of the present invention, the emulsion is chemically sensitized so as to be used as negative working silver halide emulsion. For the chemical sensitization, for example, the method described in H. Frieser, *Die Grundlageh der Photographishen Prozesse mit Silberhalogeniden*, pages 675–734, 1968, can be used.

That is, there are a sulfur sensitization method using active gelatin and a sulfur-containing compound capable of reacting with silver (e.g., thiosulfates, thioureas, mercapto compounds and rhodanines), a reduction sensitizing method using a reducing material (e.g., stannous salts, amines, hydrazine derivatives, formamidinesulfinic acid, and silane compounds), and a noble metal sensitizing method using a noble metal compound (e.g., a gold complex salt and complex salts of metals belonging to group VIII of the periodic table, such as Pt, Ir, Pd, etc.). A combination of these sensitizing methods can be also used.

The silver halide photographic emulsion can further contain various kinds of compounds for preventing the formation of fog during the production, storage, or photographic processing of photographic light-sensitive materials. That is, there are many compounds known as antifoggants or stabilizers, for example, azoles such as benzothiazoliums, nitroindazoles, triazoles, benzotriazoles, and benzimidazoles (in particular, nitro- or halogen-substituted ones); heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), and mercaptopyrimidines; the aforesaid heterocyclic mercapto compounds having a water-solubilizing group such as carboxy group and sulfo group; azaindenes such as tetraazaindenes (in particular, 4-hydroxy-substituted (1,3,3a,7)tetraazaindenes); benzenethiosulfonic acids; and benzenesulfinic acid.

The aforesaid antifoggant or stabilizer is usually added to the emulsion after chemical sensitization but is preferably added during chemical ripening or before the initiation of chemical ripening. That is, the addition of the aforesaid additive may be during the addition of an aqueous silver salt solution, after the addition of the silver salt solution before the initiation of chemical ripening, or during chemical ripening (at chemical ripening, or within, preferably, 50%, more preferably 20% from the initiation of chemical ripening) in the process of forming silver halide grains.

Among the aforesaid compounds, hydroxyazaindene compounds, benzotriazole compounds, and heterocyclic compounds substituted by at least one mercapto group and having at least two azo nitrogen atoms in the molecule are preferred.

As the hydroxyazaindene compounds, the compounds represented by following formula (II) and (III) are preferred;

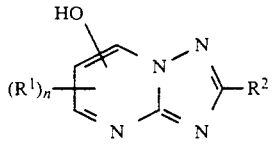
(II)

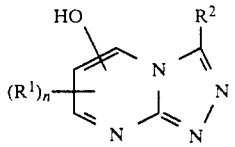
(III)

wherein $R^1$ and $R^2$ which may be the same or each represents a hydrogen atom, an aliphatic residue [such as an alkyl group (e.g., methyl, ethyl, propyl, pentyl, hexyl, octyl, isopropyl, sec-butyl, t-butyl, cyclohexyl, cyclopentylmethyl, and 2-norbornyl), an alkyl group substituted by aromatic residue (e.g., benzyl, phenetyl, benzhydryl, 1-naphthylmethyl, and 3-phenylbutyl), an alkyl group substituted by an alkoxy group (e.g., methoxymethyl, 2-methoxyethyl, 3-ethoxypropyl, and 4-methoxybutyl), or an alkyl group substituted by a hydroxy group, carbonyl group, or hydroxymethyl, 3-hydroxybutyl, carboxymethyl, 2-carboxyethyl, and 2-(methoxycarbonyl)ethyl)] or an aromatic residue [such as an aryl group (e.g., phenyl and 1-naphthyl) or a substituted aryl group (e.g., p-tolyl, m-ethylphenyl, m-cumenyl, mesityl, 2,3-xylyl, p-chlorophenyl, o-bromophenyl, p-hydroxyphenyl, 1-hydroxycarboxy-2-naphthyl, m-methoxyphenyl, p-ethoxyphenyl, p-carboxyphenyl, o-(methoxycarbonyl)phenyl, m-(ethoxycarbonyl)phenyl, and 4-carboxy-1-naphthyl]. The total carbon atom numbers of $R^1$ and $R^2$ are preferably each not more than 12. n represents 1 or 2.

Specific examples of the hydroxytetraazaindene compounds represented by formulae (II) and (III) are described below but the compounds for use in this invention are not limited to these compounds.

II-1: 4-Hydroxy-6-methyl-1,3,3a,7-tetraazaindene
II-2: 4-Hydroxy-1,3,3a,7-tetraazaindene
II-3: 4-Hydroxy-6-phenyl-1,3,3a,7-tetraazaindene
II-4: 4-Methyl-6-hydroxy-1,3,3a,7-tetraazaindene
II-5: 2,6-Dimethyl-4-hydroxy-1,3,3a,7-tetraazaindene
II-6: 4-Hydroxy-5-ethyl-6-methyl-1,3,3a,7-tetraazaindene
II-7: 2,6-Dimethyl-4-hydroxy-5-ethyl-1,3,3a,7-tetraazaindene
II-8: 4-Hydroxy-5,6-dimethyl-1,3,3a,7-tetraazaindene
II-9: 2,5,6-Trimethyl-4-hydroxy-1,3,3a,7 -tetraazaindene
II-10: 2-Methyl-4-hydroxy-6-phenyl-1,3,3a,7-tetraazaindene
II-11: 4-Methyl-6-hydroxy-1,2,7-tetraazaindene
II-12: 5,6-Trimethylene-4-hydroxy-1,3,3a,7-tetraazaindene
III-1: 4-Hydroxy-6-methyl 1,2,3a,7-tetraazaindene
III-2: 4-Hydroxy-6-ethyl-1,2,3a,7-tetraazaindene
III-3: 4-Hydroxy-6-phenyl-1,2,3a,7-tetraazaindene
III-4: 4-Hydroxy-1,2,3a,7-tetraazaindene Also, as the benzotriazole compounds described above there are compounds represented by formula (IV);

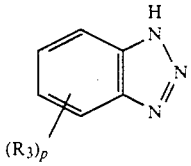
(IV)

wherein p represents an integer of from 0 to 4 and $R_3$ represents a halogen atom (e.g., chlorine, bromine, or iodine) or an aliphatic group (including saturated aliphatic groups and unsaturated aliphatic groups). Examples of the aliphatic group include an unsubstituted alkyl group preferably having from 1 to 8 carbon atoms (e.g., methyl, ethyl, n-propyl, and hexyl), a substituted alkyl group [the alkyl moiety preferably having from 1 to 4 carbon atoms, such as a vinylmethyl group, an aralkyl group (e.g., benzyl and phenetyl), a hydroxyalkyl group (e.g., 2-hydroxyethyl, 3-hydroxypropyl, and 4-hydroxybutyl), an acetoxyalkyl group (e.g., 2-acetoxyethyl and 3-acetoxypropyl), an alkoxyalkyl group (e.g., 2-methoxyethyl and methoxybutyl), etc.] and an aryl group (e.g., phenyl group).

$R_3$ is more preferably a halogen atom (e.g., chlorine and iodine) or an alkyl group having from 1 to 3 carbon atoms (e.g., methyl, ethyl, and propyl).

Specific examples of the benzotriazole compounds represented by formula (IV) are illustrated below although the invention is not limited to them.

IV-1: Benzotriazole
IV-2: 5-Methylbenzotriazole
IV-3: 5-Nitro-6-chlorobenzotriazole

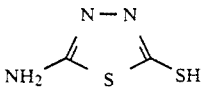
VI-4

-continued

VI-5

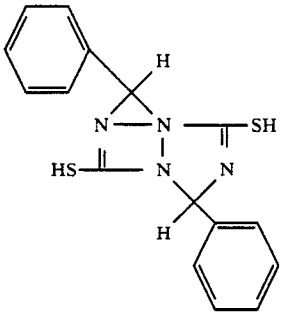

VI-6

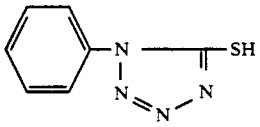

VI-7

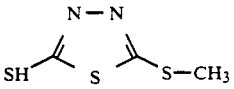

VI-8

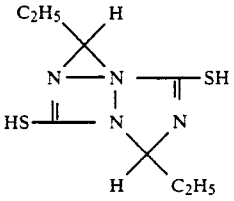

VI-9

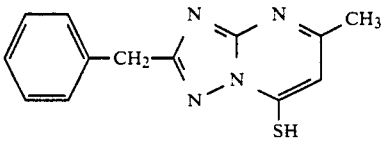

VI-10

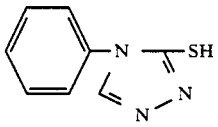

VI-11

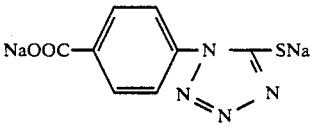

Now, the aforesaid heterocyclic compound substituted by at least one mercapto group and having at least two azo nitrogen atoms in the molecule (hereinafter, it referred to as a nitrogen-containing heterocyclic compound having a mercapto group) will be explained in detail.

Such a compound may have, in addition to nitrogen atoms, another hetero atom such as an oxygen atom, sulfur atom, selenium atom, etc., in the heterocyclic ring. Examples of the nitrogen-containing heterocyclic compound include a 5-membered or 6-membered monocyclic heterocyclic compound having at least two azo nitrogen atoms and a dicyclic or tricyclic heterocyclic compound formed by the condensation of two or three heterocyclic rings, each having at least one azo nitrogen atom, the compound having a mercapto group substituted on the carbon atom adjacent to the azo nitrogen atom.

In the nitrogen-containing heterocyclic compound having a mercapto group for use in the present invention, examples of the heterocyclic ring include a pyrazole ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, a 1,2,4-triazine ring, a 1,3,5-triazine ring and a ring formed by the condensation of two or three of these rings (such as triazolotriazole ring, a diazaindene ring, a triazaindene ring, a tetraazaindene ring, a pentaazaindene ring, etc.). A heterocyclic ring formed by the condensation of a monocyclic heterocyclic ring and an aromatic ring, such as a phthalazine ring and an indazole ring can also be used in the present invention.

Among the aforesaid rings, 1 1,3,4-thiadiazole ring, a 1,2,3,4-tetrazole ring, a 1,2,4-triazine ring, a triazolotriazole ring, and a tetraazaindene ring are preferred.

Specific examples of the nitrogen-containing heterocyclic compound having a mercapto group are illustrated below although the compounds for use in the present invention are not limited to them.

V-1

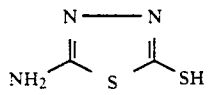

V-2

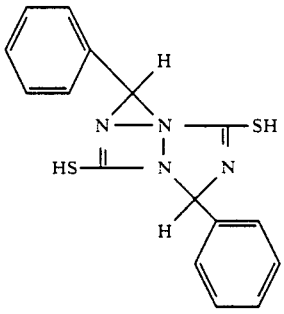

V-3

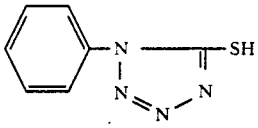

V-4

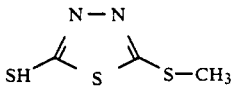

V-5

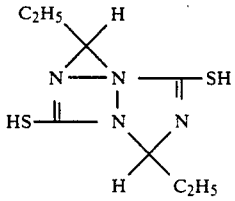

V-6

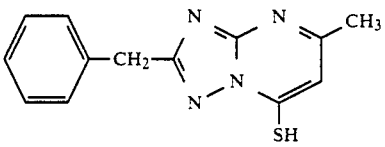

-continued

V-7

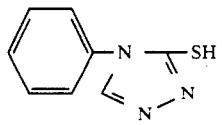

V-8

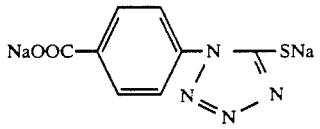

The addition amount of each of the compounds shown by formulae (II), (III), (IV), and (V) differs according to the addition method and the amount of silver halide but is preferably from $10^{-7}$ mole to $10^{-2}$ mole, and more preferably from $10^{-5}$ to $10^{-2}$ mole per mole of silver halide.

The silver halide emulsion of this invention can be used for photographic light-sensitive materials in an optional layer structure such as a single layer and a double layer.

The multilayer color photographic material using the silver halide emulsions of this invention has a multilayer structure of superposed emulsion layers, each containing a binder and silver halide grains for separately recording blue, green and red light and each silver halide emulsion layer is composed of at least two emulsion layers, viz., a high-speed emulsion layer and a low-speed emulsion layer.

Preferred layer structures are (1) BH/BL/GH/BL/RH/RL/S and (2) BH/BM/BL/GH/GM/GL/RH/RM/RL/S, (3) BH/BL/GH/RH/GL/RL/S, as described in U.S. Pat. No. 4,184,876, and (4) BH/GH/RH/BL/GL/RL/S described in *Research Disclosure,* No. 22534, JP-A-59-177551 and JP-A 59-177552.

In the aforesaid layer structures, B represents a blue-sensitive emulsion layer, G a green sensitive emulsion layer, R a red-sensitive emulsion layer, H the high sensitive layer, M an intermediate sensitive layer, L a low sensitive layer, and S a support. The aforesaid layer structures may further have light insensitive layers such as protective layers, filter layers, intermediate layers, antihalation layers, subbing layers, etc., which have been omitted in the aforesaid expressions.

Among the aforesaid layer structures, (1), (2) and (4) are preferred.

The layer structures represented by (5) BH/BL/CL/GH/GL/RH/RL/S and (6) BH/BL/GH/GL/CL/RH/RL/S, each described in JP-A-61-34541 are also preferred.

In the aforesaid structures, CL represents a double layer effect providing layer and others are same as above.

Also, in the same color-sensitive layers, the order of the high-sensitive layer and the low-sensitive layer may be reversed.

As described above, the silver halide emulsions of this invention can be applied to a color photographic material but can be also applied to other light-sensitive materials such as radiographic light sensitive materials, black and white light-sensitive materials for camera use, light-sensitive materials for making printing plates, photographic papers, etc., regardless of the layer structure.

There are no particular restrictions on the various additives for the silver halide emulsions of this invention, such as binders, chemical sensitizers, spectral sensitizers, stabilizers, gelatin hardeners, surface active agents, antistatic agents, polymer latexes, matting agents, color couplers, ultraviolet absorbents, fading preventing agents, dyes, etc., as well as the supports for the light-sensitive materials using the emulsions, the coating methods for the emulsions, the light-exposure method, the photographic processing method, etc. These are described, for example, in *Research Disclosure,* Vol. 176, No. 17643 (RD-17643), ibid, Vol. 187, No. 18716 (RD-18716), and ibid, Vol. 225, No. 22534 (RD-22534).

The descriptions of them are summarized in Table 1.

TABLE 1

| Additives | RD 17643 | RD 18716 | RD 22534 |
|---|---|---|---|
| 1. Chemical Sensitizer | Page 23 | Page 648 right column | Page 24 |
| 2. Sensitivity Increasing Agent | | Page 648 right column | |
| 3. Spectral Sensitizer, Super Color Sensitizer | Pages 23 to 24 | Page 648, right column to page 649, right column | Pages 24 to 28 |
| 4. Whitening | Page 24 | | |
| 5. Antifoggant and Stabilizer | Pages 24 to 26 | Page 649, right column | Pages 24 and 31 |
| 6. Light Absorbent, Filter Dyes, and Ultraviolet Absorbent | Pages 25 to 26 | Page 649, right column to page 650, left column | |
| 7. Stain Preventing Agent | Page 25, right column | Page 650, left to right columns | |
| 8. Color Image Stabilizer | Page 25 | | Page 32 |
| 9. Hardener | Page 26 | Page 651, left column | page 28 |
| 10.Binder | Page 26 | Page 651, left column | |
| 11.Plasticizer, and Lubricant | Page 27 | Page 650, right column | |
| 12.Coating Aid and Surfactant | Pages 26 to 27 | Page 650, right column | |
| 13.Antistatic Agent | Page 27 | Page 650, right column | |
| 14.Color Coupler | Page 25 | Page 649 | Page 31 |

In the case of applying the silver halide emulsions of this invention to color photographic materials, it is preferred that the color couplers for use are non-diffusible by having a ballast group or being polymerized. In this case, 2 equivalent couplers the coupling active position of which is substituted by a coupling releasing group are more preferred than 4 equivalent couplers having a hydrogen atom at the coupling active position from the point of view of capability of reducing the silver amount. Furthermore, couplers giving colored dyes having a proper diffusibility, noncoloring couplers, DIR couplers releasing development inhibitor with coupling reaction, or couplers releasing development accelerator with coupling reaction can be used in the present invention.

Typical examples of yellow couplers which can be used for the silver halide emulsions of this invention include oil-protective type acylamide series couplers and specific examples thereof are described in U.S. Pat. Nos. 2,407,210, 2,875,057 and 3,265,506. As the yellow couplers, 2 equivalent yellow couplers are preferably used and typical examples thereof are oxygen atom releasing type yellow couplers described in U.S. Pat. Nos. 3,408,194, 3,447,928, 3,933,501 and 4,022,620 and nitrogen atom releasing type yellow couplers described in JP-B-58-10739, U.S. Pat. Nos. 4,401,752 and 4,326,024, *Research Disclosure,* No. 18053 (April, 1979), British Patent 1,425,020, West German Patent Application (OLS) Nos. 2,219,917, 2,261,361, 2,329,587, and 2,433,812. Among these couplers, α-pivaloylacetanilide series couplers are excellent in fastness, in particular light fastness of colored dyes formed while α-benzoylacetanilide series couplers give high coloring density.

As magenta couplers for use in this invention, there are oil-protective type indazolone series and cyanoacetyl series couplers, and preferably 5-pyrazolone series couplers and pyrozoloazole series couplers such as pyrazolotriazoles. The 5-pyrazolone series couplers substituted by an arylamino group or an acylamino group at the 3-position are preferred in the view point of the hue and color density of the colored dyes. Typical examples of these magenta dyes are described in U.S. Pat. Nos. 2,311,082, 2,343,703, 2,600,788, 2,908,573, 3,062,653, 3,152,896, and 3,936,015.

As the releasing groups for the 2 equivalent 5-pyrazolone series couplers, the nitrogen atom releasing group described in U.S. Pat. No. 4,310,619 and the arylthio group described in U.S. Pat. No. 4,351,897 are particularly preferred. Also, the 5-pyrazolone series couplers having a ballast group described in European Patent 73,636 give a high coloring density.

Pyrazoloazole series magenta couplers include pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure* (RD No. 24220) (June, 1984) and JP-A-60-33552, and pyrazolopyrazoles described in ibid., (RD No. 24230) (June 1984) and JP-A-60-43659. from the view point of less yellow side absorption of colored dyes and high light fastness of colored dyes, imidazo[1,2-d]pyrazoles described in U.S. Pat. No. 4,500,630 and pyrazolo[1,5-b][1,2,4]triazoles described in U.S. Pat. No. 4,540,654 are particularly preferred.

As the cyan couplers for use in the present invention, there are phenolic or naphtholic couplers and preferred examples thereof are the naphtholic couplers described in U.S. Pat. No. 2,474,293 and more preferably the oxygen atom releasing type 2-equivalent naphtholic couplers described in U.S. Pat. Nos. 4,952,212, 4,146,396, 4,228,233, and 4,296,200.

Also, specific examples of the phenolic couplers are described in U.S. Pat. Nos. 2,369,929, 2,801,171, 2,772,162 and 2,895,826. Cyan couplers having high fastness to humidity and temperature are preferrably used in this invention and specific examples thereof are the phenolic cyan couplers having an alkyl group having at least 2 carbon atoms at the meta position of the phenol nucleus described in U.S. Pat. No. 3,772,002, the 2,5-diacylamino-substituted phenolic couplers described in U.S. Pat. Nos. 2,772,162, 3,758,308, 4,126,396, 4,334,011 and 4,327,173, West German Patent Application (OLS) No. 3,329,729 and European Patent 121,365, and the phenolic couplers having a phenylureido group at the 2-position and an acylamino group at the 5-position described in U.S. Pat. Nos. 3,446,622, 4,333,999, 4,451,559, and 4,427,767. The cyan couplers having a sulfonamido group or an amido group at the 5-position of the naphthol nucleus described in JP A-60-237448 , JP-A-61-153640 and JP-A-61-145557 can be preferably owing to the excellent fastness of colored images formed.

Also, for correcting the unnecessary absorption of the dyes formed by the magenta and cyan couplers at the short wavelength, it is preferred to use colored couplers together with the aforesaid couplers. Typical examples thereof are the yellow colored magenta couplers described in U.S. Pat. No. 4,163,670 and JP-B-57-39413 and the magenta colored cyan couplers described in U.S. Pat. Nos. 4,138,258 and 4,004,929 and British Patent 1,146,368.

Furthermore, by using couplers forming colored dyes having a proper diffusibility together with color couplers, the graininess can be improved. As such couplers, specific examples of the magenta couplers are described in U.S. Pat. No. 4,366,237 and British Patent 2,125,570 and specific examples of the yellow, magenta and cyan couplers are described in European Patent 96,570 and West German Patent (OLS) No. 3,234,533.

The dye-forming couplers and the specific couplers described above may form a dimer or higher polymer. Typical examples of the polymerized dye-forming couplers are described in U.S. Pat. Nos. 3,451,820 and 4,080,211. Also, specific examples of the polymerized magenta couplers are described in British Patent 2,102,173, U.S. Pat. No. 4,367,282, and JP-A-61-232455 and JP-A-62-54260.

The silver halide emulsions of the present invention may also contain so-called DIR couplers releasing a development inhibitor upon development.

As the DIR couplers, there are the couplers releasing a heterocyclic mercapto series development inhibitor described in U.S. Pat. No. 3,227,554; the couplers releasing a benzotriazole derivative as a development inhibitor described in JP-B 51-16141; the couplers releasing a nitrogen-containing heterocyclic development inhibitor accompanied by the decomposition of methylol after the release thereof described in JP-A-52-90932; the couplers releasing a development inhibitor accompanied by an intramolecular nucleating reaction after release thereof described in U.S. Pat. No. 4,248,962 and JP-A-57-56837; the couplers releasing a development inhibitor by an electron transfer through a covalent system after release thereof described in JP-A-56-114946, JP-A-57-154234, JP-A-57-188035, JP-A-58-98728, JP-A-58-209736, JP-A-58-209737, JP-A-58-209738, JP-A-58-209739, and JP-A-58-209740; the couplers releasing a diffusible development inhibitor, the development inhibiting faculty of which is inactivated in the color developer described in JP-A-57-151944 and JP-A-58-217932; and the couplers releasing a reactive compound to form a development inhibitor by a reaction in the layer upon development or inactive the development inhibitor described in JP-A-60-182438 and JP-A-60-184248.

In the DIR couplers described above, the developer inactivation type couplers described in JP-A-57-151944, the timing type couplers described in U.S. Pat. No. 4,248,962 and JP-A-57-154234, and the reaction type couplers described in JP-A-60-184248 are more preferred in combination with the present invention. Among the aforesaid preferred DIR couplers, the development inactivation type couplers described in JP-A-57-151944, JP-A-58-217932, JP-A-60-218644, JP-A-60-225156, JP-A-60-225148, and JP-A-60-232656 and the reactive type couplers described in JP A-60-39653 are particularly preferred.

For the color photographic materials containing the silver halide emulsions of the present invention, a compound which imagewise releases a nucleating agent or a development accelerator, or a precursor therefor (hereinafter, is referred to as "development accelerator, etc.") at development. Typical examples of the compound are described in British Patents 2,097,140 and 2,131,188. The aforesaid compound is a DAR coupler, i.e., the coupler releasing a development accelerator by a coupling reaction with the oxidation product of an aromatic primary amine color developing agent.

It is preferred that the development accelerator, etc., released from the DAR coupler have an absorptive affinity for silver halide and specific examples of such a DAR coupler are described in JP-A-59-157638 and JP-A-59-170840. The DAR couplers releasing an N-acyl-substituted hydrazine having a monocyclic or condensed heterocyclic ring as the adsorptive group at the sulfur atom or nitrogen atom from the coupling active portion of the coupler are particularly preferred and specific examples thereof are described in JP-A-60-128446.

Specific examples of the high-boiling organic solvent which is used for dispersing the aforesaid couplers in the emulsions of the present invention include phthalic acid esters (e.g., dibutyl phthalate, dicyclohexyl phthalate, di-2-ethylhexyl phthalate, and decyl phthalate), phosphoric acid esters or phosphinic acid esters (e.g., triphenyl phosphate, tricresyl phosphate, 2-ethylhydroxyldiphenyl phosphate, tricyclohexl phosphate, tri-2-ethylhexyl phosphate, tridecyl phosphate, tributoxyethyl phosphate, trichloropropyl phosphate, and di-2-ethylhexylphenyl phosphate), benzoic acid esters (e.g., 2-ethylhexyl benzoate, dodecyl benzoate, and 2-ethylhexyl-p-hydroxy benzoate), amides (e.g., diethyldodecaneamide and N-tetradecylpyrrolidone), alcohols and phenols (e.g, isostearyl alcohol and 2,4-di-tert-amylphenol), aliphatic carboxylic acid esters (e.g., dioctyl azerate, glycerol tributyrate, isostearyl lactate, and trioctyl citrate), aniline derivatives (e.g., N,N-dibutyl-2-butoxy-5-tert-octylaniline), and hydrocarbons (e.g., paraffin, dodecylbenzene, and diisopropylnaphthalene).

As the auxiliary solvents, organic solvents having a boiling point of at least bout 30° C., preferably from about 50° C. to about 160° C. can be used, and specific examples thereof are ethyl acetate, butyl acetate, ethyl propionate, methyl ethyl ketone, cyclohexanone, 2-ethoxypropionate, and dimethylformamide.

Proper supports which can be used for the silver halide photographic emulsions of the present invention are described, e.g., in *Research Disclosure,* No. 17643, page 28 and ibid., No. 18716, pages 747, right column to page 648, left column.

As a binder for the silver halide emulsions, gelatin is preferred but gelatin derivatives (such as phthalated gelatin), dextran, cellulose derivatives, polyvinyl acetate, polyacrylamide, polyvinyl alcohol, etc., can also be used.

As the gelatin hardeners for use in the present invention, active halogen compounds (e.g., 2,4-dichloro-6-hydroxy-1,3,5-triazine and the sodium salt thereof) and active vinyl compounds (e.g., 1,3-bisvinylsufonyl-2-propanol 1,2-bis(vinylsulfonylacetamido)ethane, and a vinylic polymer having a vinylsulfonyl group in the side chain) are preferred since they harden quickly a hydrophilic colloid such as gelatin to give stable photographic characteristics.

Also, N-carbamoylpyridinium salts [e.g., (1-morpholinocarbonyl-3-pyridinio)methane sulfonate] and haloazinium salts [e.g., 1-(1-chloro-1-pyridinomethylene)pyrrolidinium 2-naphthalenesulfonate] are excellent in the point of high hardening rate.

The color photographic light sensitive materials containing the silver halide photographic emulsions of the present invention can be processed by conventional processes described in *Research Disclosure,* No. 17643 pages 28 to 29 and ibid., No. 18716, page 651, left column to right column.

The color photographic light-sensitive materials containing the silver halide photographic emulsions of the present invention are usually subjected to a wash process or stabilization process after development and blixing (bleach-fixing) or fixing.

The wash step is generally carried out by a countercurrent system using two or more baths for saving water. As the stabilization process which can be used in place of the wash step, there is typically the multistage countercurrent stabilization process as described in JP-A-57-8543.

A color developer which is used for developing the aforesaid color photographic materials comprises an alkaline aqueous solution of an aromatic primary amino color developing agent as the main component. As the color developing agent, aminophenol series compounds are useful but p-phenylenediamine series compounds are preferred. Typical examples thereof are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and their sulfates, hydrochlorides, and p-toluenesulfonates. These compounds may be used singly or, according to a specific purpose, as a mixture of two or more compounds.

The color developer generally contains a pH buffer such as a carbonate, borate or phosphate of an alkali metal or a development inhibitor or antifoggant such as bromides, iodides, benzimidazoles, benzothiazoles, and mercapto compounds.

Also, the color developers also may contain, if necessary, various kinds of preservatives such as hydroxylamine, diethylhydroxylamine, sulfites, hydrazines, phenylsemicarbazides, triethanolamine, catecholsulfonic acids, triethylenediamine(1,4-diazabicyclo[2,2]octane), etc.; organic solvents such as ethylene glycol, diethylene glycol, etc.; development accelerators such as benzyl alcohol, polyethylene glycol, quaternary ammonium salts, amines, etc.; dye forming couplers; competing couplers; auxiliary developing agents such as 1-phenyl-3-pyrazolidone, etc.; fogging agents such as sodium boronhydride, etc.; tackifiers; and various chelating agents typified by aminopolycarboxylic acids, aminopolyphosphonic acids, alkylphosphonic acids and phosphonocarboxylic acids (e.g., ethylenediaminetetraacetic acid, nitrotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and their salts.

Also, in the case of performing reversal processing, a color development is usually carried out by performing black and white development. For the black and white developer, known developers such as dihydroxybenzenes (e.g., hydroquinone), 3-pyrazolidones (e.g., 1-phenyl-3-pyrazolidone), and aminophenols (e.g., N-methyl-p-aminophenol) can be used singly or as a combination thereof.

The pH of the color developer and the black and white developer is generally from 9 to 12.

Also, the replenishing amount of these developers is generally 3 liters or less per square meter of a color photographic material being processed although it depends upon the kind of the color photographic material and the amount can be reduced below 500 ml by reducing the bromide ion concentration of the replenisher. In the case of reducing the replenishing amount, it is preferred to prevent the evaporation and oxidation by air of the solution by reducing the contact area with air. Also, the replenisher amount can be reduced by using a means of restraining he accumulation of bromide ions in the developer.

After color development, the photographic emulsion layers are usually bleached. The bleach process may be performed simultaneous with fixing (blix process) or separately from a fixing process. Furthermore, for quickening processing, a process of performing blixing after bleaching may be employed. Furthermore, a process of performing the blix process using two connected blix baths, a process of performing a fix process before blixing, or a process of performing bleaching after blix process can be optionally employed according to specific purposes.

Examples of the bleaching agent include compounds of polyvalent metals such as iron(III), cobalt(III), chromium(VI), copper(II), etc., peracids, quinones, nitro compounds, etc.

Typical bleaching agents are ferrycyanides, perchromates, organic complex salts of iron(III) or cobalt(III), such as the complex salts thereof with aminopolycaroxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether aminetetraacetic acid) or with citric acid, tartaric acid or malic acid; persulfates, bromates; permanganates; nitrobenzenes; etc.

Among these materials, aminopolycarboxylic acid iron(III) complex salts such as ethylenediaminetetraacetic acid iron(III) complex salt, etc., and persulfates are preferred from the view points of quick processing and the prevention of environmental pollution. Furthermore, aminopolycarboxylic acid iron(III) complex salts are particularly useful in both bleach solutions and blix solutions. The pH of the bleach solution or blix solution using such an aminopolycarboxylic acid iron(III) complex salt is usually from 5.5 to 8 but a lower pH may be employed for quickening the processing.

For the bleach solution, the blix solution and a prebath therefor may be used, if necessary, a bleach accelerator.

Practical examples of useful bleaching agents are the compounds having a mercapto group or a disulfide bond described in U.S. Pat. No. 3,893,858, West German Patent 1,290,812, JP-A-53-95630, and *research Disclosure,* No. 17129 (July, 1978); the thiazolidine derivatives described in JP-A-50-140129; the thiourea derivatives described in U.S. Pat. No. 3,706,561; the iodides described in JP-A-58-16235; the polyoxyethylene compounds described in West German Patent 2,748,430; the polyamine compounds described in JP-B-45-8836; and bromide ions.

Among the aforesaid compounds, the compounds having a mercapto group or a disulfide group are preferred in the view point of showing a high acceleration effect and the compounds described in aforesaid U.S. Pat. No. 3,893,858, West German Patent 1,290,812 and JP-A-53-95630 are particularly preferred. Furthermore, the compounds described in U.S. Pat. No. 4,552,834 are also preferred.

The bleach accelerator may be present in a color photographic light-sensitive material.

In the case of blixing color photographic light-sensitive materials for camera use, the aforesaid bleaching accelerators are particularly effective.

As the fixing agent, there are thiosulfates, thiocyanates, thioether series compounds, thioureas, a large amount of iodides, etc., but thiosulfates are generally used and ammonium thiosulfate is most widely used.

As a preservative for the blix solution, sulfites, hydrogensulfites, or carbonyl-hydrogensulfuric acid addition products are preferred.

The silver halide color photographic light-sensitive materials containing the photographic emulsions of the present invention are generally washed and/or stabilized after desilvering process. The amount of wash water in the wash step can be widely varied according to various conditions such as the characteristics (e.g., by the materials such as couplers, etc.) and the uses of photographic light-sensitive materials, the washing temperature, the number (stage number) of washing tanks, the replenishing system such as countercurrent and normal current, and other factors. In this case, the relation between the number of washing tanks and the amount of water in a multistage countercurrent system can be determined by the manner described in the *Journal of Motion Picture and Television Engineers,* Vol. 64, 248–253 (1955, May).

According to the multistage countercurrent system described in the aforesaid literature, the amount of wash water can be greatly reduced; however, the increase of the residence time of water in the tanks allows for bacteria to grow and floating to attach to the light-sensitive materials. In processing the color photographic materials containing the photographic emulsions of the present invention, a method of reducing calcium ions and magnesium ions described in JP-A-62-288838 can be effectively used for solving the aforesaid problem. Also, chlorine series antibacterial agents such as isothiazolone compounds, thiabenzazoles, chlorinated sodium isocyanurate, etc., described in JP-A-57-8542, other benzotriazoles, and the antibacterial agents described in Hiroshi Noguchi, *Bokin Bobaizai no Kagaku* (*Chemistry of Antibacterial and Antifungal Agents*), *Biseibutsu no Mekkin, Sakkin, Bobai Gijutsu* (*Sterilization and Antifungal Techniques of Microorganisms*), edited by Eisei Gijutsu Kai, and *Bokin Bobai Zai Jiten* (*Antibacterial and Antifungal Agent Handbook*), edited by Nippon Bokin Bobai Gakkai.

The pH of wash water in processing for the photographic light-sensitive materials is from 4 to 9, and preferably from 5 to 8. The washing temperature and the washing time can be suitably selected according to the characteristics, uses, etc., of photographic light-sensitive materials but are generally selected to be in the range of from 20 seconds to 10 minutes at a temperature of from 15° C. to 45° C. and preferably from 30 seconds to 5 minutes at a temperature of from 25° C. to 40° C.

Furthermore, the photographic light-sensitive materials can be directly processed by a stabilizing solution in place of washing. For such a stabilization process, the methods described in JP-A-57-8543, JP-A-58-14834, and JP-A-60-220345 can be used.

Also, as the case may be, a stabilization process is performed after the aforesaid wash process, and as such an example, there is a stabilization bath containing formalin and a surface active agent, which is used as a final bath of color photographic materials for camera use. The stabilization bath may further contain the aforesaid chelating agent and antibacterial and antifungal agents.

Overflow liquids formed with the replenishing of the aforesaid wash water and/or the stabilization liquid can be reused for the desilvering step, etc.

The color photographic light-sensitive materials may also contain therein a color developing agent for the simplification and quickening of processing. For incorporating these in the photographic material, it is preferred to use various precursors of color developing agents. Examples of such precursors are indoaniline series compounds described in U.S. Pat. No. 3,342,597, Schiff base type compounds described in U.S. Pat. No. 3,342,599 and *Research Disclosure,* No. 14850 and ibid., No. 15159, aldol compounds described in ibid., No. 13924, metal salt complexes described in U.S. Pat. No. 3,719,492, and urethane series compounds described in JP-A-53-135628.

Each of the aforesaid processing solutions is used at a temperature of from 10° C. to 50° C. A standard processing temperature is from 33° C. to 38° C. but a higher processing temperature may be employed for accelerating processing to reduce the processing time or a lower temperature may be employed for improving the image quality and the stability of the processing solutions. Also, for saving silver in the photographic light-sensitive materials, a process of using a cobalt intensification or a hydrogen peroxide intensification described in West German Patent 2,226,770 and U.S. Pat. No. 3,674,499 may be used.

The following examples serve to illustrate the invention without limiting, however, the scope of the invention. Unless otherwise indicated, all parts, percents, ratios, etc. are by weight.

EXAMPLE 1

The preparation of the silver halide emulsions of the present invention is explained.

While keeping 970 ml of an aqueous solution containing 32 g of gelatin and 3 g of potassium bromide at 40° C., an aqueous solution containing 32.7 g of silver nitrate and an aqueous solution containing 23.8 g of potassium bromide and 2.8 g of potassium iodide were simultaneously added thereto with stirring over a period of 4 minutes. After increasing the temperature of the resultant mixture to 75° C., an aqueous solution containing 7 g of potassium bromide and 6 g of sodium chloride was added thereto followed by ripening for 32 minutes. In this case the silver potential of the reaction solution was −60 mV for a saturated calomel electrode. Thereafter, an aqueous silver nitrate solution was added until the silver potential of the reaction solution became +150 mV. Then, an aqueous silver nitrate solution and an aqueous halide solution (containing 11.7% by weight KI to KBr) were added thereto over a period of 4.6 minutes and the silver potential of the reaction solution became +20 mV. In this case, the used amount of silver nitrate was 50.3 g.

Thereafter, an aqueous solution of 91.5 g of sodium nitrate and an aqueous halogen solution (containing 9.0% by weight KI to KBr) were added thereto over a period of 21 minutes. In this case, the silver potential of the reaction solution was kept at +20 mV for a saturated calomel electrode.

The emulsion was desalted and then gelatin and water were added thereto and the pH and pAg of the emulsion were adjusted to 6.9 and 8.3, respectively, at 40° C. to provide an emulsion (Em-A).

Em-A was a tabular grain silver halide emulsion having a thickness of 0.25 μm, a mean circular-corresponding diameter of 0.77 μm, and a mean aspect ratio of 3.43. The silver chloride content of Em-A measured by an EPMA method was 5.5 mole %. Accordingly, it was confirmed that 40% of silver chloride deposited had been halogen-converted.

Then, the dislocation of the silver halide grains thus formed was directly observed using the transmission type electron microscope described hereinbefore. The electron microscope used was JEM-2000FX (made by NEC Corporation) and the dislocation was observed at a voltage of 200 KV and a liquid nitrogen temperature. The result obtained is shown in FIG. 1. The result showed that many dislocation lines existed on the principle plane of the tabular grain.

The effects of the pressure resistant property and the sensitivity of the silver halide grains in the present invention obtained by selectively halogen converting specific positions in the inside of the tabular grains are now explained.

As in the manner of producing Em-A, except that after increasing the temperature of the reaction solution to 75° C., an aqueous solution containing 7 g of potassium bromide was added thereto followed by ripening for 32 minutes. That is, sodium chloride was not added in the aforesaid procedure. In this case, the silver potential of the reaction solution was −60 mV for a saturated calomel electrode. Thereafter, an aqueous silver nitrate solution was added thereto until the silver potential became +20 mV. Then, an aqueous silver nitrate solution and an aqueous halide solution (containing 11.7% by weight KI to KBr) were added thereto while keeping the silver potential of the reaction solution at +20 mV. In this case, the used amount of silver nitrate was 50.3 g.

Thereafter, an aqueous silver nitrate solution (91.5 g of silver nitrate) and an aqueous halide solution (containing 9.0% by weight KI to KBr) were added thereto over a period of 21 minutes. In this case the silver potential of the reaction solution was kept at +20 mV to a saturated calomel electrode.

The emulsion was desalted; gelatin and water were added thereto, and the pH and pAg were adjusted to 6.9 and 8.3, respectively, at 40° C. to provide an emulsion Em-B.

Figure 2:
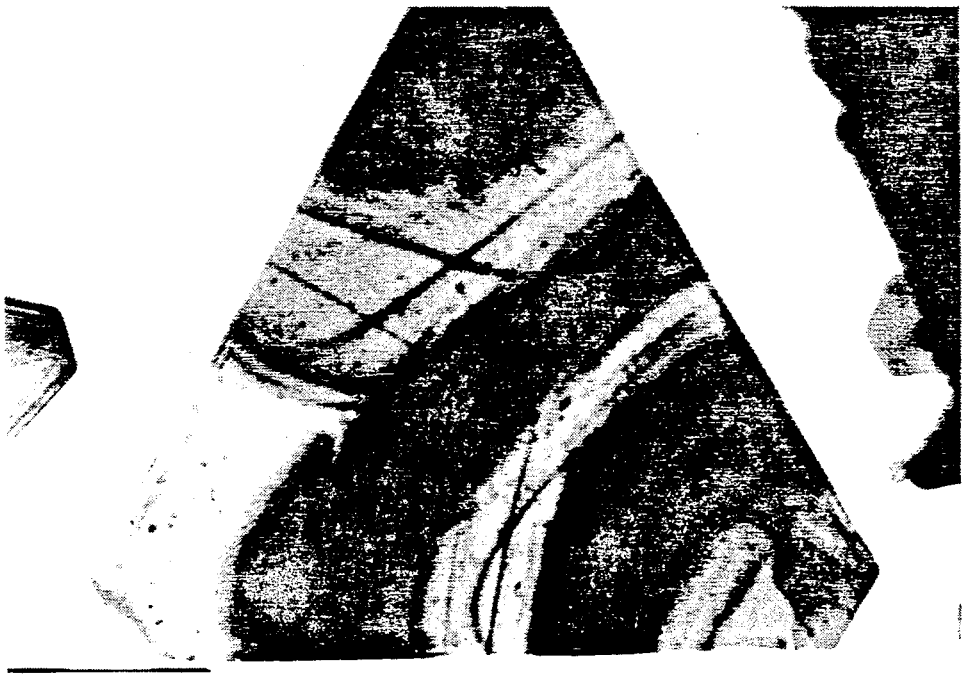
FIG. 2 is a low-temperature transmission electron microphotograph of 50,000 magnifications showing the crystal structure of the silver halide grains of Emulsion Em-b prepared in Example 1.

The silver halide grains of Em-B were tabular silver halide grains having a thickness of 0.23 μm, a circular-corresponding diameter of 0.80 μm, and an aspect ratio of 3.56. The silver halide grains did not contain silver chloride. Also, the result obtained by observing the grains by the low-temperature transmission type electron microscope as described above is shown in FIG. 2. The result shows that no dislocation line existed.

After adding Dye I-1 shown hereinbefore to each of Em-A and Em-B in an amount of $0.98\times10^{-3}$ mole per mole of silver, each emulsion was most suitably chemically sensitized by sodium thiosulfate, potassium chloroaurate, and potassium thiocyanate at 64° C.

Then, a coating aid and a hardener were added to the emulsion and the emulsion was coated onto a cellulose triacetate base at a silver coverage of 2 g/m$^2$.

The evaluation of the pressure resistant characteristics was performed as follows. One end of the coated sample was fixed with the emulsion layer being lower side at a controlled condition of 40% relative humidity and the sample was bent along the stainless steel pipe of 10 mm in diameter at 180° at a bending speed of 360° /sec. The bending procedure was performed 10 seconds before exposure or 10 seconds after exposure.

The coated emulsion layer was exposed to a tungsten lamp (color temperature of 2854° K.) through a continuous wedge for one second. The coated sample was developed using the following surface developer (MAA-1) for 10 minutes at 20° C.

| | |
|---|---|
| Metol ($HOC_6H_4NHCH_3 \cdot \frac{1}{2}H_2SO_4$) | 2.5 g |
| d-Ascorbic Acid | 10.0 g |
| Potassium Bromide | 1.0 g |
| Nabox ($NaBO_2 \cdot 4$(or 8)$H_2O$) | 35.0 g |
| Water to make | 1000 ml |

The sensitivity and fog of the sample thus developed were evaluated at the bent portion (kink mark) and a portion not subjecting to bending. The sensitivity was shown by the relative value of the reciprocal of an exposure amount required to give an optical density of fog +0.1.

The results obtained are shown in Table 2.

TABLE 2

| | | Evaluation of Pressure Resisting Property | | | | | |
|---|---|---|---|---|---|---|---|
| | | No Kinking | | Kinking Applied Before Exposure | | Kinking Applied After Exposure | |
| Sample | Feature of Grains | Fog | Sensitivity | Fog | Sensitivity | Fog | Sensitivity |
| Em-A (Invention) | Halogen Conversion of AgCl Layer in the Inside of Grains | 0.03 | 100 | 0.04 | 98 | 0.04 | 98 |
| Em-B (Comparison) | No AgCl Layer in the Inside of Grains | 0.03 | 80 | 0.06 | 78 | 0.06 | 78 |

As is clear from the results shown in Table 2, the silver halide emulsion of the present invention wherein silver chloride was selectively halogen-converted at limited sites only in the inside of the tabular grains showed significantly less increase of fog by external pressure. Also, the emulsion of the present invention showed a high sensitivity and hard gradation.

EXAMPLE 2

In this example, it is explained that the silver halide grains of the present invention having a partially halogen-converted silver chloride layer in the inside of the grains are superior in pressure resistant property and sensitivity to conventional silver halide grains having a deposited high iodide layer in the inside thereof or a high iodide layer formed therein by conversion.

To 1 liter of water were added 30 g of gelatin, 10.3 g of potassium bromide and 20 ml of an aqueous solution of 0.5% by weight thioether [$HO(CH_2)_2S(CH_2)_2S(CH_2)_2OH$] and the resultant mixture was placed in a vessel (pAg 9.0, pH 6.5) and kept at 73° C. Then, after simultaneously adding thereto an aqueous silver nitrate solution (4.5 g of silver nitrate) and an aqueous halide solution (containing 3.15 g of KBr, 0.088 g of KI, and 0.45 ml of an aqueous solution of 5% by weight thioether) with stirring over a period of 10 seconds, an aqueous silver nitrate solution (95.5 g of $AgNO_3$) and an aqueous halide solution (containing 69.6 g of KBr, 1.865 g of KI, and 9.6 ml of an aqueous solution of 5% by weight thioether) were simultaneously added thereto by a double jet method over a period of 65 minutes.

The silver halide grains formed were tabular grains having a mean diameter of 1.90 μm and an aspect ratio of 9.9. Then, after chemically sensitizing the emulsion using a chloroaurate and sodium thiosulfate, a coating aid and an antifoggant were added thereto to provide an emulsion Em-C.

The same procedure as the case of forming Em-C was followed while KI was omitted from the aqueous halide solution the first and second stages. That is, in the second stage, the aqueous silver nitrate solution and the aqueous halide solution (containing no KI) at the second stage were simultaneously added to the emulsion by a double jet method as described above and after 5 minutes from the addition, an aqueous potassium iodide solution (1.953 g of KI) was also added together with the aforesaid solutions by a triple jet method over a period of 10 minutes. The silver halide grains obtained were tabular grains having a mean diameter of 1.85 μm and an aspect ratio of 10.8. The emulsion was chemically sensitized as in Em-C to provide an emulsion Em-D.

The same procedure as Em-D was followed except that after 20 minutes from the simultaneous addition of the aqueous silver nitrate solution and the aqueous halide solution by double jet method in the second stage, the addition thereof was temporarily stopped and 4.88 ml of an aqueous solution of 10% KI was added. The silver halide grains were tabular grains having a mean diameter of 1.73 μm, and an aspect ratio of 10.0. The emulsion was chemically sensitized as in Em-D to provide an emulsion Em-E.

The same procedure for preparing Em-C was followed except that after 40 minutes from the simultaneous addition of the aqueous silver nitrate solution and the aqueous halide solution by double jet method in the second stage, the addition thereof was temporarily stalled and 5 g of sodium chloride was added. Thereafter, the aqueous silver nitrate only was added to make the silver potential +100 mV to a saturated calomel electrode. After ripening the emulsion for 5 minutes, the addition of the aqueous silver nitrate solution and the aqueous halide solution was continued. The silver halide grains obtained were tabular grains having a mean diameter of 1.60 μm and an aspect ratio of 8.9. The emulsion was chemically sensitized as Em-C to provide an emulsion Em-F.

Each of the emulsions Em-C, -D, -E, and -F was simultaneously coated onto a polyethylene terephthalate film having a subbing layer of 180 μm with a surface protective layer at a silver coverage of 2.5 g/m$^2$. The coating composition for the surface protective layer was as follows.

An aqueous 10% gelatin solution comprising gelatin, sodium polystyrenesulfonate, polymethyl methacrylate fine particles (mean particle size 3.0 μm), saponin, and 2,4-dichloro-6-hydroxy-s-triazine.

The pressure resistant characteristics were evaluated as in Example 1.

Each of the coated samples was exposed and developed by the following developer for 25 seconds at 35° C.

| | |
|---|---|
| 1-Phenyl-3-pyrazolidone | 1.5 g |
| Hydroquinone | 30 g |
| 5-Nitroindazole | 0.25 g |
| Potassium Bromide | 3.7 g |
| Anhydrous Sodium Sulfite | 50 g |
| Potassium Hydroxide | 20 g |
| Boric Acid | 10 g |
| Aqueous Solution of 25% glutaraldehyde | 20 ml |
| Water to make | 1 liter |
| pH adjusted to 10.20 | |

The results obtained are shown in Table 3.

TABLE 3

| | | Evaluation of Pressure Resisting Property | | | |
|---|---|---|---|---|---|
| | | No Kinking | | Kinking Applied Before Exposure | |
| Sample | Feature of Grains | Fog | Sensitivity | Fog | Sensitivity |
| Em-C* | Uniform Iodine | 0.04 | 100 | 0.14 | 100 |
| Em-D* | High-Iodine Layer in the Inside of Grains | 0.04 | 90 | 0.06 | 90 |
| Em-E* | Iodine Conversion in the Inside of Grains | 0.04 | 80 | 0.06 | 80 |
| Em-F** | Halogen Conversion of AgCl layer in the Inside of Grains | 0.04 | 150 | 0.06 | 150 |

*Comparison
**Present Invention

As is clear from the results shown in Table 3, the silver halide grains of the present invention having a partially halogen-converted silver chloride layer in the inside of the grains showed a very high sensitivity and improved pressure resistant characteristics as compared to conventional emulsions having improved pressure resistant characteristics, i.e., the silver halide grains having a high iodide layer in the inside of the grains which was converted by iodine.

EXAMPLE 3

In this example, it is explained that the silver halide emulsion of the present invention is effective as compared to double layer structure silver halide grains having higher iodide content in the interior thereof than in the surface portions.

While keeping 970 ml of an aqueous solution containing 32 g of gelatin and 3 g of potassium bromide at 40° C., an aqueous silver nitrate solution (32.7 g of $AgNO_3$) and an aqueous halide solution (containing 23.8 g of KBr and 32.7 g of KI) were added thereto under stirring at constant rate over a period of 4 minutes. After increasing the temperature of the mixture to 75° C., 7 g of potassium bromide was added thereto followed by ripening for 32 minutes. Thereafter, an aqueous silver nitrate solution (71.4 g of $AgNO_3$) and an aqueous halide solution (containing 42% by weight KI to KBr) were added thereto over a period of 33.9 minutes. In this case, the silver potential of the reaction solution was kept at +20 mV to a saturated calomel electrode. Then, an aqueous silver nitrate solution (70.4 g of $AgNO_3$) and an aqueous solution of potassium bromide were added thereto over a period of 16 minutes while keeping the silver potential at +20 mV to a saturated calomel electrode. The silver halide emulsion obtained was a tabular grain silver halide emulsion having a mean circle-corresponding diameter of 0.80 μm, a mean thickness of 0.23 μm, and a mean aspect ratio of 3.6. The measurement of X-ray diffraction on the emulsion grains by a power method showed that the grains were double structure grains clearly showing two diffraction peaks, the inside being high iodide portion and the surface portion being a low-iodide portion. The emulsion was defined as Em-G.

The production process of Em-G was repeated, except that after completing the addition of the aqueous silver nitrate solution in the second stage, 3 g of sodium chloride were added. Thereafter, an aqueous silver nitrate solution was added thereto to adjust the silver potential of the reaction solution to +150 mV. Then, after adding an aqueous potassium bromide solution to adjust the silver potential to +20 mV and ripening the emulsion for 3 minutes, an aqueous silver nitrate solution and an aqueous potassium bromide solution were added thereto. In this case, 70.4 g of silver nitrate was used. The silver halide grains obtained were tabular grains having a circle-corresponding diameter of 0.80 μm, a thickness of 0.23 μm, and an aspect ratio of 3.6. The emulsion was defined as Em-H.

Each of the emulsions, Em-G and Em-H was desalted and gelatin and water were added thereto to adjust the pH and pAg to be 6.8 and 8.3, respectively, at 40° C. Then, after adding thereto Dye I-1 in an amount of $0.98\times10^{-3}$ mole per mole of silver, Compound V-8, shown hereinbefore, was added thereto in an amount of $1.4\times10^{-4}$ mole per mole of silver and then the emulsion was most suitably chemically sensitized with sodium thiosulfate, potassium chloroaurate and potassium thiocyanate.

Each of the emulsions Em-G and Em-H was mixed with the additives shown below and wer then coated onto a cellulose triacetate film support having a subbing layer together with a protective layer having the composition shown below.

(1) Emulsion Layer:

| | |
|---|---|
| Emulsion: Em - G or Em - H | ($2.1\times10^{-2}$ mole-Ag/m$^2$) |
| Coupler having the following structural formula | ($1.5\times10^{-3}$ mole/m$^2$) |

-continued

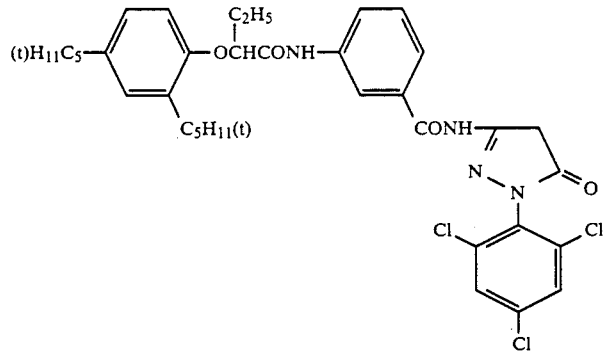

| | | |
|---|---|---|
| | Tricresyl Phosphate | (1.10 g/m$^2$) |
| | Gelatin | (2.30 g/m$^2$) |
| (2) | Protective Layer: | |
| | 2,4-Dichlorotriazine-6-hydroxy-s-triazine Sodium Salt | (0.08 g/m$^2$) |
| | Gelatin | (1.80 g/m$^2$) |

Each sample thus obtained was allowed to stand for 14 hours under the conditions of 40° C. and 70% relative humidity, exposed to the light source as in Example 1 through a continuous wedge for 1/100 second, and processed under the following conditions at 38° C.

| | |
|---|---|
| 1. Color Development | 2 min. 45 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The compositions of the processing solutions used for the aforesaid steps were as follows.

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline Sulfate | 4.5 g |
| Water to make | 1 liter |
| Bleach Solution: | |
| Ammonium Bromide | 160.0 g |
| Aqueous Ammonia (28%) | 25.0 ml |
| Ethylenediaminetetraacetic Acid Sodium Iron (III) Salt | 130 g |
| Glacial Acetic Acid | 14 ml |
| Water to make | 1 liter |
| Fix Solution: | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 liter |
| Stabilization Solution: | |
| Formalin | 8.0 ml |
| Water to make | 1 liter |

The pressure resistant characteristics were evaluated as in Example 1.

The sensitivity was shown by the reciprocal of an exposure amount shown by lux.second at a density of fog +0.2.

The results thus obtained are shown in Table 4 together with the properties of the emulsion.

TABLE 4

| | | Evaluation of Pressure Resistant Property | | | |
|---|---|---|---|---|---|
| | | No Kinking | | Kinking Applied Before Exposure | |
| Sample | Feature of Grains | Fog | Sensitivity | Fog | Sensitivity |
| Em-G* | Double structure grains of inside high-iodine | 0.18 | 100 | 0.34 | 100 |
| Em-H** | Above grains AgCl layer in the inside of which was further halogen-converted | 0.18 | 164 | 0.20 | 164 |

*Comparison
**Sample of the present invention

As is clear from the results shown in Table 4 above, as to double structure silver halide grains having higher iodide content in the interior thereof than in the surface, the tabular silver halide grains of the present invention having a partially halogen-converted silver chloride layer in the inside of the grains demonstrate excellent pressure resistant properties and showed a higher sensitivity as compared to the comparison sample.

Also, the graininess was evaluated on each sample.

The RMS granularity was measured by the method described in T. H. James, *The Theory of the Photographic Process,* page 619, published by Macmillan using F filter after uniformly exposing the sample at an exposure amount of giving a density of fog +0.2 and processing by the aforesaid process.

The gamma value was shown by the reciprocal of the difference between the exposure amount of giving a density 1.0 and the exposure amount of giving a density 0.5 on sensitometery. The results obtained are shown in Table 5.

TABLE 5

| Sample | RMS Granularity | Gamma Value |
|---|---|---|
| Em-G* | 0.020 | 100 (standard) |
| Em-H** | 0.018 | 130 |

*Comparison
**Sample of this invention.

From the results shown in Table 5, it can be seen that the emulsion of the present invention showed hard gradation and excellent graininess.

EXAMPLE 4

In this example the effect of the deposite mole number of a silver chloride layer in the tabular silver halide grains in this invention to the pressure resistant property is explained.

An aqueous solution of gelatin and potassium bromide was kept at 40° C. and an aqueous silver nitrate solution (silver nitrate 32.7 g) and an aqueous halide solution (potassium bromide 24.9 g and potassium iodide 1.3 g) were simultaneously added to the aforesaid solution under constant stirring over a period of 4 minutes. Then, the temperature of the mixture was increased to 70° C. and the mixture was ripened for 30 minutes. In this case the silver potential of the reaction solution was −50 mV to a saturated calomel electrode. Then, the silver potential was adjusted to +70 mV by the addition of an aqueous silver nitrate solution The silver halide emulsion obtained is defined as Em-1.

To the emulsion Em-1 were added an aqueous silver nitrate solution and an aqueous sodium chloride solution by a double jet method to deposit 0, 2 moles, 4 moles, 8 moles, 16 moles, 32 moles, and 64 moles each of silver chloride on the silver grains of Em-1 per mole of silver of the final silver halide grains. Thereafter, the silver potential of the reaction solution was adjusted to 0 mV with an aqueous halide solution (including 5.3% by weight potassium iodide to potassium bromide) and the silver halide grains were ripened for 5 minutes. Thereafter, an aqueous silver nitrate solution and an aqueous halide solution (including 5.3% by weight potassium iodide to potassium bromide) were added thereto at an addition rate of 4.74 g/min. as silver nitrate. In this case the silver potential of the reaction solution was kept at 0 mV to a saturated calomel electrode. The amount of silver nitrate added after the formation of emulsion Em-1 was constant as 152.3 g.

The emulsions composed of silver grains the amount of silver chloride deposited thereon being 0, 2 moles, 4 moles, 8 moles, and 16 moles were defined as Em-J, Em-K, Em-L, Em-M, and Em-N, respectively. Each of the thereto to adjust pH and pAg to 6.9 and 7,5, respectively at 40° C. After adding thereto dye I-14 at $1.4\times10^{-3}$ mole per mole of silver, each emulsion was most suitably chemically sensitized with sodium thiosulafate, potassium chloroaurate and sodium thiocyanate at 64° C.

Each of the emulsions was coated as in Example 3.

After allowing to stand these samples for 14 hours at 40° C. and 70% in relative humidity, each sample was light-exposure through BPN42 filter (gelatin filter, made by Fuji Photo Film Co., Ltd.) in the case of seening the intrinsic sensitivity or through SC52 filter (gelatin filter, made by Fuji Photo Film Co., Ltd.) and a continuous wedge in the case of seening the color sensitizing sensitivity for 1/100 second and then subjected to the color development process as in Example 3.

On the samples thus processed, the density was measured using a green filter. The evaluation of the pressure resistant characteristics were made by the same manner as in Example 1.

The results obtained in shown in Table 6 below.

TABLE 6

| | Deposited Mole Number of AgCl Before Halogen Conversion | Grain Form | Aspect Ratio | Thickness (μm) | Circle-Corresponding Diameter (μm) | Evaluation of Pressure Resisting Property | | | |
|---|---|---|---|---|---|---|---|---|---|
| | | | | | | No Rinking | | Before Exposure | |
| | | | | | | Fog | Sensitivity | Fog | Sensitivity |
| Em-J (Comparison) | 0 mol | Plate | 5.2 | 0.13 | 0.68 | 0.10 | 100 | 0.32 | 100 |
| Em-K (Invention) | 2 | Plate | 5.2 | 0.13 | 0.68 | 0.10 | 140 | 0.16 | 140 |
| Em-L (Invention) | 4 | Plate | 4.1 | 0.14 | 0.58 | 0.10 | 140 | 0.12 | 140 |
| Em-M (Invention) | 8 | Plate | 2.9 | 0.17 | 0.5 | 0.08 | 130 | 0.08 | 130 |
| Em-N | 16 | Plate | 1.9 | 0.21 | 0.4 | 0.06 | 110 | 0.06 | 110 |

As shown in the above table, it can be seen that in the emulsions Em-K, Em-L and Em-M of this invention, the pressure resistant property was improved. In this case, however, in Em-N having deposited silver chloride layer of 16 moles, the thickness of the grains was increased and the aspect ratio was 1.9. In addition, it was further confirmed by other experiment that when the deposited mole number of silver chloride was further increased, the grains became sphere.

EXAMPLE 5

In this example the effect of the position of the partially halogen-converted silver chloride layer in the inside of tabular silver haldie grains to the pressure resistant property is explained.

An aqueous solution of gelatin and potassium bromide was kept at 40° C. and an aqueous silver nitrate solution (silver nitrate 32.7 g) and an aqueous halide solution (potassium bromide 24.9 g and potassium iodide 1.3 g) were added to the aforesaid aqueous solution under constant stirring over a period of 4 minutes. Thereafter, the temperature of the mixture was increased to 70° C. and ripened for 30 minutes. The silver potential of the reaction solution was −50 mV to a saturated calomel electrode, Then, the silver potential was adjusted to +0 mV by the addition of an aqueous silver nitrate solution to provide an emulsion Em-Q.

To the emulsion Em-Q were added an aqueous silver nitrate solution and an aqueous halide solution (containing 5.3% by weight potassium iodide to ptoassium bromide) at an addition rate of 4.74 g/min. as silver nitrate. In this case the silver potential of the reaction solution was kept at 0 mV to a saturated calomel electrode. In this case the amount of silver nitrate used was 152.3 g. Thus, an emulsion Em-R was prepared.

Also, to the emulsion Em-Q was added 10 g of sodium chloride and then by adding thereto an aqueous silver nitrate solution at an addition ratio of 4.74 g/min. as silver nitrate, the silver potential thereof was adjusted to +150 mV to a saturated calomel electrode. Thereafter, an aqueous silver nitrate and an aqueous halide solution (containing 5.3% by weight potassium iodide to potassium bromide) were added thereto at an addition rate of 4.74 g/min. In this case the silver potential of the reaction solution was kept at 0 mV to a saturated calomel electrode. In this case the amount of silver nitrate used was 152.3 g. Thus, an emulsion Em-S was prepared.

Furthermore, to an emulsion Em-Q were added an aqueous silver nitrate solution and an aqueous halide solution-(containing 5.3% by weight potassium iodide to potassium bromide) at an addition rate of 4.74 g/min. In this case the silver potential of the reaction solution was kept at 0 mV to a saturated calomel electrode. In this case the amount of silver nitrate used was 71.1 g. Then, 10 g of sodium chloride was added to the emulsion and then by adding thereto an aqueous silver nitrate solution at an addition rate of 4.74 g/min. as silver nitrate, the silver potential was adjusted to +150 mV to a saturated calomel elecrtrode. Thereafter, an aqueous silver nitrate soution and an aqueous halide solution (containing 5.3% by weight potassium iodide to poatassium bromide) were added thereto at an addition rate of 4.74 g/min. at silver nitrate. In this case the silver potential of the reaction solution was kept at 0 mV to a saturated calomel electrode. In this case the amount of silver nitrate used was 81.2 g. Thus, en emulsion Em-T was prepared.

To each of the emulsions Em-R, Em-S, and Em-T was added dye I-1 in an amount of $1.5\times10^{-3}$ mole per mole of silver and then the emulsion was ripened for 10 minutes. Each of the emulsions was desalted and then gelatin and water were added thereto to adjust pH and PAg to 6.9 and 7.5, respectively at 40° C. Thereafter, compound II-1 was added to each emulsion at $1.4\times10^{-3}$ mole per mole of silver at 64° C. and then each emulsion was most suitably chemically sensitized by sodium thiosulfate, potassium chloroaurate, and sodium thiocyanate.

Each of the emulsions thus prepared was coated as in Example 3.

After allowing to stand each sample for 14 hours at 40° C. and 70% in relative humidity, the sample was light-exposed through a continuous wedge for 1/10 second and subjected to the color development process as Example 3.

On the samples thus processed, the density was measured using a green filter. The evaluation of the pressure resistant characteristics was made by the same manner as in Example 1.

The results obtained are shown in Table 7.

EXAMPLE 6

The example shows the case that the partially halogen-converted layer in the inside of silver halide grains is a lyer of silver thiocyanate.

While keeping 970 ml of an aqueous solution containing 32 g of gelatin and 3 g of potassium bromide at 40° C., an aqueous silver nitrate solution (silver nitrate 32.7 g) and an aqueous halide solution (potassium bromide 23.8 g and potassium iodide 2.8 g) were added thereto under constant stirring. Then, after increasing the temperature of the mixture to 75° C., 7 g of potassium bromide was added and the mixture was ripened for 32 minutes. In this case the silver potential of the reaction solution was −60 mV to a saturated calomel electrode.

Thereafter, 100 ml of an aqueous solution of 1N potassium thiocyanate was added to the mixture and then an aqueous silver nitrate solution was added thereto at a rate of 3.16 g/min. for 11.3 minutes to adjust the silver potential to +50 mV to a saturated calomel electrode. Thereafter, an aqueous silver nitrate solution and an aqueous halide solution (containing 11.7% by weight potassium iodide to potassium bromide) were added thereto over a period of 4.6 minutes to adjust the silver potential of the reaction solution to +20 mV. In this case the amount of silver nitrate used was 14.6 g. Thereafter, an aqueous silver nitrate solution (silver nitrate 91.5 g) and an aqueous halide solution (containing 9.0% by weight potassium iodide to potassium bromide) were added thereto over a period of 21 minutes. In this case the silver potential of the reaction solution was kept at +20 mV to a saturated calomel electrode. The emulsion was desalted and then gelatin and water were added thereto to adjust pH and PAg to 6.9 and 8.3, respectively at 40° C. to provide an emulsion Em-U.

The emulsion Em-U contained tabular silver halide grains having a thickness of 0.25 μm, a mean circle-corresponding diamter of 0.80 μm and an aspect ratio of 3.5.

To each of the emulsion Em-B obtained in Example 1 described above and the emulsion Em-U obtained above was added dye I-1 at $0.98\times10^{-3}$ mole per mole of silver and then each emulsion was most suitably chemically sensitized by sodium thiosulfate, potassium chloroaurate, and potassium thiocyanate at 64° C.

Each emulsion was coated, exposed and processed as in Example 1. The evaluation of the pressure resistant characteristics was also performed as in Example 1. The results obtained are shown in Table 8.

TABLE 7

| | Deposited Mole Number of AgCl Before Halogen Conversion | Aspect Ratio | Thickness (μm) | Circle-Corresponding Diameter (μm) | Evaluation of Pressure Resisting Property | | | |
|---|---|---|---|---|---|---|---|---|
| | | | | | No Rinking | | Before Exposure | |
| | | | | | Fog | Sensitivity | Fog | Sensitivity |
| Em-R (Comparison) | — | 5.2 | 0.13 | 0.68 | 0.08 | 100 | 0.22 | 100 |
| Em-S (Invention) | From the center 18% | 1.9 | 0.21 | 0.4 | 0.08 | 120 | 0.10 | 120 |
| Em-T (Invention) | From the center 57% | 4.3 | 0.14 | 0.60 | 0.08 | 158 | 0.10 | 158 |

As is clear from the results shown in Table 7 above, it can be seen that hte pressure resistant property is greatly improved by the present invention and the position of the partially halogen-converted silver chloride layer in the inside of tabular silver halide grains gives a large effect to the form of the grains.

TABLE 8

| Comparison of Pressure Resistant Property and Sensitivity | | | | | |
|---|---|---|---|---|---|
| | | Evaluation of Pressure-Resistant Property | | | |
| | | No Kinking | | Kinking Before Light Exposure | |
| Sample | Feature of Grains | Fog | Sens. | Fog | Sens. |
| Em - U (Invention) | Halogen-converted AgSCN layer in the inside of grains | 0.03 | 110 | 0.04 | 108 |
| Em - B (Comparison) | No AGSCN Layer in the inside of grains | 0.03 | 100 | 0.06 | 98 |

As is clear from the results shown in Table 8 above, it can be seen that in the silver halide emulsion of this containing selectively halogen-converted silver thiocyanate in the limited site only in the inside of the tabular silver halide grains, the increase of fog by external pressure (kinking) is very less.

EXAMPLE 7

This examples shows the effect of the case of using the silver halide emulsion of this invention for a blue-sensitive emulsion layer of a multilayer color photographic material.

Preparation of Samples 101 and 102

A multilayer color photographic material having the layers of the compositions shown below on a cellulose triacetate film support having subbing layer was prepared.

Compositions of Layers

The coating amounts in the following compositions were shown by a g/m$^2$ unit of silver on silver halide, silver halide emulsion and colloid silver, a g/m$^2$ unit on couplers, additives, and gelatin, and mole number per mole of silver halide in the same emulsion layer on sensitizing dyes.

| | |
|---|---|
| Layer 1 Antihalation Layer | |
| Black Colloid Silver | 0.37 |
| U - 1 | 0.027 |
| U - 2 | 0.055 |
| U - 3 | 0.064 |
| HBS - 3 | 0.076 |
| Gelatin | 2.81 |
| Layer 2 Interlayer | |
| U - 1 | 0.027 |
| U - 2 | 0.054 |
| U - 3 | 0.063 |
| HBS - 3 | 0.076 |
| Gelatin | 1.52 |
| Layer 3 1st Red-Sensitive Emulsion Layer | |
| Silver Iodobromide Emulsion (AgI 10 mole %, sphere-corresponding diameter 0.9 μm, coeff. of variation 28.8%, aspect ratio 5.1) | 0.43 |
| Silver Iodobromide Emulsion (AgI 14 mole %, sphere-corresponding diameter 0.6 μm, coeff. of variation 36.6%, aspect ratio 3.4) | 0.11 |
| Silver Iodobromide Emulsion (AgI 2 mole %, sphere-corresponding diameter 0.45 μm, coeff. of variation 28%, aspect ratio 2.7) | 0.55 |
| Sensitizing Dye I | $4.7 \times 10^{-3}$ |
| C - 1 | 0.14 |
| C - 2 | 0.15 |
| C - 3 | 0.08 |
| C - 5 | 0.08 |
| HBS - 1 | 0.06 |
| HBS - 2 | 0.13 |
| C - 10 | 0.14 |
| Gelatin | 1.66 |
| Layer 4 2nd Red-Sensitive Emulsion Layer | |
| Silver Iodobromide Emulsion (AgI 3.5 mole %, sphere-corresponding diameter 0.35 μm, coeff. of variation 10.6%, aspect ratio 1.0) | 0.73 |
| Sensitizing Dye I | $4.0 \times 10^{-3}$ |
| C - 1 | 0.27 |
| C - 2 | 0.28 |
| C - 3 | 0.07 |
| C - 4 | 0.11 |
| HBS - 1 | 0.12 |
| HBS - 2 | 0.24 |
| C - 10 | 0.007 |
| Gelatin | 2.34 |
| Layer 5 Interlayer | |
| Gelatin | 0.92 |
| Cpd - 1 | 0.10 |
| HBS - 1 | 0.053 |
| Dye I | 0.075 |
| U - 4 | 0.023 |
| U - 5 | 0.036 |
| HBS - 4 | $7.7 \times 10^{-3}$ |
| Layer 6 1st Green-Sensitive Emulsion Layer | |
| Silver Iodobromide Emulsion (AgI 3.5 mole %, sphere-corresponding diameter 0.35 μm, coeff. of variation 10.6%, aspect ratio 1.0) | 0.48 |
| Sensitizing Dye II | $3.6 \times 10^{-3}$ |
| Sensitizing Dye III | $1.7 \times 10^{-3}$ |
| C - 6 | 0.33 |
| C - 7 | 0.077 |
| HBS - 1 | 0.29 |
| Gelatin | 1.13 |
| Layer 7 2nd Green-Sensitive Emulsion Layer | |
| Silver Iodobromide Emulsion (AgI 10 mole %, sphere-corresponding diameter 0.9 μm, coeff. of variation 36.6%, aspect ratio 3.4) | 0.21 |
| Silver Iodobromide Emulsion (AgI 4 mole %, sphere-corresponding diameter 0.6 μm, coeff. of variation 28%, aspect ratio 3.4) | 0.09 |
| Silver Iodobromide Emulsion (AgI 2 mole %, sphere-corresponding diameter 0.45 μm, coeff. of variation 28%, aspect ratio 2.7) | 0.24 |
| Sensitizing Dye II | $2.2 \times 10^{-3}$ |
| Sensitizing Dye III | $1.0 \times 10^{-3}$ |
| C - 6 | 0.20 |
| C - 8 | 0.071 |
| C - 4 | 0.079 |
| C - 5 | 0.038 |
| HBS - 1 | 0.18 |
| Gelatin | 0.79 |
| Layer 8 3rd Green-Sensitive Emulsion Layer | |
| Silver Iodobromide Emulsion (AgI 10 mole %, sphere-corresponding diameter 1.2 μm, coeff. of variation 29.4%, aspect ratio 6.3) | 0.44 |
| Sensitizing Dye II | $5.6 \times 10^{-4}$ |
| Sensitizing Dye III | $2.1 \times 10^{-4}$ |
| Sensitizing Dye IV | $3.6 \times 10^{-4}$ |
| C - 6 | 0.036 |
| C - 5 | 0.020 |
| HBS - 1 | 0.032 |
| Gelatin | 0.34 |
| Layer 9 Yellow Filter Layer | |
| Yellow Colloid Silver | 0.11 |
| Cpd - 1 | 0.28 |
| HBS - 1 | 0.15 |
| Gelatin | 1.19 |
| Layer 10 1st Blue-Sensitive Emulsion Layer | |
| Silver Iodobromide Emulsion (AgI 1 mole %, sphere-corresponding diameter 0.45 μm, coeff. of variation 20.1%, aspect ratio 1.8) | 0.33 |

-continued

| | |
|---|---|
| Sensitizing Dye V | $1.7 \times 10^{-3}$ |
| C - 9 | 0.65 |
| C - 11 | 0.10 |
| HBS - 1 | 0.22 |
| Gelatin | 0.85 |
| Layer 11 2nd Blue-Sensitive Emulsion Layer | |
| Silver Iodobromide Emulsion containing $3.0 \times 10^{-3}$ of sensitizing dye V (AgI 4.1 mole %, sphere-corresponding diameter 0.43 μm, coeff. of cariation 25%, aspect ratio 3.6) | 0.17 |
| Silver Iodochloro-bromide Emulsion (Em - A or Em - B) | 0.21 |
| C - 9 | 0.28 |
| C - 4 | 0.044 |
| HBS - 1 | 0.10 |
| Gelatin | 0.75 |

-continued

| | |
|---|---|
| Layer 12 1st Protective Layer | |
| Gelatin | 0.60 |
| U - 4 | 0.10 |
| U - 5 | 0.15 |
| HBS - 4 | 0.033 |
| Dye II | 0.15 |
| Layer 13 2nd Protective Layer | |
| Polymethyl Methacrylate Particles (diameter about 1.5 μm) | 0.14 |
| Gelatin | 0.87 |

Each of the aforesaid layers further contains a gelatin hardener H-1 and a surface active agent. The compounds used for the aforesaid sample are shown below.

Sensitizing Dye

I

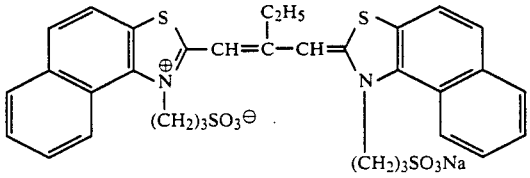

II

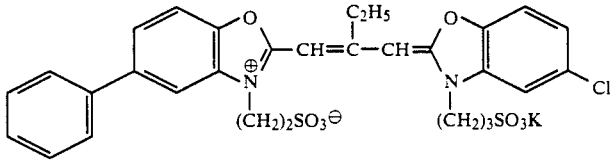

III

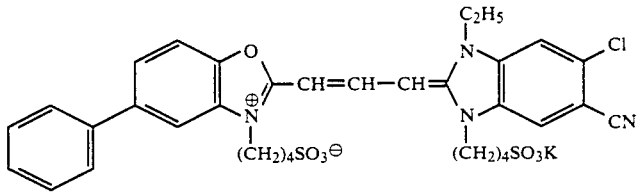

IV

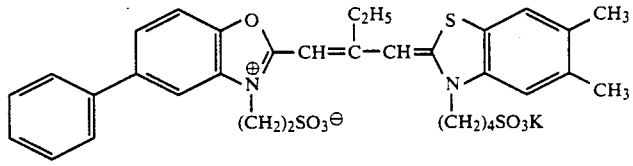

V

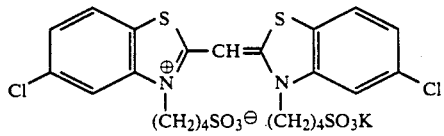

U-1

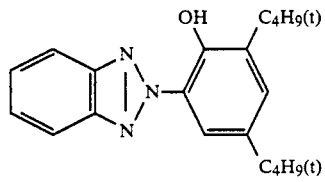

-continued
Sensitizing Dye
U-2
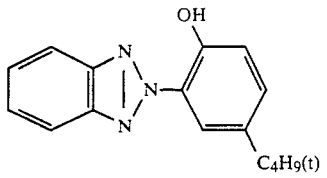
U-3
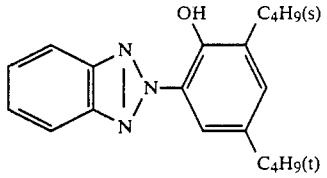
U-4
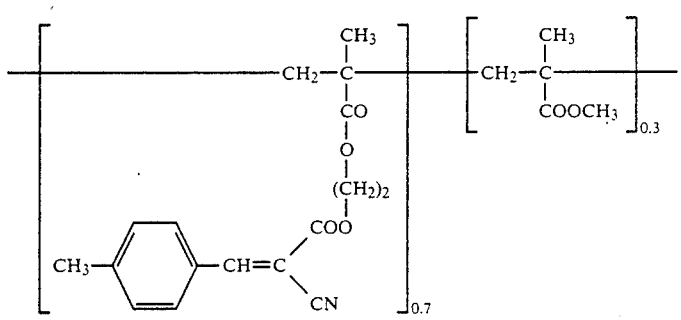
U-5
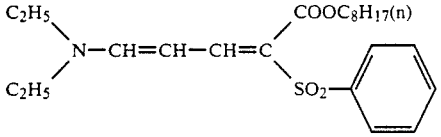
Dye I
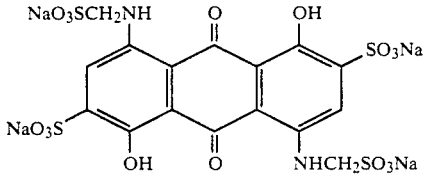
Dye II
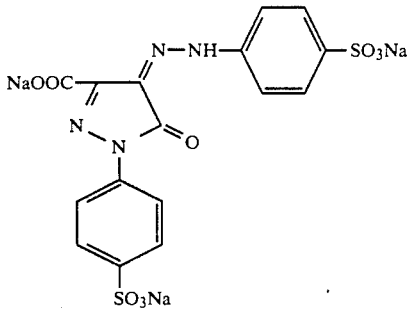
C-1
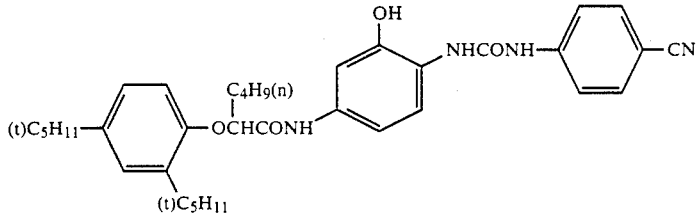

-continued
Sensitizing Dye
C-2
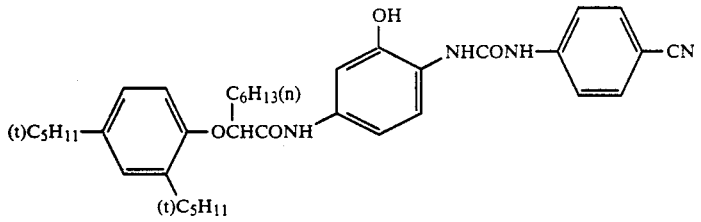
C-3
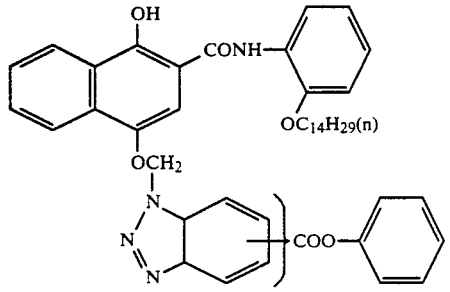
C-4
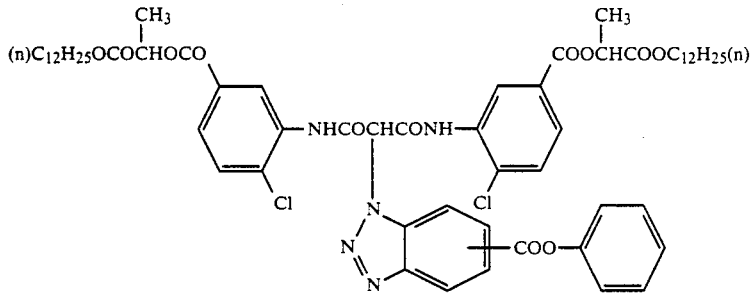
C-5
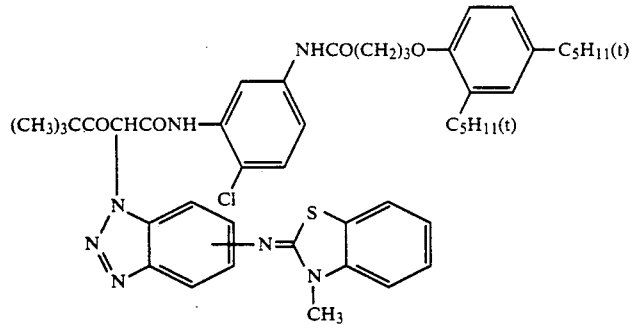
C-6
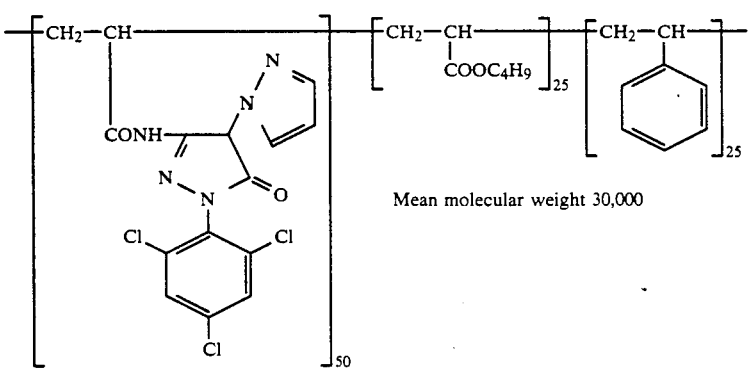
Mean molecular weight 30,000

-continued
Sensitizing Dye
C-7
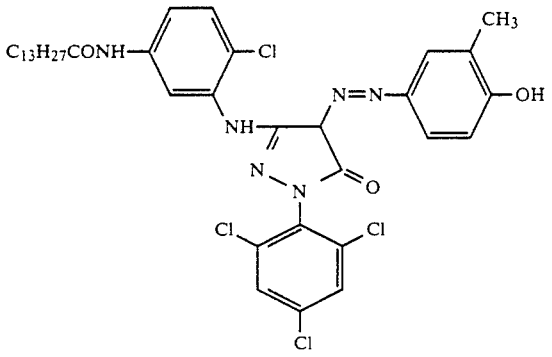
C-8
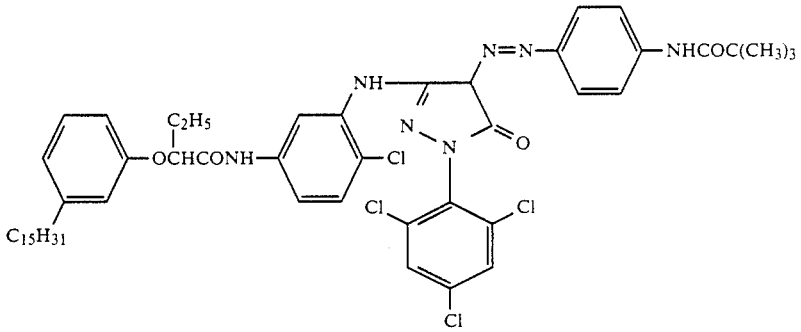
C-9
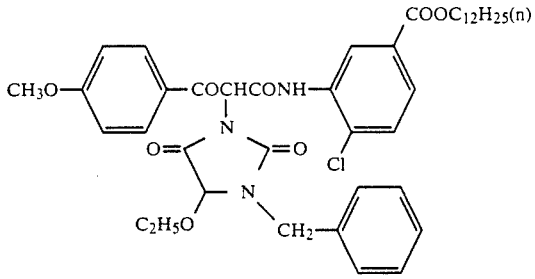
C-10
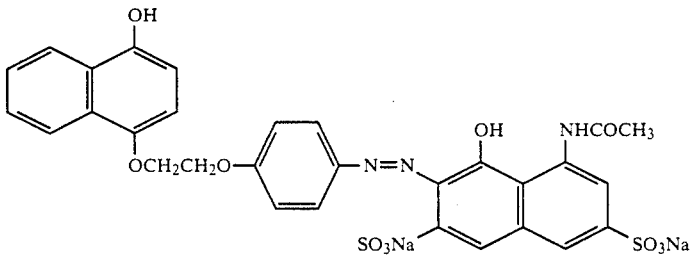

-continued

Sensitizing Dye

C-11

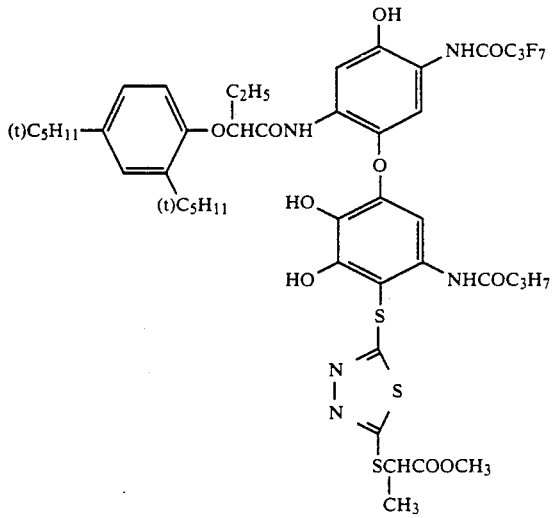

Cpd-1

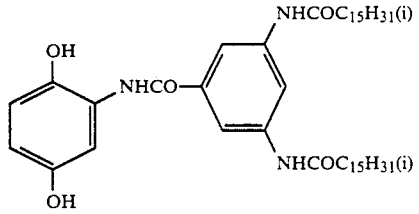

H-1:

$CH_2{=}CH{-}SO_2{-}CH_2CONH{-}CH_2$
$CH_2{=}CH{-}SO_2{-}CH_2CONH{-}CH_2$

HBS-1: Tricresyl Phosphate
HBS-2: Dioctyl Phthalate
HBS-3: Dibutyl Phthalate
HBS-4: Bis(2-ethylhexyl) Phthalate The sample using the emulsion Em-A or Em-B prepared in Example 1 for Layer 11 of the aforesaid blue-sensitive emulsion layers was defiend as sample 101 and sample 102.

After allowing to stand these samples for 14 hours at 40° C. and 70% in relative humidity, each sample was exposed through a continuous wedge for 10 seconds and processed as shown below to provide characteristics curves of cyan, magenta and yellow color images. On the characteristic curve of the yellow color images, the recipropcal of the exposure amount giving an optical density of fog +0.1 was shown as the relative sensitivity.

Each sample was processed by the following processing steps at 38° C.

| | |
|---|---|
| Color Deveopment | 3 min. 15 sec. |
| Bleach | 6 min. 30 sec. |
| Wash | 2 min. 10 sec. |
| Fix | 4 min. 20 sec. |
| Wash | 3 min. 15 sec. |
| Stabilization | 1 min. 05 sec. |

The compositions of the processing solutions used for the aforesaid steps were as follows.

| | |
|---|---|
| Color Developer | |
| Diethylenetriaminepentaacetic Acid | 1.0 g |
| 1-Hydroxyethylidene-1,1-diphosphonic | 2.0 g |

-continued

| | |
|---|---|
| Acid | |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.0 |
| Bleach Solution | |
| Ethylenediaminetetraacetic Acid Ferric Ammonium Salt | 100.0 g |
| Ethylenediaminetetraacetic Acid Disodium Salt | 10.0 g |
| Ammonium Bromide | 150.0 g |
| Ammonium Nitrate | 10.0 g |
| Water to make | 1.0 liter |
| pH | 6.0 |
| Fix Solution | |
| Ethylenediaminetetraacetic Acid Disodium Salt | 1.0 g |
| Sodium Sulfite | 4.0 g |
| Aqueous Ammonium Thiosulfate Solution (70%) | 175.0 ml |
| Sodium Hydrogensulfite | 4.6 g |
| Water to make | 1.0 liter |
| pH | 6.6 |
| Stabilization Solution | |
| Formalin (40%) | 2.0 ml |
| Polyoxyethylene-p-mono-nonylphenyl Ether (mean polymerization degree 10) | 0.3 g |

-continued

| | |
|---|---|
| Water to make | 1.0 liter |

The evaluation of the pressure resisting characteristics was performed as follows.

That is, the coated sample was fixed with the emulsion layer surface above under a constant relative humidity of 40% and the emulsion layer surface was scratched by a metal stylus having a diameter of 1 mm, 0.1 mm or 0.01 mm while applying a proper load on the styrus. The scratch by the metal stylus was performed before development and after development each sample thus scratched, the density change of the scratched portion in the yellow density was measured by a micro densitometer.

The results obtained are shown in Table 9 below.

TABLE 9

| | | | Increase of Fog by Scratching with Metal Stylus | | | | | | | | | | |
|---|---|---|---|---|---|---|---|---|---|---|---|---|---|
| | | | 1 mm Load (g) | | | 0.1 mm Load (g) | | | 0.01 mm Load (g) | | | | |
| Sample | Emulsion | Sensitivity | 20 | 40 | 80 | 5 | 10 | 20 | 2 | 4 | 6 | 8 | 10 |
| 101 (Invention) | Em-A | 100 | ○ | ○ | ○ | ○ | ○ | 0.05 | ○ | 0.04 | 0.1 | 0.3 | 0.5 |
| 102 (Comparison) | Em-B | 80 | ○ | ○ | 0.1 | ○ | 0.05 | 0.3 | 0.2 | 0.4 | 0.6 | 0.8 | 1.0 |

As is clear from the results shown in Table 9, it can be seen that by using the silver halide emulsion of this invention, a color photographic material having a high sensitivity and very excellent pressure resistance is obtained.

EXAMPLE 8

This example shows the effect of the case of using the silver halide emulsion of this invention for the green-sensitive emulsion layer of a multilayer color photographic material for the pressure resisting characteristics.

Preparation of Sampels 201 and 202

A multilayer color photographic material having the layers of the compositions shown belwo on a cellulose triacetate film support having subbing layer was prepared.

In addition, in the following composition the coating amounts were shown by the same units as explaiend in Example 7 above.

| | |
|---|---|
| Layer 1 Antihalation Layer | |
| Black Colloid Silver | 0.18 |
| Gelatin | 0.40 |
| Layer 2 Interlayer | |
| 2,5-Di-t-pentadecylhydroquinone | 0.18 |
| Ex - 1 | 0.07 |
| Ex - 3 | 0.02 |
| U - 1 | 0.08 |
| U - 2 | 0.08 |
| HBS - 1 | 0.10 |
| HBS - 2 | 0.02 |
| Gelatin | 1.04 |
| Layer 3 1st Red-Sensitive Emulsion Layer | |
| Silver Iodobromide Emulsion (silver iodide 6 mole %, mean grain size 0.8 μm) | 0.55 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| Ex - 2 | 0.350 |
| HBS - 1 | 0.005 |
| Ex - 11 | 0.008 |
| Gelatin | 1.20 |

-continued

| | |
|---|---|
| Layer 4 2nd Red-Sensitive Emuldion Layer | |
| Silver Iodobromide Emulsion (silver iodide 8 mole %, mean gran size 0.85 μm) | 1.20 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| Ex - 2 | 0.300 |
| Ex - 3 | 0.050 |
| Ex - 10 | 0.004 |
| HBS - 2 | 0.050 |
| Gelatin | 1.30 |
| Layer 5 3rd Red-Sensitive Emulsion Layer | |
| Silver Iodobromide Emulsion (silver iodide 14 mole %, mean grain size 1.5 μm) | 1.60 |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| Ex - 5 | 0.150 |
| Ex - 3 | 0.055 |
| Ex - 4 | 0.060 |
| Ex - 11 | 0.005 |
| HBS - 1 | 0.32 |
| Gelatin | 1.63 |
| Layer 6 Interlayer | |
| Gelatin | 1.06 |
| Layer 7 1st Green-Sensitive Emulsion Layer | |
| Em - J or Em - k | 0.40 |
| Ex - 6 | 0.260 |
| Ex - 1 | 0.021 |
| Ex - 7 | 0.030 |
| Ex - 8 | 0.025 |
| HBS - 1 | 0.100 |
| Gelatin | 0.75 |
| Layer 8 2nd Green-Sensitive Emulsion Layer | |
| Silver Iodobromide Emulsion (silver iodie 9 mole %, mean grain size 0.85 μm) | 0.80 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| Ex - 6 | 0.150 |
| Ex - 8 | 0.010 |
| Ex - 1 | 0.008 |
| Ex - 7 | 0.012 |
| HBS - 1 | 0.60 |
| Gelatin | 1.10 |
| Layer 9 3rd Green-Sensitive Emulsion Layer | |
| Silver Iodobromide Emulsion (silver iodide 12 mole %, mean gran size 1.3 μm) | 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| Ex - 6 | 0.065 |
| Ex - 1 | 0.025 |
| HBS - 2 | 0.55 |
| Gelatin | 1.74 |
| Layer 10 Yellow Filter Layer | |
| Yellow Colloid Silver | 0.05 |
| 2,5-Di-t-pentadecylhydroquinone | 0.03 |
| Gelatin | 0.95 |
| Layer 11 1st Blue-Sensitive Emulsion Layer | |
| Silver Iodobromide Emulsion (silver iodide 8 mole %, mean grain size 0.8 μm) | 0.24 |
| Sensitizing Dye VIII | $0.5 \times 10^{-4}$ |
| Ex - 9 | 0.85 |
| Ex - 8 | 0.12 |
| HBS - 1 | 0.28 |

-continued

| | |
|---|---|
| Gelatin | 1.28 |
| Layer 12 2nd Blue-Sensitive Emulsion Layer | |
| Silver Iodobromide Emulsion (silver iodide 10 mole %, mean grain size 1.0 μm) | 0.45 |
| Sensitizing Dye VIII | $2.1 \times 10^{-4}$ |
| Ex - 9 | 0.20 |
| HBS - 1 | 0.03 |
| Gelatin | 0.46 |
| Layer 13 3rd Blue-Sensitive Emulsion Layer | |
| Silver Iodobromide Emulsion (silver iodide 10 mole %, mean grain size 1.8 μm) | 0.77 |
| Ex - 9 | 0.20 |
| HBS - 1 | 0.07 |
| Gelatin | 0.69 |
| Layer 14 1st Protetive Layer | |
| Silver Iodobromide Emulsion (silver iodide 1 mole %, mean grain size 0.07 μm) | 0.5 |
| U - 1 | 0.11 |
| U - 2 | 0.17 |
| HBS - 1 | 0.90 |
| Gelatin | 1.00 |
| Layer 15 2nd Protective Layer | |
| Polymethyl Acrylate Particles (diameter about 1.5 μm) | 0.54 |
| S - 1 | 0.05 |
| S - 2 | 0.20 |
| Gelatin | 0 72 |

Each layer further contained a gelatin hardener H-1 and a surface active agent.

The compounds used for making the aforesaid sample are shown below.

U-1

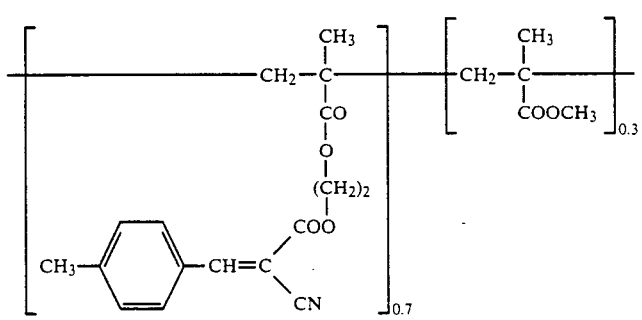

(U-2)

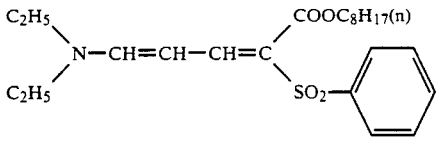

EX-1

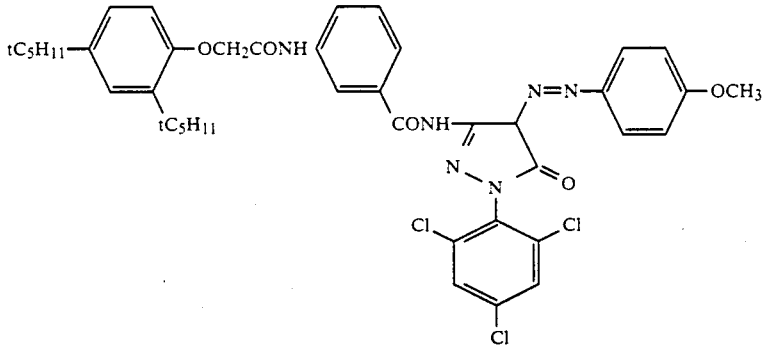

EX-2

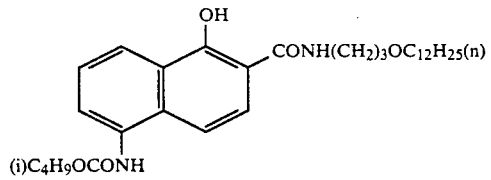

EX-3

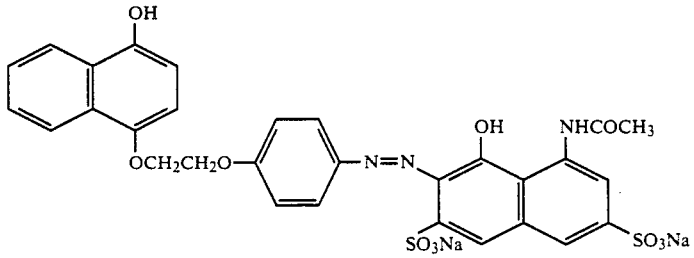

-continued
EX-4
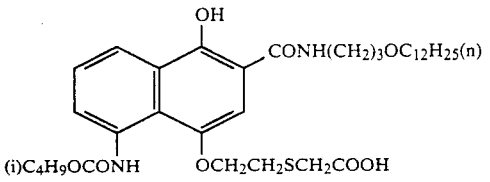
EX-5
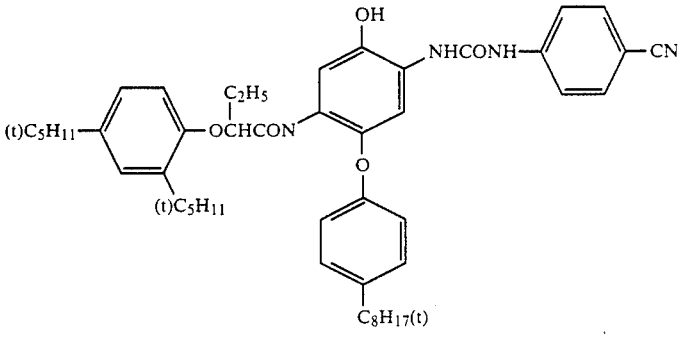
EX-6
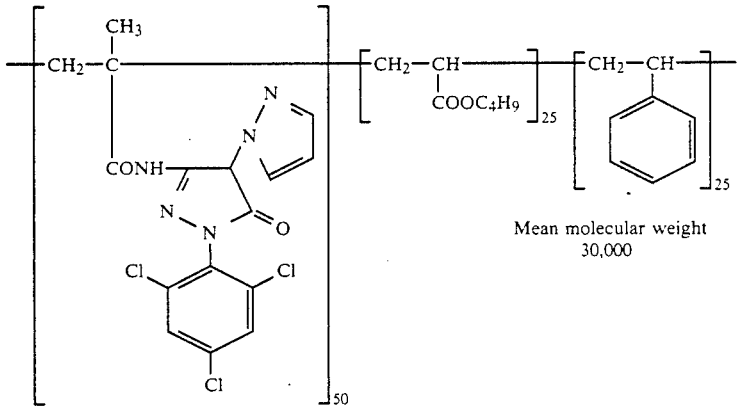
EX-7
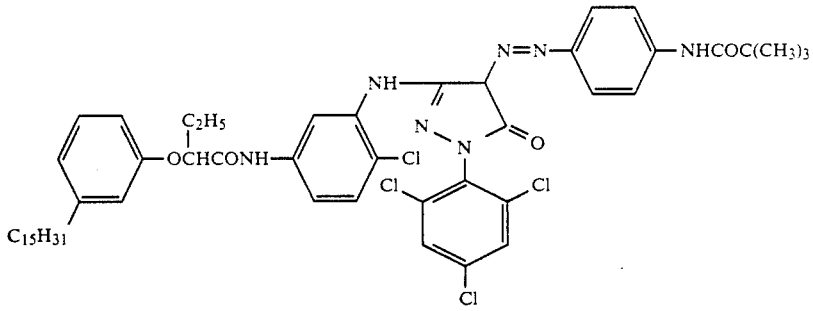
EX-8
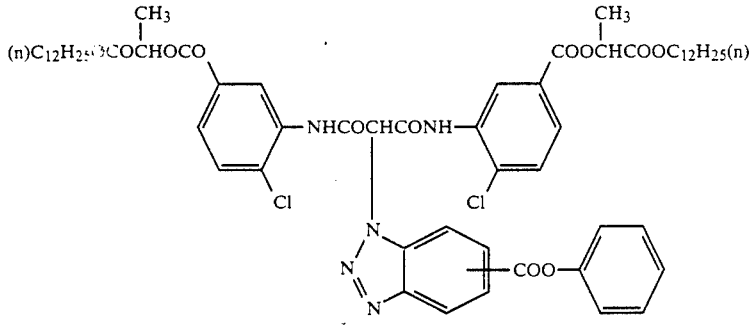

-continued
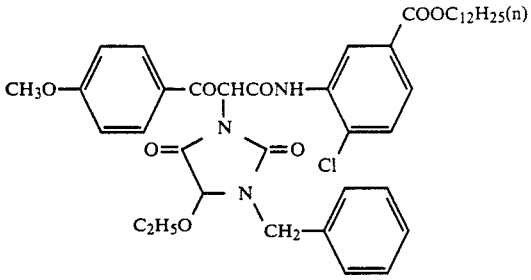
EX-9
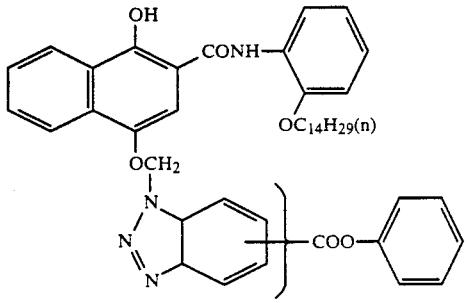
EX-10
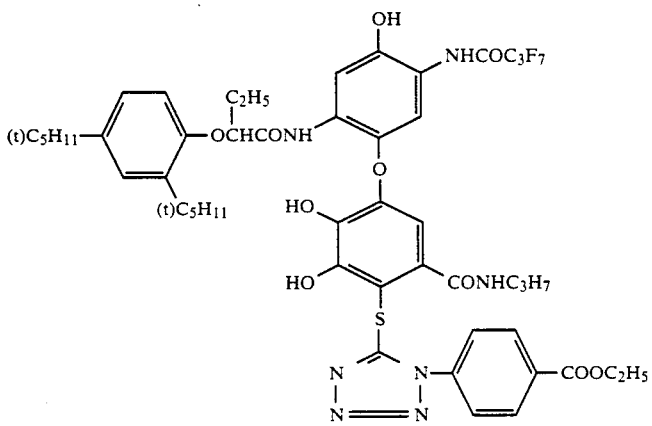
C-11
Tricresyl Phosphate HBS-1
Dibutyl Phthalate HBS-2
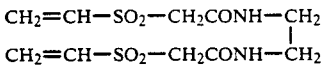
H-1
Sensitizing Dye
I
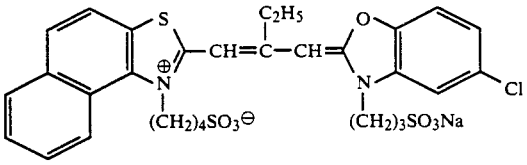
II
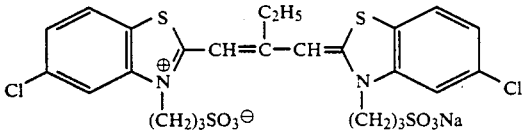
-continued
Sensitizing Dye
III
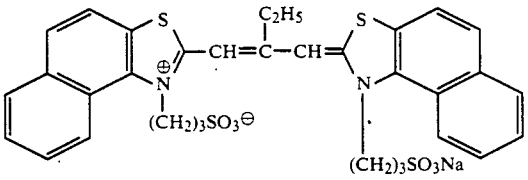
S-1
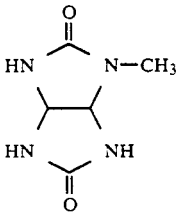

-continued

Sensitizing Dye

S-2

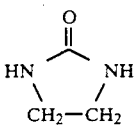

IV

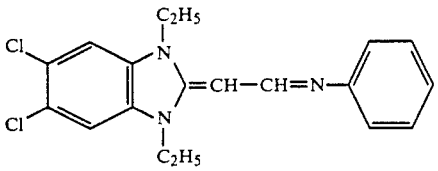

V

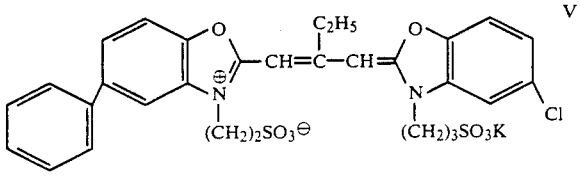

VI

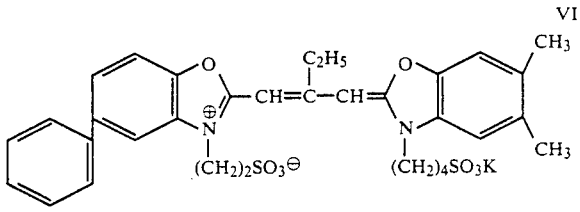

VII

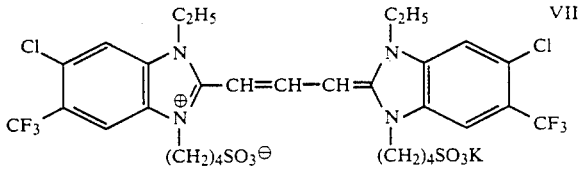

VIII

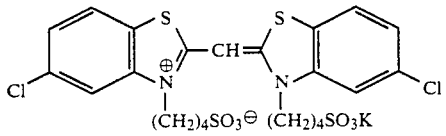

IX

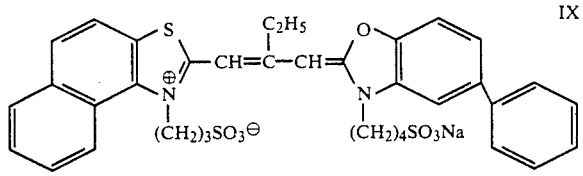

The sample containing Em-J or Em-K prepared in Example 4 in Layer 7 of the aforesaid green-sensitive emulsion layers was defined as sample 201 or 202, respectively.

After allowing to stand these sampels for 14 hours at 40° C. and 70% in relative humidity, each sample was fixed at an end with the emulsion layer inside and bent along the surface of a stainless stell pipe of 10 mm in diameter at 180° while rotating the pipe (kink mark). Thereafter, the sample was developed as in Example 7 and the change of the fog density at the bent portion in magenta images was measured.

The results obtained are shown in Table 10.

TABLE 10

Comparison on Fog Density Changes at Bent Portion

| Sample | Emulsion Used | Change of Fog Density at Bent Portion |
|---|---|---|
| Sample 201 (Comparison) | Em - J | 0.8 |
| Sample 202 (Invention) | Em - K | 0.6 |

As is clear from the above results, it can be seen that the foramtion of the pressure fig (kink mark) is reduced by using the silver halide emulsion of this invention.

Also, each sample was exposed through a continuous wedge for 1/100 second and then processed as above. The characteristic curve of the magenta images showed that sample 202 was better in gradation at the high density side than sample 201.

EXAMPLE 9

This examples shows the effect of the case of using the silver halide emulsion of this invention for the red-sensitive emulsion layer of a multilayer color photogr-pahic material for sensitivity and pressure resistant characteristics.

Preparation of Samples 301, 302, 303, and 304

A miltilayer color photographic material having the layers of the compositions shown below on a cellulose triacetate film support having subbing layer was prepared.

In addition, in the following composition the coating amounts were shown by the same units as explained in Example 7.

| | |
|---|---|
| Layer 1 Antihalation Layer | |
| Black Colloid Silver | 0.2 |
| Gelatin | 1.3 |
| ExM - 9 | 0.06 |
| UV - 1 | 0.03 |
| UV - 2 | 0.06 |
| UV - 3 | 0.06 |
| Solv - 1 | 0.15 |
| Solv - 2 | 0.15 |
| Solv - 3 | 0.05 |
| Layer 2 Interlayer | |
| Solv - 1 | 0.1 |
| Solv - 2 | 0.1 |
| Gelatin | 1.0 |
| UV - 1 | 0.03 |
| ExC - 4 | 0.02 |
| Layer 3 Low-Speed Red-Sensitive Emulsion Layer | |
| Silver Iodobromide Emulsion (AgI 4 mole %, uniform AgI type, sphere-corresponding diameter 0.5 μm, coeff. of variation of sphere-corresponding diameter 20%, tabular grains, aspect ratio 3.0) | 1.2 |
| Silver Iodobromide Emulsion (AgI 3 mole %, uniform AgI type, sphere-corresponding diameter 0.3 μm, coeff. of sphere-corresponding diameters, sphereical grains, aspect ratio 1.0) | 0.6 |
| Gelatin | 1.0 |
| ExS - 1 | $4 \times 10^{-4}$ |
| ExS - 2 | $5 \times 10^{-5}$ |
| ExC - 1 | 0.05 |
| ExC - 2 | 0.50 |
| ExC - 3 | 0.03 |
| ExC - 4 | 0.12 |
| ExC - 5 | 0.01 |
| Layer 4 High-Speed Red-Sensitive Emulsion Layer | |
| Em - C, D, E or F | 0.7 |

-continued

| | |
|---|---|
| Gelatin | 1.0 |
| ExS - 1 | $3 \times 10^{-4}$ |
| ExS - 2 | $2.3 \times 10^{-5}$ |
| ExC - 6 | 0.11 |
| ExC - 7 | 0.05 |
| ExC - 4 | 0.05 |
| Solv - 1 | 0.05 |
| Solv - 3 | 0.05 |
| Layer 5 Interlayer | |
| Gelatin | 0.5 |
| Cpd - 1 | 0.1 |
| Solv - 1 | 0.05 |
| Layer 6 Low-Speed Green-Sensitive Emulsion Layer | |
| Silver Iodobromide Emulsion (AgI 4 mole %, surface high-AgI type, sphere-corresponding diameter 0.5 μm, coeff. of variation of sphere-corresponding diameters, spherical grains, aspect ratio 1.0) | 0.20 |
| Gelatin | 1.0 |
| ExS - 3 | $5 \times 10^{-4}$ |
| ExS - 4 | $3 \times 10^{-4}$ |
| ExS - 5 | $1 \times 10^{-4}$ |
| ExM - 8 | 0.4 |
| ExM - 9 | 0.07 |
| ExM - 10 | 0.03 |
| ExY - 11 | 0.03 |
| Solv - 1 | 0.3 |
| Solv - 4 | 0.05 |
| Layer 7 High-Speed Green-Sensitive Emulsion Layer | |
| Silver Iodobromide Emulsion (AgI 4 mole %, inside high-AgI type, sphere-corresponding diameter 0.7 μm, coeff. of variation of sphere-corresponding diameters 20%, tabular grains, aspect ratio 5.0) | 0.6 |
| ExS - 3 | $5 \times 10^{-4}$ |
| ExS - 4 | $3 \times 10^{-4}$ |
| ExS - 5 | $1 \times 10^{-4}$ |
| ExM - 8 | 0.1 |
| ExM - 9 | 0.02 |
| ExY - 11 | 0.03 |
| ExC - 2 | 0.03 |
| ExM - 14 | 0.01 |
| Solv - 1 | 0.2 |
| Solv - 4 | 0.01 |
| Layer 8 Interlayer | |
| Gelatin | 0.5 |
| Cpd - 1 | 0.05 |
| Solv - 1 | 0.02 |
| Layer 9 Donner Layer for Double Layer Effect | |
| Silver Iodobromide Emulsion AgI 2 mole %, inside high-AgI type, sphere-corresponding diameter 1.0 μm, coeff. of variation of sphere-corresponding diameters 15%, tabular grains, aspect ratio 6.0) | 0.35 |
| Silver Iodobromide Emulsion (AgI 12 mole %, inside high-AgI type, sphere-corresponding diameter 0.4 μm, coeff. of variation of sphere-corresponding diameters 20%, tabular grains, aspect ratio 6.0) | 0.20 |
| Gelatin | 0.5 |

-continued

| | |
|---|---|
| ExS - 3 | $8 \times 10^{-4}$ |
| ExY - 13 | 0.11 |
| ExM - 12 | 0.03 |
| ExM - 14 | 0.14 |
| Solv - 1 | 0.20 |
| Layer 10 Yellow Filter Layer | |
| Yellow Colloid Silver | 0.05 |
| Gelatin | 0.5 |
| Cpd - 2 | 0.13 |
| Cpd - 1 | 0.10 |
| Layer 11 Low-Speed Blue-Sensitive Emulsion Layer | |
| Silver Iodobromide Emulsion (AgI 4.5 mole %, uniform AgI type, sphere-corresponding diameter 0.7 μm, coeff. of variation of sphere-corresponding diameters, tabular grains, aspect ratio 7.0) | 0.15 |
| Gelatin | 1.6 |
| ExS - 6 | $2 \times 10^{-4}$ |
| ExC - 16 | 0.05 |
| ExC - 2 | 0.10 |
| ExC - 3 | 0.02 |
| ExY - 13 | 0.07 |
| ExY - 15 | 0.5 |
| ExY - 17 | 1.0 |
| Solv - 1 | 0.20 |
| Layer 12 High-Speed Blue-Sensitive Emulsion Layer | |
| Silver Iodobromide Emulsion (AgI 10 mole %, inside high-AgI type, sphere-corresponding diameter 1.0 μm, coeff. of variation of sphere-corresponding diameters 25%, amorphous grains, aspect ratio 2.0) | 0.5 |
| Gelatin | 0.5 |
| ExS - 6 | $1 \times 10^{-4}$ |
| ExY - 15 | 0.20 |
| ExY - 13 | 0.01 |
| Solv - 1 | 0.10 |
| Layer 13 1st Protective Layer | |
| Gelatin | 0.8 |
| UV - 4 | 0.1 |
| UV - 5 | 0.15 |
| Solv - 1 | 0.01 |
| Solv - 2 | 0.01 |
| Layer 14 2nd Protective Layer | |
| Fine Grain Silver Bromide Emulsion (12 moles, 0.07 μm) | 0.5 |
| Gelatin | 0.45 |
| Polymethyl Methacrylate Particles (diameter 1.5 μm) | 0.2 |
| H - 1 | 0.4 |
| Cpd - 3 | 0.5 |
| Cpd - 4 | 0.5 |

Each layer further contained a stabilizer Cpd-3 for the emulsion and a surface active agent Cpd-4 as a coating aid. Moreover, the layers contained the compounds Cpd-5 and Cpd-6.

The compounds used for the aforesaid sample were as follows.

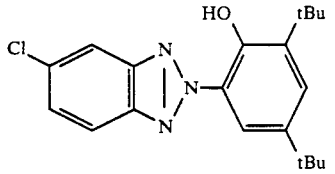

UV-1

-continued
UV-2
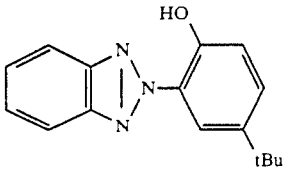
UV-3
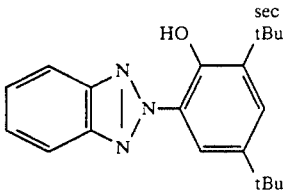
UV-4
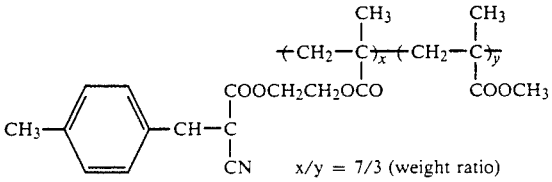
x/y = 7/3 (weight ratio)
UV-5
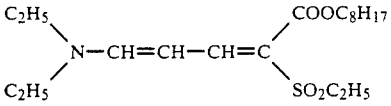
Tricresyl Phosphate — Solv-1
Dibutyl Phthalate — Solv-2
Solv-3
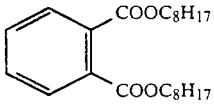
Solv-4
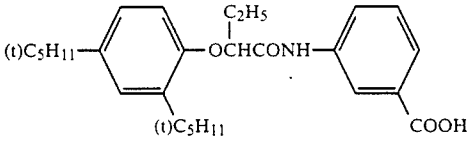
Cpd-1
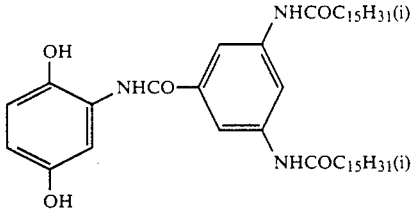
Cpd-2
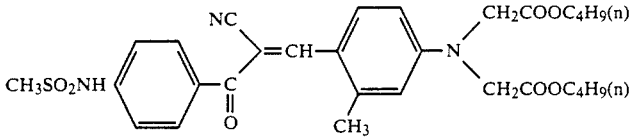
Cpd-3
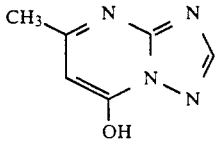
Cpd-4
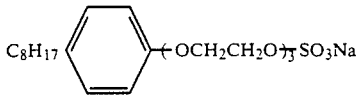

-continued
Cpd-5
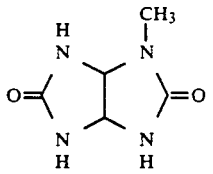
Cpd-6
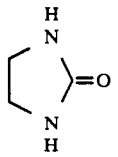
ExC-1
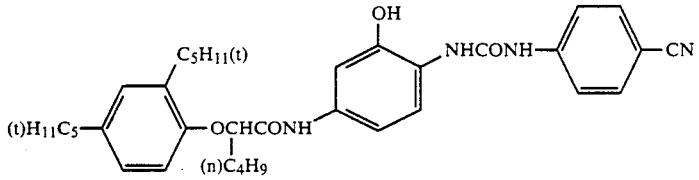
ExC-2
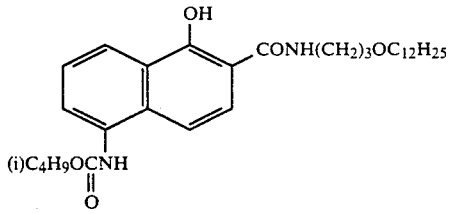
ExC-3
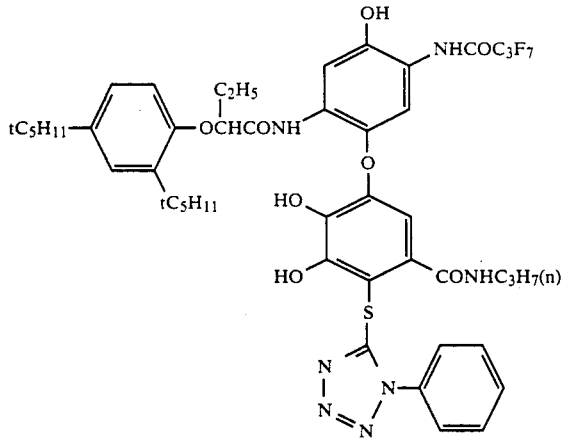
ExC-4
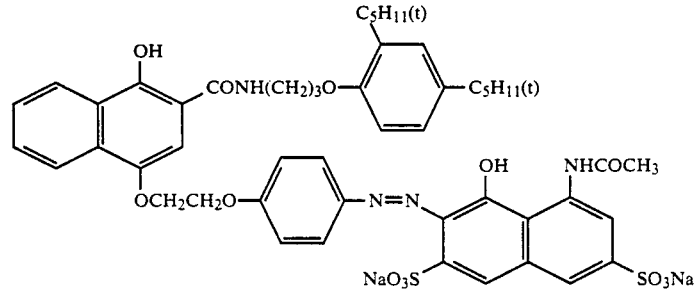

-continued
ExC-5
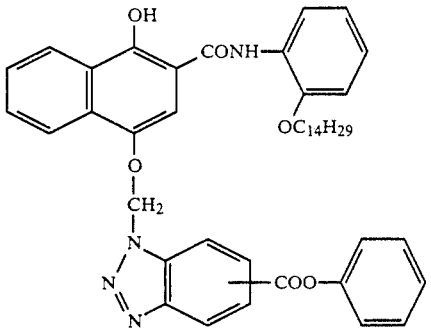
ExC-6
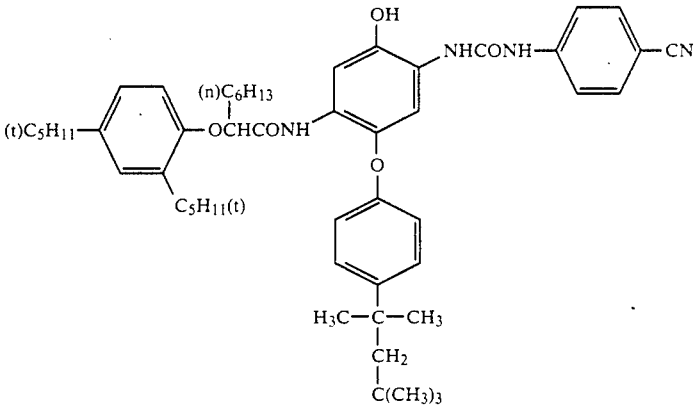
ExC-7
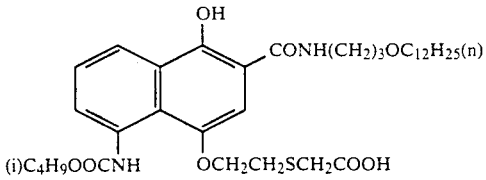
EX-8
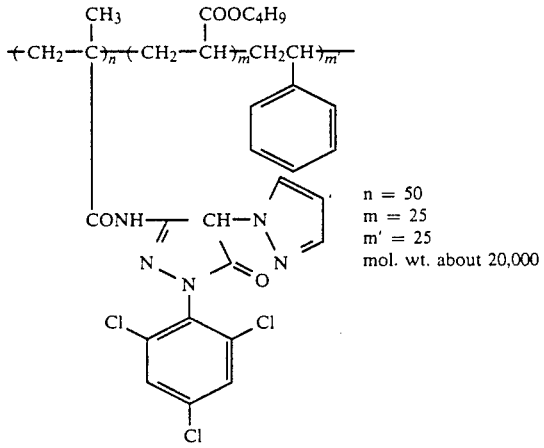
n = 50
m = 25
m' = 25
mol. wt. about 20,000

-continued
ExM-9
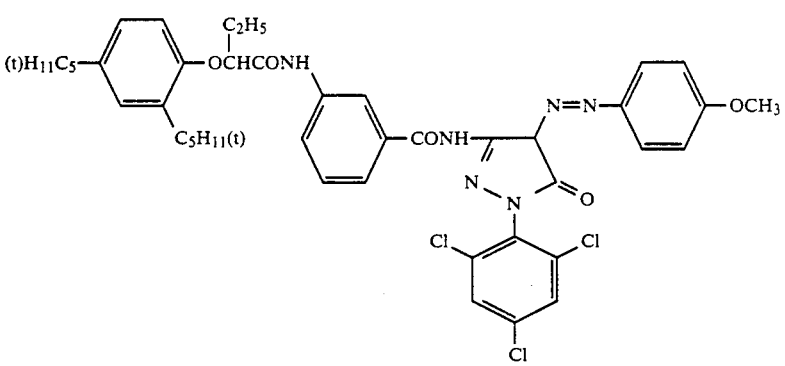
ExM-10
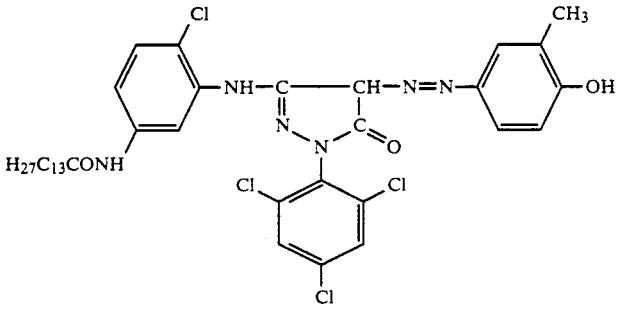
ExY-11
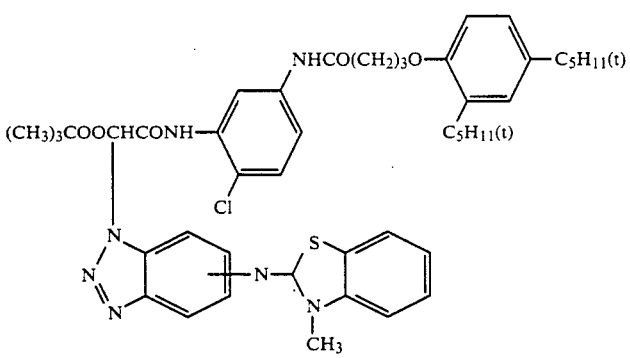
ExM-12
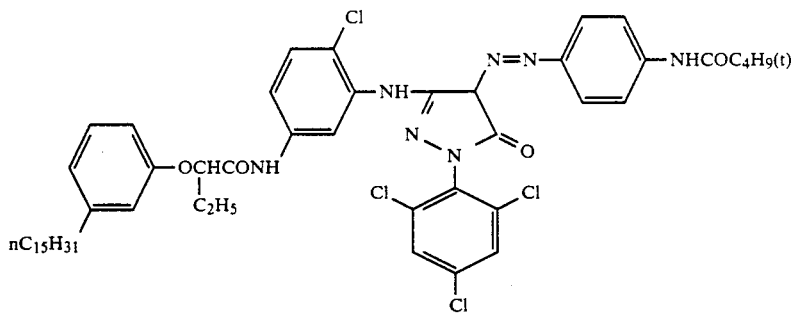
ExY-13
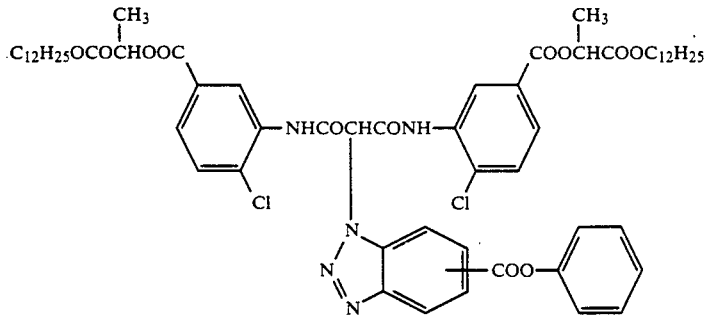

-continued
ExM-14
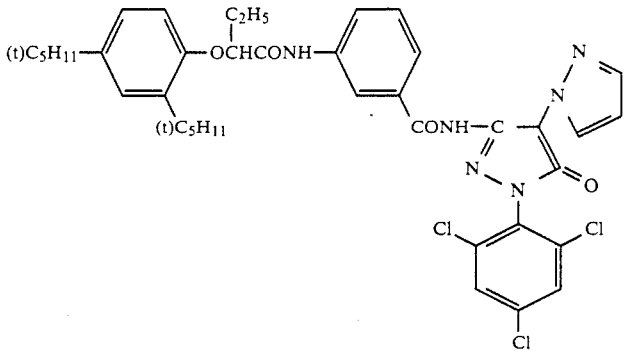
ExY-15
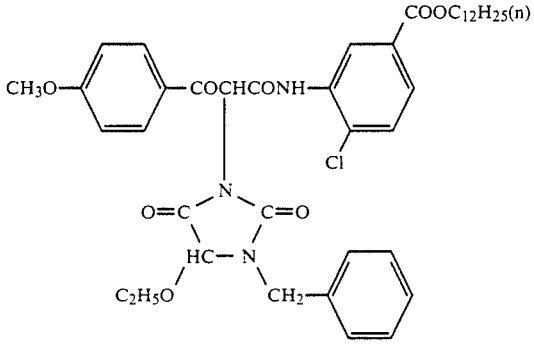
ExC-16
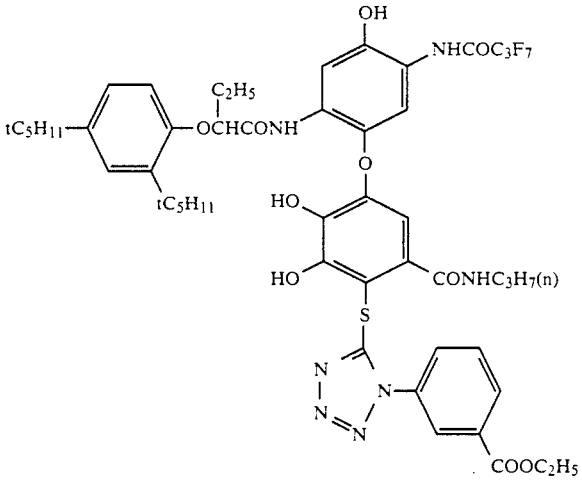
ExY-17
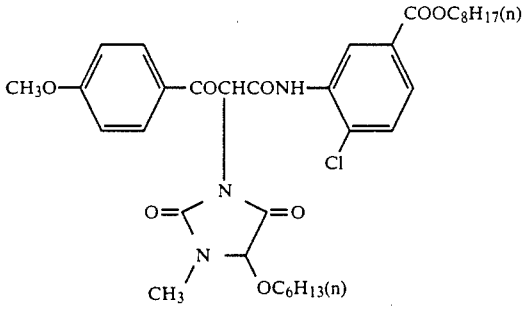
ExS-1
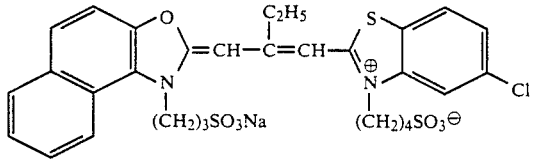

-continued

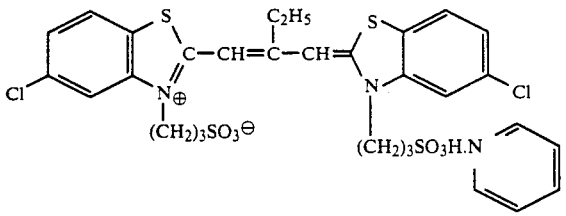

ExS-2

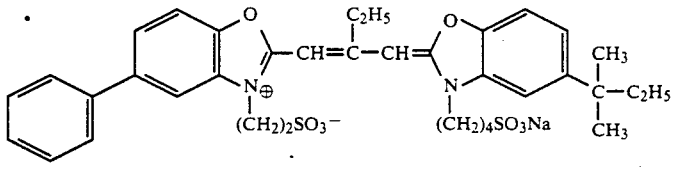

ExS-3

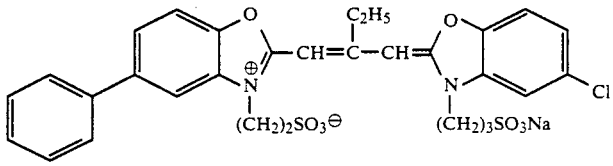

ExS-4

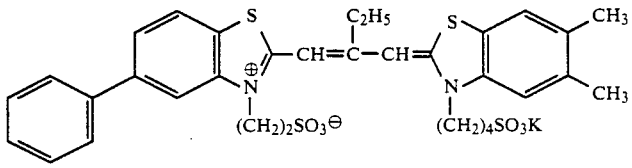

ExS-5

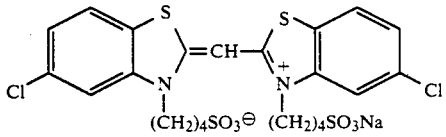

ExS-6

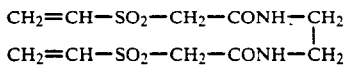

H-1

The aforesaid sample using Em-C, Em-D, Em-E, or Em-F in Example 2 for the Layer 4 of the red-sensitive emulsion layers of the aforesaid color photographic material was defined as sample 301, 302, 303, or 304, respectively.

After allowing to stand these samples for 14 hours at 40° C. and 70% in relative humidity, each sample was exposed through a continuous wedge for 1/100 second and processed as in Example 7 to provide characteristics curves of cyan, magenta, and yellow color images The reciprocal of the exposure amount of giving an optical density of fog +0.1 about the characteristic curve of cyan images was shown by the relative sensitivity. The pressure resisting charactreistics were evaluated as in Example 8.

The results obtained are shown in Table 11.

TABLE 11

Comparison of Pressure Resistant Characteristics and Sensitivity

| Sample | Emulsion | Sensitivity | Change of Fog Density at Bent Portion |
|---|---|---|---|
| Sample 301 (Comparison) | Em - C | 100 (Standard) | 0.16 |
| Sample 302 (Comparison) | Em - D | 90 | 0.08 |

TABLE 11-continued

Comparison of Pressure Resistant Characteristics and Sensitivity

| Sample | Emulsion | Sensitivity | Change of Fog Density at Bent Portion |
|---|---|---|---|
| Sample 303 (Comparison) | Em - E | 80 | 0.08 |
| Sample 304 (Invention) | Em - F | 150 | 0.07 |

As is clear from the results shown in the above table, it can be seen that color photographic materials having a high sensitivity and excellent pressure resisting characteristics are obtained by using the silver halide emulsion of this invention.

EXAMPLE 10

In water were dissolved gelatin and ammonia and while stirring the solution at 60° C., an aqueous silver nitrate solution (silver nitrate 120 g).and an aqueous potassium bromide solution-were added to the solution by a double jet method at a silver potential of +40 mV to a saturated calomel electrode.

Thereafter, the temperature of the mixture was lowered to 35° C., after removing soluble salts by a flocculation method, gelatin was further added thereto at 40° C., and pH and pAg were adjusted to 6.3 and 8.2, respectively to provide an emulsion Em-1.

Em-1 is monodispersed cubic grain silver halide emulsion having a projected area diameter of 0.8 μm and the coefficient of variation was 18%.

In water was dissolved potassium bromide, gelatin, and ammonia, while stirring the solution at 60° C., an aqueous silver nitrate solution (sodium nitrate 40 g) and an aqueous potassium bromide solution were added to the solution by a double jet method at a silver potential of +40 mV to a saturated calomel electrode. Thereafter, an aqueous silver nitrate solution (silver nitrate 10 g) and an aqueous sodium chloride solution were added thereto by a double jet method while keeping the silver potential at +40 mV to a saturated calomel electrode. Then, an aqueous potassium bromide solution (potassium bromide 10 g) was added thereto followed by ripening. Then, after adding thereto an aqueous silver nitrate solution to keep the silver potential at +4 mV, an aqueous silver nitrate solution and an aqueous potassium bromide solution were added thereto by a double jet method while keeping the silver potential at +40 mV. In this case the amount of silver nitrate used was 70 g.

After removing soluble salts as in the case of Em-1, pH and pAg were adjusted to 6.3 and 8.2, respectively to provide an emulsion Em-2. Em-2 was an monodispersed cubic silver halide emulsion having a projected area of 0.8 μm and the coefficient of variation was 19%.

Then, after adding the dye shown below to each of Em-1 and Em-2 at $5.0\times10^{-4}$ mole per mole of silver, each emulsion was most suitably chemically sensitized by sodium thiosulfate, potassium chloroaurate, and potassium thiocyanate at 64° C.

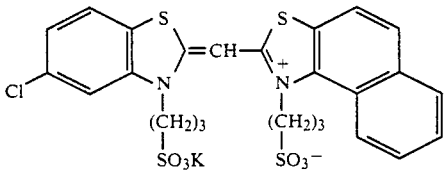

Then, after adding thereto a coating aid and a hardener, the emulsion was coated on a cellulose triacetate film support at a silver coverage of 2 g/m².

The evaluation of the pressure resistant characteristics was performed as follows. The sample was fixed at an end with the emulsion layer inside under a relative humidity of 40% and bent along a stainless steel pipe of 10 mm in diameter at 180° at a bending rate of 360°/sec. while rotating the pipe (kinking). The bending test was performed 10 seconds before the light exposure or 10 seconds after the exposure.

The coated sample was exposed through a continuous wedge to a tungstent lamp (having color temperature of 2854° K.) for one second and developed using the following surface developer (MMA-1) for 10 minutes at 20° C.

| | |
|---|---|
| Metol | 2.5 g |
| d-Ascorbic Acid | 10.0 g |
| Potassium Bromide | 1.0 g |
| Nabox | 35.0 g |
| Water to make | 1.0 liter |

The sensitivity and fog of the sample thus processed were evalauted on the bent (kinked) portion and an unbent portion. The sensitivity was shown by the relative value of the reciprocal of the exposure amount required to give an optical density of fog +0.1.

The results obtained are shown in Table 12.

TABLE 12

Comparison of Pressure Resistant Characteristics and Sensitivity

| | Evalaution of Pressure Characteristics | | | | | |
|---|---|---|---|---|---|---|
| | No Kinking | | Kinking Before Exposure | | Kinking After Exposure | |
| Sample | Fog | Sens. | Fog | Sens. | Fog | Sens. |
| Sample Em - 1 (Comparison) | 0.04 | 100 | 0.10 | 90 | 0.10 | 90 |
| Sample Em - 2 (Invention) | 0.03 | 158 | 0.04 | 150 | 0.04 | 158 |

As is clear from the results shown in Table 12, it can be seen that the silver halide emulsion of this invention is excellent in the pressure resistant characteristics and shows high sensitivity as compared with the comaprison emulsion although the grain sizes are same in both the emulsions. The gradation was almsot same in both emulsions.

EXAMPLE 11

In water were dissolved potassium bromide, gelatin, and ammonia and while stirring the solution at 60° C., an aqueous silver nitrate solution (silver nitrate 120 g) an an aqueous potassium bromide solution were added thereto by a double jet method at a silver potential of −40 mV to a saturated calomel electrode.

Then the dye shown below was added thereto at $1\times10^{-3}$ mole per mole of silver and the mixture was stirred for 10 minutes.

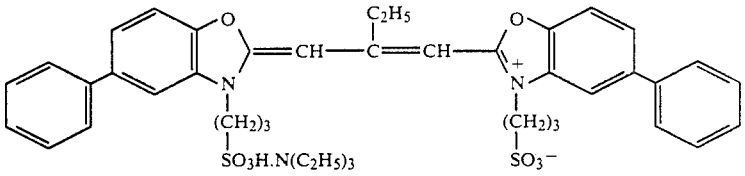

Then, the temperature of the mixture was reduced to 35° C., after removing soluble salts by a fluccualtion method, gelatin was added again to the mixture at 40° C., and then pH and pAg thereof were adjusted to 6.3 and 8.2, respectively to provide an emulsion Em-3.

Em-3 was a mono-dispersed octahedral grain silver halide emulsion having a projected area diameter of 0.8 μm and the coefficeint of variation thereof was 15%.

In water were dissolved potassium bromide, gelatin, and ammonia and while stirring the solution at 60° C., an aqueous silver nitrate solution (silver nitrate 60 g) and an aqueous potassium bromide solution were added thereto by a double jet method at a silver potential of −40 mV to a saturated calomel electrode. Then, after adding thereto 5 g of sodium chloride, an aqueous silver nitrate solution was added to adjust the silver potential to +50 mV. Thereafter, an aqueous potassium bromide solution was added to reduce the silver potential to −40 mV and the mixture was ripened for 5 minutes. Thereafter, an aqueous silver nitrate solution and an aqueous potassium bromide solution were added thereto by a double jet method while keeping the silver potential at −40 mV. In this case, the amount of silver nitrate used was 60 g. Then, after adding the aforesaid dye at $1\times10^{-3}$ mole per mole of silver, the mixture was stirred for 10 minutes and the mixture was treated as in the case of Em-3 to provide an emulsion Em-4. Em-4 was a mono-dispersed octahedral grain silver halide emulsion having a projected area diameter of 0.8 μm and the coefficient of variation thereof was 18%.

By following the same procedure as the production of Em-4 except that 85 ml of 1N potassium thiocyaante was used in place of using 5 g of sodium chloride, an emulsion Em-5 was prepared. Em-5 was a mono-dispersed octahedral silver halide emulsion having a projected area diameter of 0.8 μm and the coefficient of variation was 20%.

After keeping each of the emulsions Em-3, 4, and 5 at 50° C., each emulsion was most suitably chemically sensitized by sodium thiosulfate, potassium chloroaurate, and potassium thiocyanate.

Then, after adding thereto a coating aid and a hardener, the emulsion was coated on a cellulose triacetate film support at a silver coverage of 2.0 g/m². The caoted sample was exposed through a continuous wedge for 1/100 second using a BPN 42 filter (gelatin filter, made by Fuji Photo Film Co., Ltd.) in the case of seeing the intrinsic sensitivity or SC-48 filter (gelatin filter, made by Fuji Photo Film Co., Ltd.) in the case of seeing the color sensitized sensitivity, and then processed using each of the developers shown below for 7 minutes or 10 minutes at 20° C., respectively.

| | |
|---|---|
| Developer D76: | |
| Metol | 2 g |
| Anhydrous Sodium Sulfite | 100 g |
| Hydroquinone | 5 g |
| Borax ($Na_2B_4O_7.10H_2O$) | 1.53 g |
| Water to make | 1 liter |
| Delveloper D19: | |
| Metol | 2 g |
| Hydroquinone | 8 g |
| Anhydrous Sodium Sulfite | 90 g |
| Anhydrous Sodium Carbonate | 45 g |
| Potassium Bromide | 5 g |
| Water to make | 1 liter |

The sensitivity of the sample thus processed was shown by the relative value of the reciprocal of the exposure amount required for giving an optical density of fog +0.1.

The pressure resisting property was evaluated as in Example 10.

TABLE 13

| Developer | Specific Sensitivity | Color Sensitized Sensitivity | Fog | Fog at Rinked Portion |
|---|---|---|---|---|
| D 76 Em-3 | 100 | 100 | 0.04 | 0.09 |

TABLE 13-continued

| Developer | Specific Sensitivity | Color Sensitized Sensitivity | Fog | Fog at Rinked Portion |
|---|---|---|---|---|
| (Comparison) | (Standard) | (Standard) | | |
| Em-4 (Invention) | 130 | 140 | 0.03 | 0.05 |
| Em-5 (Invention) | 160 | 170 | 0.04 | 0.05 |
| D-19 Em-3 (Comparison) | 100 (Standard) | 100 (Standard) | 0.05 | 0.12 |
| Em-4 (Invention) | 130 | 140 | 0.04 | 0.06 |
| Em-5 (Invention) | 160 | 170 | 0.05 | 0.06 |

As is clear from the results shown in the above table, it can be seen that the emulsions of this invention have very high sensitivity. Also, the emulsions of this invention give less increase of fog density at bent portion and thus show excellent pressure resisting property.

EXAMPLE 12

In water were dissolved potassium bromide and gelatin and while stirring the solution at 76° C., an aqueous silver nitrate solution (silver nitrate 100 g) and an aqueous potassium bromide solution were added thereto by a double jet method to porvide core grains having a silvre iodide content of 35 mole %. Then, an aqueous silver nitrate solution (silver nitrate 100 g) and an aqueous potassium bromide solution were added thereto by a double jet method to form silver bromide shells on the cores.

Thereafter, the temperature of the mixture was reduced to 35° C., after removing soluble salts by a flocculation method, gelatin was added thereto at 40° C. and pH and pAg thereof were adjusted to 6.2 and 8.9, respectively to provide an emulsion Em-6.

Em-6 was a mono-dispersed octahedral grain silver halide emulsion having a projected area diameter of 1.0 μm and the coefficient of variation thereof was 16%.

In water were dissolved potassium bromide and gelatin and while stirring the solution at 76° C., an aqueous silver nitrate solution (silver nitrate 100 g) and an aqueous solution of potassium bromide and potassium iodie were added to the solution by a double jet method to form core grains having a silver iodide content of 35 mole %. Then, after adding thereto an aqueous sodium chloride solution (sodium chloride 10 g), an aqueous silver nitrate solution was added. Thereafter, an aqueous silver nitrate solution and an aqueous potassium bromide solution were added to the mixture by a double jet method. In this case the amount of silver nitrate used was 100 g. Then, soluble salts were removed as in the case of Em-6 to provide an emulsion Em-7.

Em-7 was a mono-dispersed octahedral grain silver halide emulsion having a diameter of 1.0 μm and the coefficient of variation was 16%.

Each of the emulsions Em-6 and 7 was most suitably chemically sensitized by sodium thiosulfate, potassium chloroaurate, and potassium thiocyanate.

Then after adding the dye shown below to each emulsion $5\times10^{-4}$ mole per mole of silver and also adding thereto the additive shown below at $3\times10^{-4}$ mole per mole of silver, the emulsion was coated on a cellulose triacetate film support having subbing layer as shown below together with a protective layer shown below.

Dye

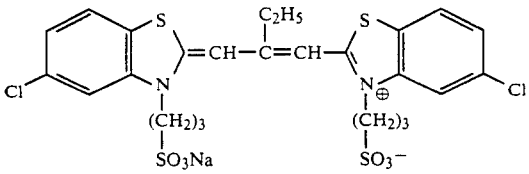

Additive

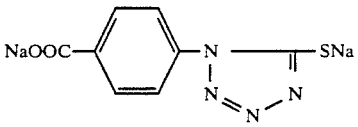

Emulsion Layer

| | |
|---|---|
| Emulsion: Ex - 6 or Em - 7 | $2.1 \times 10^{-2}$ mole/m$^2$ as silver |
| Coupler shown below | $1.5 \times 10^{-3}$ mole/m$^2$ |

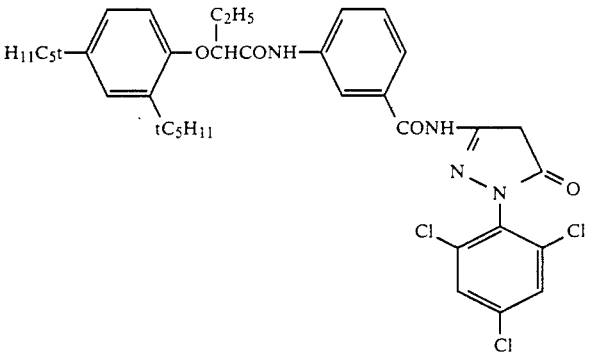

| | |
|---|---|
| Tricresyl Phosphate | 1.10 g/m$^2$ |
| Gelatin | 2.30 g/m$^2$ |
| Protective Layer | |
| 2,4-Dichlorotriazine-6-hydroxy-s-triazine Sodium Salt | 0.08 g/m$^2$ |
| Gelatin | 1.80 g/m$^2$ |

After allowing to stand these samples for 14 hours at 40° C. and a relative humidity of 70%, each sample was exposed through a continuous wedge for 1/100 second using BPN-42 filtre (gelatin filter, made by Fuji Photo Film Co.) in the case of seeing the intrinsic sensitivity or SC-52 filter (gelatin filter, made by Fuji Photo Film Co., Ltd.) in the case of seeing the color sensitized sensitivity, processed by the steps shown below, and the density of the sample thus processed was measured using a green filter.

The processing steps were as followed and performed at 38° C.

| | |
|---|---|
| 1. Color Development | 2 min. 45 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The compositions of the processing solutions used in the aforesaid steps were as follows.

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |

-continued

| | |
|---|---|
| Hydroxylamine Sulfate | 2.4 g |
| 4-(N-Ethyl-N-β-hydroxyethylamino)-2-methylaniline Sulfate | 4.5 g |
| Water to make | 1 liter |
| Bleach Solution: | |
| Ammonium Bromide | 160.0 g |
| Aqueous Ammonia (28%) | 25.0 ml |
| Ethylenediaminetetraacetic Acid Sodium Iron Salt | 130 g |
| Glacial Acetic Acid | 14 ml |
| Water to make | 1 liter |
| Fix Solution: | |
| Sodium Tetrapolyphosphate | 2.0 g |
| Sodium Sulfite | 4.0 g |
| Ammonium Thiosulfate (70%) | 175.0 g |
| Sodium Hydrogensulfite | 4.6 g |
| Water to make | 1 liter |
| Stabilization Solution: | |
| Formalin | 8.0 ml |
| Water to make | 1 liter |

The sensitivity was shown by the reciprocal of the exposure amount giving fog +0.2 shown by lux/sec.

The pressure resistant characteristics were evaluated by the same manner as Example 10.

The results obtained are shown in Table 14.

TABLE 14

| Comaprison of Pressure Resisting Property and Sensitivity | | | | |
|---|---|---|---|---|
| | Relative Sensitivity | | C.S.S. by Kinking Before | I.S. by Kinking Before |
| Sample | C.S.S. | I.S. | Exposure | Exposure |
| Em - 6 (Comaprison) | 100* | 100* | 63 | 63 |
| Em - 7 (Invention) | 260 | 270 | 200 | 200 |

C.S.S.: Color Sensitized Sensitivity
I.S.: Intrinsic Sensitivity
*Standard

As is clear from the results shown above, it can be seen that the emulsion of this invention has a high sensitivity and shows less reduction of sensitivity at bent portion.

EXAMPLE 13

In water were dissolved potassium bromide, potassium iodide, and gelatin and while stirring the solution at 70° C., an aqueous silver nitrate solution (silver nitrate 120 g) was added to the solution by a single jet method.

Thereafter, the temperature of the mixture was reduced to 35° C., after removing soluble salts by a flocculation method, gelatin was added again to the mixture at 40° C., and pH and pAg thereof were adjusted to 6.3 and 8.2, respectively to provide an emulsion of Em-8.

Em-8 was a poly-dispersed (coefficient of variation 40%) emulsion of potato-like grains having a mean projected area diameter of 0.8 μm and contained silver iodobromide grains having an iodide content of 3 moles.

In water were dissolved potassium bromide, gelatin, and ammonia and while stirring the solution at 60° C., an aqueous silver nitrate solution (silver nitrate 120 g) and an aqueous potassium bromide solution (containing potassium iodide) were added to the solution by a double jet method at a silver potential of −40 mV to a saturated calomel electrode.

Thereafter, the temperature of the mixture was reduced to 35° C., after removing soluble salts by a flocculation method, gelatin was added thereto again at 40° C., and pH and pAg thereof were adjusted to 6.3 and 8.2, respectively to provide an emuslion Em-9.

Em-9 was a mono-dispersed (coefficient of variation 19%) octahedral grain silver halide emulsion having a projected area diameter of 0.8 μm and said grains were iodobromide grains containing 3 moles of iodide.

In water were dissolved potassium bromide, gelatin, and ammonia and while stirring the solution at 60° C., an aqueous silver nitrate solution (silver nitrate 60 g) and an aqueous potassium bromide solution (containing potassium iodide) were added to the solution by a double jet method at a silver potential of −40 mV to a saturated calomel electrode. Then, after adding thereto 8 g of sodium chloride, the silver potential was adjusted to +40 mV. Thereafter, an aqueous potassium bromide solution (containing potassium iodide) was added thereto to adjust tje silver potential to −40 mV and the mixture was ripened for 10 minutes. Thereafter, an aqueous silver nitrate solution and an aqueous potassium bromide solution (containing potassium iodide) were added thereto by a double jet method while keeping the silver potential at −40 mV. In this case the amount of silver nitrate used was 60 g. Thereafter, the temperature of the mixture was reduced and soluble salts were removed therefrom as in the case of Em-9 to provide an emulsion Em-10.

Em-10 was a mono-dispersed (coefficient of variation 19%) octahedral grain silver halide emulsion having a projected area diameter of 0.8 μm and the grains were silver iodobromide grains having an iodine content of 3 moles.

Each of the emulsions Em-8, 9, and 10 was most suitably chemically sensitized by sodium thiosulfate, potassium chloroaurate, and potassium thiocyanate at 55° C.

Then, the layers shown below were successively formed on a cellulose triacetate film support to provide each coated sample.

| | |
|---|---|
| Lowermost Layer | |
| Binder: Gelatin | 1 g/m² |
| Fix Accelerator E - 1 | |

E - 1:

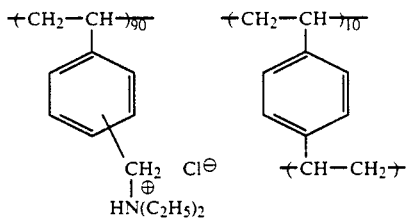

| | |
|---|---|
| Emulsion Layer 1 | |
| Mono-dispersed Silver Iodobromide Emulsion (circle-corresponding diameter 0.3 μm. coeff. of variation 13%, iodine content 3 mole %) | 1.5 g/m² as silver |
| Gelatin | 1.6 g/g-Ag |
| Sensitizing Dye shown below | |

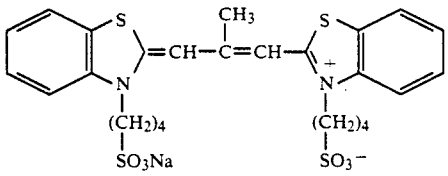

| | |
|---|---|
| Additive: $C_{18}H_{35}O(CH_2CH_2O)_{20}H$ | 5.8 mg/g-Ag |
| Coating Aid: Sodium Dodecylbenzenesulfonate | 0.07 mg/m² |
| Potassium Poly-p-styrenesulfonate | 0.7 mg/m² |
| Emulsion Layer 2 | |
| Em - 8, Em - 9, or Em - 10 | 4.0 g/m² as Ag |
| Binder, sensitizinf dye, additive, and coating aids were same as in Emulsion Layer 1 | |
| Surface Protective Layer | |
| Binder: Gealtin | 0.7 g/m² |
| Coating Aid: N-Oleyl-N-methyltaurine Sodium Salt | 0.2 mg/m² |
| Matting Agent: Polymethyl Methacrylate Fine Particles: mean particle size 3 μm) | 0.13 mg/m² |

Sensitometry

Each of these samples was stored for 7 days after coating at 25° C. and 65% RH. Then, each sample was exposed through a continuous wedge to a tungsten lamp (color temperature 2854° K.) for one second and developed by a developer D76 shown in Example 11 for 7 minutes, fixed by a fix solution (Fiji Fix, made by Fuji Photo Film Co., Ltd.), washed and dried.

The sensitivity of the sample thus processed was shown by the relative layer of the reciprocal of the exposure amount required for giving an optical density of fog +0.1.

The gradation was shown by the relative value of the reciprocal of the difference between the exposure amount required to give an optical density of fog +0.1 and the exposure amount required to give an optical density of fog +0.8.

The pressure resisting property was evaluated as in Example 10.

The results obtained are shown in Table 15.

TABLE 15

Comparison of Pressure Resistant Property and Sensitivity

| Emulsion | Relative Sensitivity | Fog | Gradation | Fog at Kinked Portion |
|---|---|---|---|---|
| Em - 8 (Comparison) | 100 | 0.4 | 70 | 0.6 |
| Em - 9 (Comparison) | 80 | 0.4 | 100 | 0.8 |
| Em - 10 (Invention) | 140 | 0.4 | 100 | 0.5 |

As is clear from the results shown above, it can be seen that the emulsion of this invention is excellent in sensitivity, contrast, and pressure resistant property.

EXAMPLE 14

By simultaneously adding an aqueous potassium bromide solution and an aqueous silver nitrate solution to an aqueous solution of 2.1% gelatin heated to 63° C. while controlling pAg over a period of 15 minutes, a silver bromide emulsion having a mean grain size of 0.25 μm was obtained. Thereafter, an aqueous potassium bromide solution and an aqueous silver nitrate solution were added to the emulsion at pAg of 6.0, whereby the diameter of the crystals in the starting emulsion were grown twice.

Then, by simultaneously adding thereto an aqueous potassium chloride solution and an aqueous silver nitrate solution white controlling pAg, the shell of silver chloride was deposited on the crystal. Furthermore, by simultaneously adding an aqueous potassium bromide solution and an aqueous silver nitrate solution to the emulsion and depositing precipitations thereon to form the shell of silver bromide on the aforesaid shell of silver chloride The emulsion obtained was a mono-dispersed cubic grain silver halide emulsion having a mean crystal size of 0.65 μm and the coefficient of variation thereof was 16%.

After removing soluble salts by washing the emulsion according to an ordinary manner, pAg thereof was adjusted to 7.8. Then, after adding thereto sodium thiosulfate penta-hydrate in an amount of 80 μmoles per mole of silver and 42.5 mg of triazaindrizine, the emulsion was ripened for 120 minutes at 45° C. to provide an emulsion Em-11.

In the aforesaid preparation of the emulsion, after forming the cubic grains having a diamter of 0.5 μm, silver chloride was deposited thereon in an amount of 5 mole % as silver. Thereafter, an aqueous potassium bromide solution was added thereto to adjust pAg to 8 followed by ripening for 5 minutes. Then, after adjusting back the pAg to the original value, an aqueous potassium bromide solution and an aqueous silver nitrate solution were added thereto to provide mono-dispersed cubic grains having a mean grain size of 0.65 μm. The coefficient of variation thereof was 16%. Then, by treating the emulsion as almost same as for Em-11, an emulsion Em-12 was obtained.

The emulsions thus prepared were applied to the following photographic material having the multilayer structure.

Thus, a color photographic material having the following layers on a paper support both surfaces of which had been coated with polyethylene was prepared. The polyethylene layer at the emulsion layer side contained titanium dioxide and a slight amount of ultramarine blue.

In the following compositions for layers, the caoting amount was shown by a g/m$^2$ unit, wherein the amount was shown by silver calculated amount on silver halide emulsion and colloid silver.

| | |
|---|---|
| Layer 1 Coloring Material-Containing Layer | |
| Black Colloid Silver dispersion | 0.07 |
| Gelatin | 0.48 |
| Layer 2 Interlayer | |
| Gelatin | 0.90 |
| Di-t-octylhydroquinone | 0.05 |
| Solvent for above (DBO) | 0.10 |
| Layer 3 Blue-Sensitive Emulsion Layer | |
| Silver Chlorobromide Emulsion (silver bromdie 80 mole %) | 0.30 |
| Yellow Coupler (*1) | 0.70 |
| Solvent for above (YNP) | 0.15 |
| Gelatin | 1.20 |
| Layer 4 Interlayer | |
| Gelatin | 0.90 |
| Di-t-octylhydroquinone | 0.05 |
| Solvent for above (DBP) | 0.10 |
| Layer 5 Green-Sensitive Emulsion Layer | |
| Silver Chlorobromide Emulsion (silver bromide 70 mole %) | 0.45 |
| Magenta Coupler (*2) | 0.35 |
| Solvent for above (TOP) | 0.44 |
| Fading Preventing Agent (*3/*4) | 0.05/0.10 |
| Gelatin | 1.00 |
| Layer 6 Ultraviolet Absorptive Interlayer | |
| Ultraviolet Absorbent (*5/*6/*7) | 0.06/0.25/0.25 |
| Solvent for above (TNP) | 0.20 |
| Layer 7 Red-Sensitive Emulsion Layer | |
| Em - 11 | 0.20 |
| Cyan Coupler (*8/*9) | 0.2/0.2 |
| Coupler Solvent (TNP/DBP) | 0.10/0.20 |
| Gelatin | 0.9 |
| Layer 8 Ultraviolet Absorptive Interlayer | |
| Ultraviolet Absorbent (*5/*6/*7) | 0.20 |
| Solvent for above (DBP) | |
| Gelatin | 0.15 |
| Layer 9 Protective Layer | |
| Gelatin | 1.5 |

In the above compositions, DBP shows dibutyl phthalate, TOP tri(n-octylphosphate), and TNP tri(n-nonylphosphate).

The compounds (*1) to (*9) used above are as follows.

(*1)
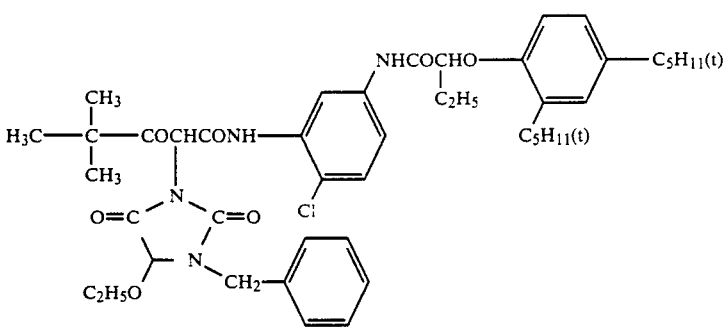
(*2)
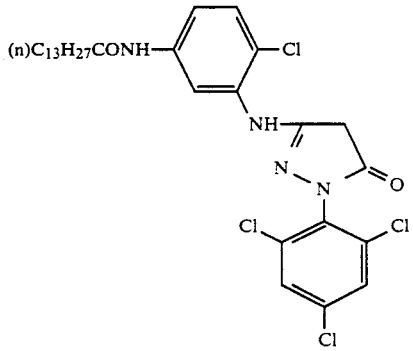
(*3)
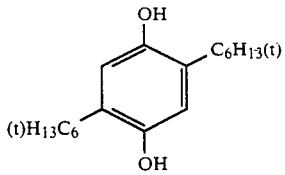
(*4)
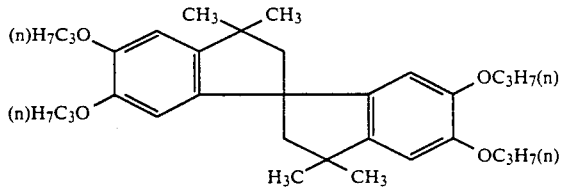
(*5)
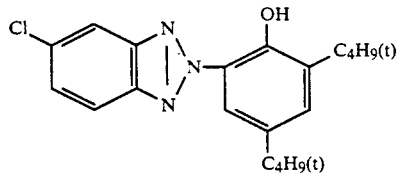
(*6)
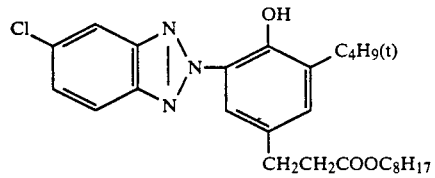
(*7)
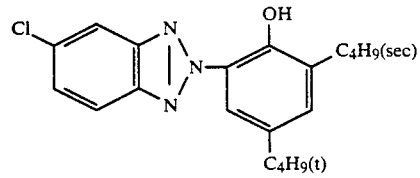

-continued (*8)

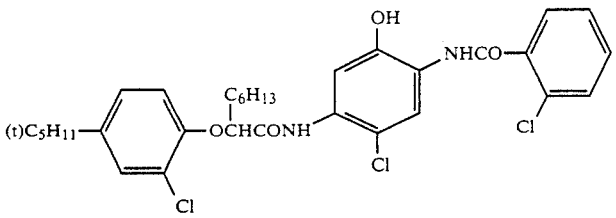

(*9)

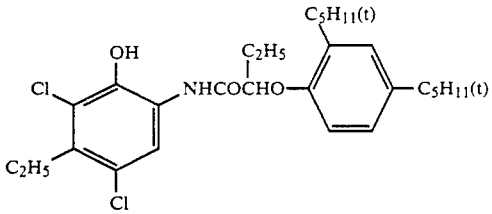

In addition, for each emulsion layer was used the following dye as a spectral sensitizer.

For Blue-Sensitive Emuslion Layer: 4- 5-Chloro-2-[5-chloro-3-(4-sulfonatobutyl)benzothiazolin-2-iridenemethyl]-3-benzothiazolio butanesulfonate triethylammonium Salt ($2\times10^{-4}$ mole per mole of silver halide).

For Green-Sensitive Emulsion Layer: 3,3-Di-(γ-sulfopropyl)-5,5-diphenyl-9-ethyloxacarbocyanine Sodium Salt ($2.5\times10^{-4}$ mole per mole of silver halide).

For Red-Sensitive Emulsion Layer: 3,3'-Di-(γ-sulfopropyl)-9-methyl-thiadicarbocyanine Sodium Salt ($2.5\times10^{-4}$ mole per mole of silver halide).

Also, for each emulsion layer, the following dye was used an an irradiation preventing dye.

For Green-Sensitive Emulsion Layer:

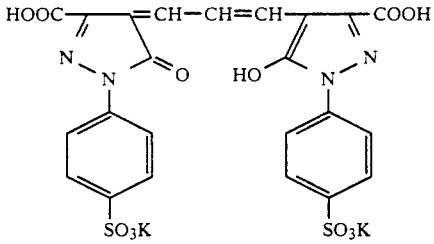

For Red-Sensitive Emulsion Layer:

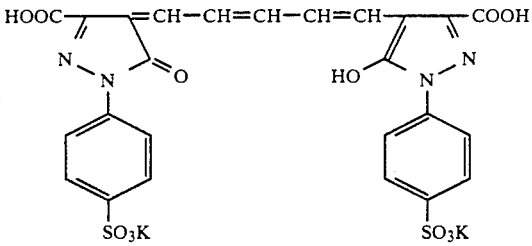

The sample obtained was defined as sample 501.

Also, by following the same procedure as above while using Em-12 in place of Em-11 in Layer 7, sample 502 was prepared.

Each of the sample was gradation exposed fpr sensitometry using an enlarge (Fuji Color Head 609, trade name, made by Fuji Photo Co., Ltd.) and processed by the following processing steps.

Also, the pressure resistant characteristics was evaluated as ofllows. The coated sample was fixed with the emulsion layer above and the emulsion layer was scratched by a metal styrus having a diameter of 0.01 mm. In this case, a proper load was applied onto the metal styrus. The scratch by the metal styrus was performed before development and the change of density at the scratched portion in the cyan density at fogged portion was measured by a micro densitometer.

| Processing Step | Temperature | Time |
|---|---|---|
| Development | 33° C. | 3.5 min. |
| Blix | 33° C. | 1.5 min. |
| Wash | 28 to 35° C. | 3.0 min. |

| | | |
|---|---|---|
| Developer: | | |
| Nitrilotriacetic Acid.3Na | | 2.0 g |
| Benzyl Alcohol | | 15 ml |
| Diethylene Glycol | | 10 ml |
| Sodium Sulfite | | 2.0 g |
| Potassium Bromide | | 0.5 g |
| Hydroxylamine Sulfate | | 3.0 g |
| 4-Amino-3-methyl-N-ethyl-N-[β-methanesulfonamido)ethyl]-p-phenylenediamine.Sulfate | | 5.0 g |
| Sodium Carbonate (monohydrate) | | 30 g |
| Water to make | | 1 liter |
| | pH | 10.1 |
| Blix Solution: | | |
| Ammonium Thiosulfate (70 wt. %) | | 150 ml |
| Sodium Sulfite | | 15 g |
| $NH_4$[Fe(EDTA)] | | 55 g |
| EDTA.2Na | | 4 g |
| Water to make | | 1 liter |
| | pH | 6.9 |

EDTA: Ethylenediaminetetraacetic acid

The test results of the sensitometry and pressure resisting property are shown in Table 16.

The sensitometery was shown by the corelation of the logarithm of the exposure amount to the sensitivity of smaple 501 being defined as 0. The sign (+) shows a direction of higher sensitivity.

TABLE 16

Sensitivity and Pressure Resisting Property

| | Sample No. | |
|---|---|---|
| | Sample 501 (Comparison) | Sample 502 (Invention) |
| | Emulsion | |
| | Em - 11 | Em - 12 |
| Sensitivity (Red-Sensitive | 0 | +0.15 |

TABLE 16-continued

| Sensitivity and Pressure Resisting Property | Sample No. | |
|---|---|---|
| | Sample 501 (Comparison) | Sample 502 (Invention) |
| | Emulsion | |
| | Em - 11 | Em - 12 |
| Layer) | | |
| Increase of Fog by Scratching (Red-Sensitive Layer) | 0.15 | 0.10 |

From the results shown in Table 16, it can be seen that the emulsion of this invention showed high sensitivity in apite of having the same grain size as that of the comparison emulsion.

Also, it can be seen that the emulsion of this invention shows less increase of fog density by scratching and is excellent in pressure resistance.

EXAMPLE 15

A multilayer color photogrpahic material (sample 601) having the following layers on a cellulose triacetate film suppor having subbing layer was prepared.

Sample 601

In the following compositions, the coating amount was shown by g/m$^2$ unit as silver on silver halide emulsion and colloid silver, g/m$^2$ unit on additives and gelatin, and a mole number per mole of silver halide in the same layer on a sensitizing dye.

| | |
|---|---|
| Layer 1 Antihalation Layer | |
| Black Colloid Silver | 0.37 |
| Gelatin | 2.81 |
| Ultraviolet Absorbent UV-1 | 0.03 |
| Ultraviolet Absorbent UV-2 | 0.05 |
| Ultraviolet Absorbent UV-3 | 0.06 |
| High-Boiling Organic Solvent for Dispersion Solv-1 | 0.07 |
| Layer 2 Interlayer | |
| Gelatin | 1.52 |
| Ultraviolet Absorbent UV-1 | 0.03 |
| Ultraviolet Absorbent UV-2 | 0.05 |
| Ultraviolet Absorbent UV-3 | 0.06 |
| High-Boiling Organic Solvent Solv-1 | 0.07 |
| Layer 3 High-Speed Red-Sensitive Emulsion Layer | |
| Silver Iodobromide Emulsion (AgI 10 mole %, spherical grains of 0.7 μm in grain size) | 0.90 |
| Silver Iodobromide Emulsion (AgI 2 mole %, spherical grains of 0.25 μm in grain size) | 0.45 |
| Gelatin | 2.05 |
| Sensitizing Dye I | $7.0 \times 10^{-4}$ |
| Coupler Ex-1 | 0.04 |
| Coupler Ex-2 | 0.19 |
| Coupler Ex-3 | 0.20 |
| Coupler Ex-4 | 0.10 |
| Coupler Ex-5 | 0.11 |
| High-Boiling Organic Solvent Solv-2 | 0.10 |
| High-Boiling Organic Solvent Solv-3 | 0.20 |
| Layer 4 Low-Speed Red-Sensitive Emulsion Layer | |
| Silver Iodobromide Emulsion (AgI 3.5 mole %, uniform cubic grains having a side length of 0.09 μm) | 0.60 |
| Gelatin | 1.93 |
| Sensitizing Dye D-1 | $9.0 \times 10^{-4}$ |
| Coupler Ex-1 | 0.03 |
| Coupler Ex-2 | 0.23 |
| Coupler Ex-3 | 0.24 |
| Coupler Ex-4 | 0.03 |
| High-Boiling Organic Solvent Solv-2 | 0.10 |

-continued

| | |
|---|---|
| High-Boiling Organic Solvent Solv-3 | 0.20 |
| Layer 5 Interlayer | |
| Gelatin | 0.90 |
| Color Mixing Preventing Agent Ex-6 | 0.09 |
| High-Boiling Organic Solvent Solv-2 | 0.05 |
| Dye F-1 | 0.04 |
| Dye F-2 | 0.04 |
| Layer 6 Low-Speed Green-Sensitive Emulsion Layer | |
| Silver Iodobromide Emulsion (AgI 3.5 mole %, uniform cubic grains having side length of 0.14 μm) | 0.46 |
| Gelatin | 0.93 |
| Sensitizing Dye D-II | $6.0 \times 10^{-4}$ |
| Coupler Ex-7 | 0.36 |
| Coupler Ex-8 | 0.07 |
| High-Boiling Organic Solvent Solv-2 | 0.32 |
| Layer 7 Intermediate-Speed Green-Sensitive Emulsion Layer | |
| Silver Iodobromide Emulsion (AgI 4 mole %, spherical grains of 0.40 μm in grain size) | 0.67 |
| Gelatin | 0.86 |
| Sensitizing Dye D-II | $9.0 \times 10^{-4}$ |
| Sensitizing Dye D-III | $1.0 \times 10^{-4}$ |
| Sensitizing Dye D-IV | $5.0 \times 10^{-5}$ |
| Coupler Ex-7 | 0.22 |
| Coupler Ex-8 | 0.10 |
| Coupler Ex-5 | 0.04 |
| Coupler Ex-9 | 0.09 |
| High-Boiling Organic Solvent Solv-2 | 0.20 |
| Layer 8 High-Speed Green-Sensitive Emulsion Layer | |
| Em-6 | 0.48 |
| Gelatin | 0.46 |
| Sensitizing Dye D-II | $5.0 \times 10^{-4}$ |
| Coupler Ex-7 | 0.04 |
| Coupler Ex-5 | 0.01 |
| High-Boiling Organic Solvent Solv-2 | 0.04 |
| Layer 9 Yellow Filter Layer | |
| Gelatin | 1.19 |
| Yellow Colloid Silver | 0.11 |
| Color Mixing Preventing Agent Ex-6 | 0.28 |
| High-Boiling Organic Solvent Solv-2 | 0.15 |
| Layer 10 Low-Speed Blue-Sensitive Emulsion Layer | |
| Silver Chloroiodo-bromide Emulsion (AgI 1 mole %, AgCl 5 mole %, cubic grains having side length of 0.17 μm) | 0.73 |
| Gelatin | 1.31 |
| Sensitizing Dye D-V | $1.0 \times 10^{-2}$ |
| Coupler Ex-10 | 0.74 |
| Coupler Ex-11 | 0.04 |
| High-Boiling Organic Solvent Solv-2 | 0.25 |
| Layer 11 High-Speed Blue-Sensitive Emulsion Layer | |
| Silver Chloroiodo-bromide Emulsion (AgI 8 mole %, AgCl 6 mole %, circle-corresponding diameter 0.60 μm, yabular grains having aspect ratio of 7) | |
| Silver Chloroiodo-bromide Emulsion (AgI 4 mole %, AgCl 7 mole %, circle-corresponding diameter 0.38 μm, tabular grains having mean aspect ratio of 6) | 0.20 |
| Gelatin | 1.54 |
| Sensitizing Dye D-V | $2.0 \times 10^{-3}$ |
| Coupler Ex-10 | 0.28 |
| Coupler Ex-5 | 0.08 |
| High-Boiling Organic Solvent Solv-2 | 0.09 |
| Layer 12 1st Protective Layer | |
| Gelatin | 0.60 |
| Ultraviolet Absorbent UV-4 | 0.11 |
| Ultraviolet Absorbent UV-5 | 0.17 |
| High-Boiling Organic Solvent Solv-4 | 0.02 |
| Dye F-3 | 0.05 |
| Layer 13 2nd Protective Layer | |
| Fine Grain Silver Halide Emulsion (AgI 1 mole %, spherical silver iodobromide grains having circle-corresponding diameter of 0.07 μm) | 0.74 |
| Gelatin | 1.87 |
| Polymethyl Methacrylate Particles (diameter 1.5 μm) | 0.15 |

-continued

| | |
|---|---|
| Hardener H-1 | 0.50 |

Each layer further contained a surface active agent as a coating aid.

Thus, sample 601 was prepared. Also, by following the same procedure as above while using Em-7 in place of Em-6 in Layer 8, sample 602 was prepared.

Also, the following ocmpouns are added to each emulsion for improving the shelf life, processing property, film property, and stabilization.

SPC-1

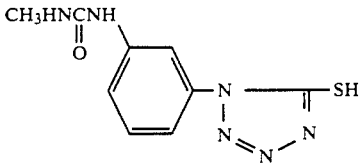

SPC-2

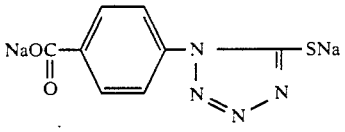

SPC-3

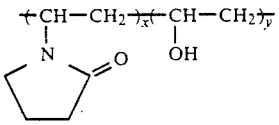

SPC-4

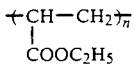

SPC-5

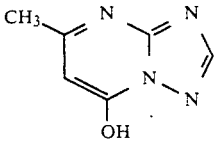

Each of the samples was exposed and processed by the following processing steps.

| Processing Step | Processing Time | Processing temp. |
|---|---|---|
| Color Development | 3 min. 15 sec. | 38° C. |
| Bleach | 6 min. 30 sec. | 38° C. |

-continued

| Processing Step | Processing Time | Processing temp. |
|---|---|---|
| Wash | 2 min. 10 sec. | 24° C. |
| Fix | 4 min. 20 sec. | 38° C. |
| Wash (1) | 1 min. 05 sec. | 24° C. |
| Wash (2) | 1 min. 00 sec. | 24° C. |
| Stabilization | 1 min. 05 sec. | 38° C. |
| Drying | 4 min. 20 sec. | 55° C. |

The compositions of the processing solutions used in the above steps were as follows:

| | |
|---|---|
| Color Developer: | |
| Diethylenetriaminepentaacetic Acid | 1.0 g |
| 1-Hydroxyethylidene-1,1-diphosphonic Acid | 3.0 |
| Sodium Sulfite | 4.0 |
| Potassium Carbonate | 30.0 g |
| Potassium Bromide | 1.4 g |
| Potassium Iodide | 1.5 mg |
| Hydroxylamine Sulfate | 2.4 g |
| 4-[N-Ethyl-N-β-hydroxyethylamino]-2-methylaniline Sulfate | 4.5 g |
| Water to make | 1.0 liter |
| | pH 10.05 |
| Bleach Solution: | |
| Ethylenediaminetetraacetic Acid Ferric Sodium Tri-hydrate | 100.0 g |
| Ethylenediaminetetraacetic Acid Di-sodium Salt | 10.0 g |
| Ammonium Bromide | 140.0 g |
| Ammonium Nitrate | 30.0 g |
| Aqueous Ammonia (27%) | 6.5 ml |
| Water to make | 1.0 liter |
| | pH 6.0 |
| Fix Solution: | |
| Ethylenediaminetetraacetic Acid Di-sodium Salt | 0.5 g |
| Sodium Sulfite | 7.0 g |
| Sodium Hydrogensulfite | 5.0 g |
| Aqueous Solution of Ammonium Thiosulfate (70%) | 170.0 ml |
| Water to make | 1.0 liter |
| | pH 6.7 |
| Stabilization Solution | |
| Formalin (37%) | 2.0 ml |
| Polyoxyethylene-p-monononylphenyl Ether (mean polymerization degree 10) | 0.3 g |
| Ethylenediaminetetraacetic Acid Di-sodium Salt | 0.05 g |
| Water to make | 1.0 liter |
| | pH 5.0 to 8.0 |

The compounds used for the samples were as follows.

UV-1

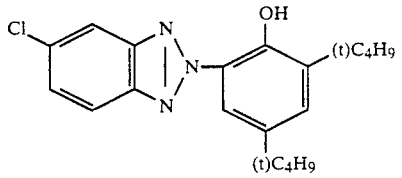

UV-2

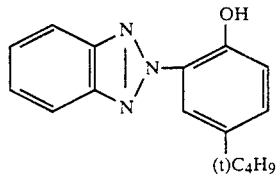

-continued
UV-3
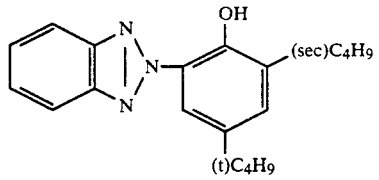
UV-4
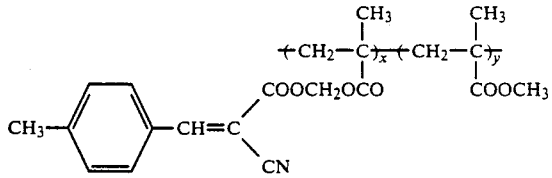
x/y = 7/3
(Weight Ratio)
UV-5
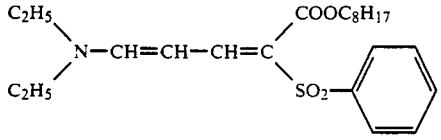
EX-1
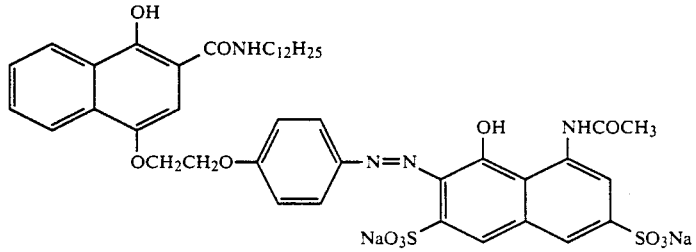
EX-2
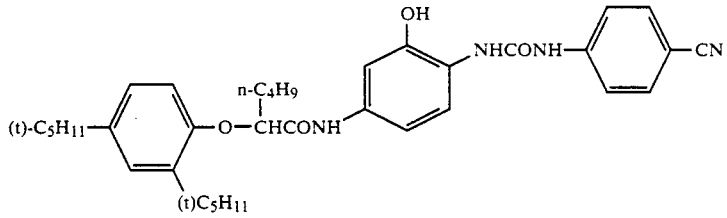
EX-3
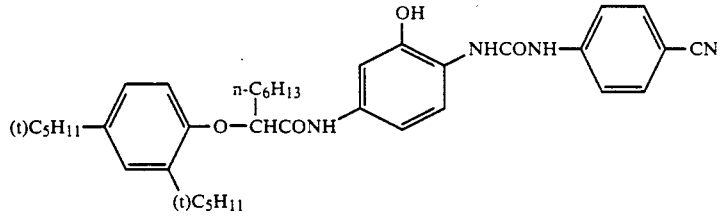
EX-4
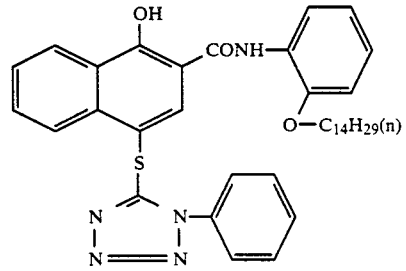

-continued
EX-5
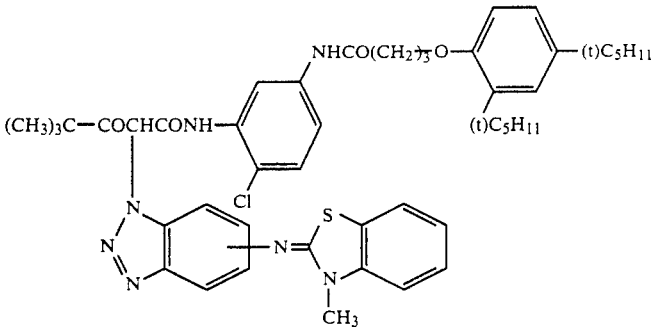
EX-6
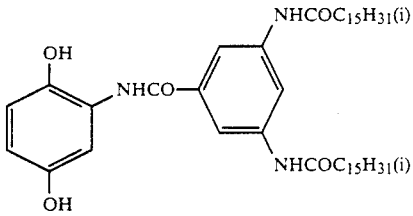
EX-7
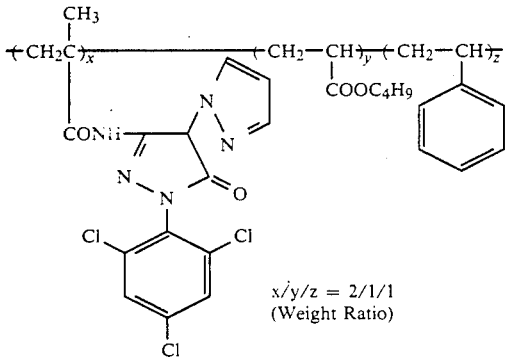
x/y/z = 2/1/1
(Weight Ratio)
EX-8
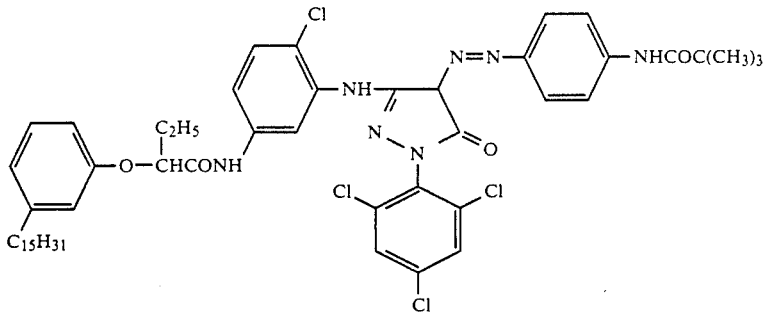
EX-9
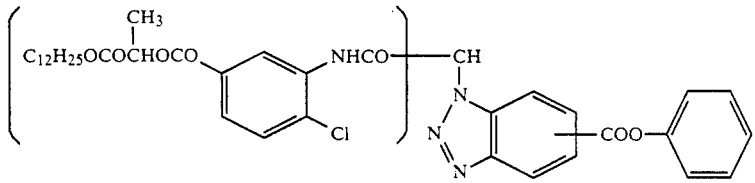

-continued
EX-10
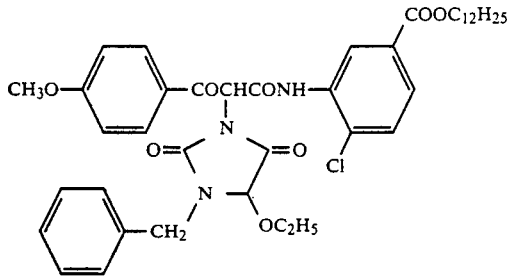
EX-11
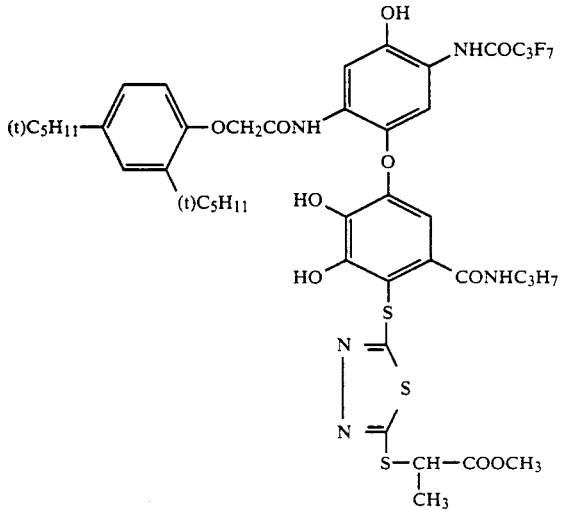
D-I
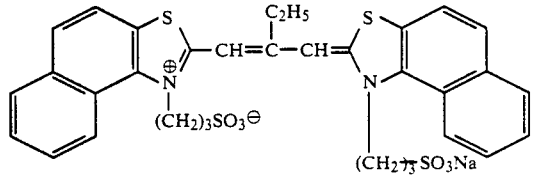
D-II
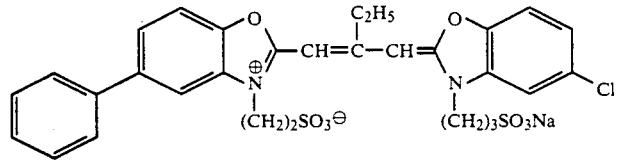
D-III
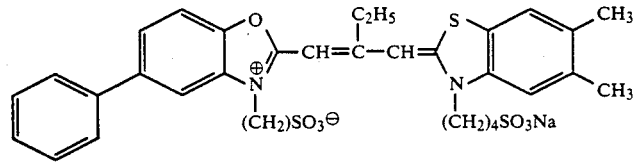
D-IV
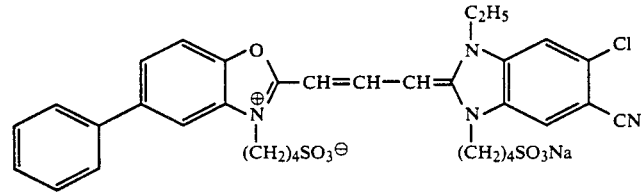
D-V
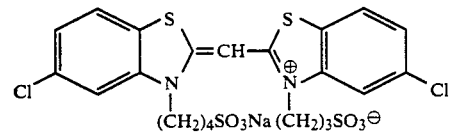

-continued

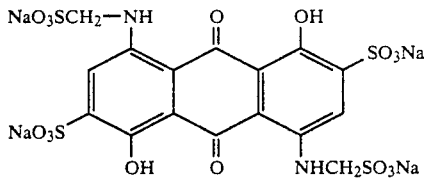

F-1

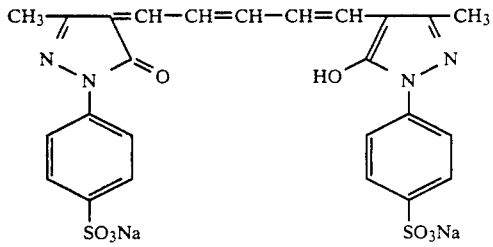

F-2

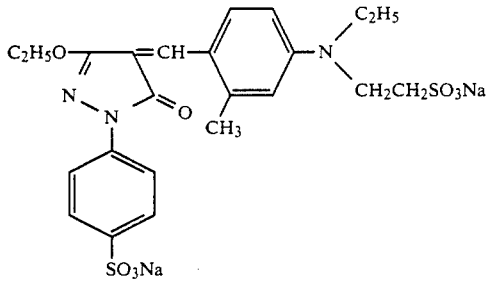

F-3

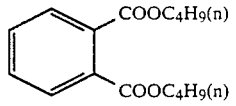

SOLV-1

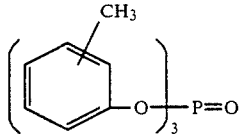

SOLV-2

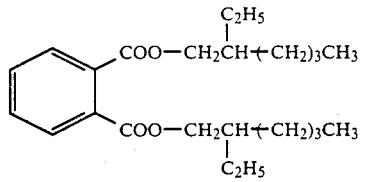

SOLV-3

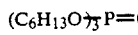

SOLV-4

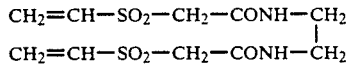

H-1

The pressure resisting characteristics were evaluated as in Example 10. The results are shown in Table 17.

TABLE 17

| Sensitivity and Pressure Resistance | | |
|---|---|---|
| Sample No. Emulsion | Sample 601 Em-6 (Comparison) | Sample 602 Em-7 (Invention) |
| Sensitivity (Green-Sensitive Layer) | 0 | +0.35 |
| Increase of Fog at Kinked Portion (Green-Sensitive Layer) | 0.20 | 0.10 |

As is clear from the results in Table 17, it can be seen that the emulsion of this invention has a high sensitivity and is excellent in pressure resistance.

The graininess was evaluated by the rms graininess measured by an aperture diameter of 48 μm (at the portion of a megenta optical density of fog +0.3). The rms graininess is described in T. H. James, *The Theory of the Photographic Process*, pages 619–620, published by Macmillan Co., 1977.

The results showed that the graininess of sample 602 of this invention was same as that of sample 601 in spite of the aforesaid sensitivity difference in Table 17.

EXAMPLE 16

Emulsion A (Comparison)

An aqueous solution of 20 g of inert gelatin, 17 g of potassium bromide, 12 g of potassium iodide and 40 ml of ammonia (25%) dissolved in 1 liter of distilled water was stirred in a reaction vessel at 60° C.

Then, 200 ml of an aqueous solution of 50 g of silver nitrate and 200 ml of an aqueous solution of 13 g of potassium bromide were simultaneously added thereto over a period of 2 minutes followed by ripening for 20 minutes and thereafter, 40 ml of acetic acid (100 wt. %) was added to the mixture. Then, 600 ml of an aqueous solution of 100 g of silver nitrate and 600 ml of an aqueous solution of 75 g of potassium bromide were added thereto while keeping pBr at 2.1 over a period of 60 minutes until the aqueous silver nitrate solution was consumed. Thereafter, the emulsion formed was cooled to 35° C., washed with water by an ordinary flocculation method, and after adjusting pH and pAg thereof to 6.2 and 9.0, respectively at 40° C., the emulsion was stored in the cold dark. The grain size was 0.75 μm as the circle-corresponding diameter of the projected area.

Emulsion B (Invention)

In the aforesaid procedure for Emulsion A, the procedure after the addition of acetic acid was performed as follows.

That is, 5.2 g of sodium chloride was added to the mixed and then 130 ml of an aqueous solution obtained by dissolving 100 g of silver nitrate in 600 ml of water was added thereto over a period of 13 minutes. Then, the aforesaid aqueous silver nitrate solution and 600 ml of an aqueous solution of 75 g of potassium bromide were added to the mixture while keeping pBr at 3.8 over a period of 27 minutes until 270 ml of the aqueous silver nitrate solution was consumed, and after adjusting pBr to 2.1, the remaining aqueous silver nitrate solution was added thereto while keeping the same pBr over a period of 20 minutes.

Thereafter, the same procedure as the aforesaid process was followed.

Emulsion C (Invention)

The emulsion C was prepared by following the same procedure as Emulsion B while growing the grains at pBr of 2.1 in place of growing at pBr of 3.8.

Emulsion D (Invention)

In the aforesaid process for Emulsion A, the procedure after the addition of acetic acid was performed as follows.

That is, 5.2 g of sodium chloride was added to the mixture and then 130 ml of an aqueous solution obtained by dissolving 100 g of silver nitrate in 600 ml of water was added thereto over a period of 13 minutes. Then, 120 ml of an aqueous solution obtained by dissolving 75 g of potassium bromide in 600 ml of water was added thereto over a period one minute followed by ripening for 15 minutes. Thereafter, the aforesaid remaining aqueous silver nitrate solution and the aforesaid remaining aqueous potassium bromide solution were added thereto over a period of 47 minutes while keeping pBr at 2.1 until the aqueous silver nitrate solution was consumed Thereafter, the same procedure as in the case of preparing Em-A was followed.

After adding dye I-11 to each of the emulsion Em A to D at $3.5\times10^{-4}$ mole per mole of silver, the emulsion was most suitably chemically sensitized by sodium thiosulfate, potassium chloroaurate, and potassium thiocyanate at 60° C.

In the case of preparing the emulsions Em B to D, the emulsion was sampled in the case of adding 72 g of silver nitrate and after removing gelatin by centrifugal separation, the silver halide grains were annealed at 300° C. for 3 hours. The analysis result of the sample by ESCA confirmed that sodium chloride added was almost all deposited as silver salt (more than 95% of the added amount) in all the samples. Also, the final silver halide grains were analyzed by the same manner as above to determine the content of chloride and the halogen conversion ratio was calculated.

Each emulsion thus chemically sensitized was coated on a cellulose triacetate support as follows.

| | |
|---|---|
| Emulsion Layer | |
| Emulsion: Em A to Em D | $2.1\times10^{-2}$ mole/m² as silver |
| Coupler shown below | $1.5\times10^{-3}$ mole/m² |

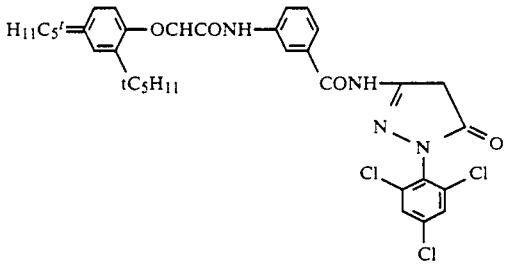

| | |
|---|---|
| Tricresyl Phosphate | 1.10 g/m² |
| Gelatin | 2.30 g/m² |
| Protective Layer | |
| 2,4-Dichlorotriazine-6-hydroxy-s-triazine Sodium Salt | 0.08 g/m² |
| Gelatin | 1.80 g/m² |

The coated samples were allowed to stand for 14 hours at 40° C. and 70% in relative humidity.

The pressure resistant characteristics were evaluated as follows.

The coated sample was fixed at an end with the emulsion layer inside under a relative humidity of 40% and bent along a stainless steel pipe of 10 mm in deiameter at 180° at a bending rate of 360°/sec. while rotating the pipe. The bending was performed 10 seconds before exposure or 10 seconds after exposure.

The sample was exposed through a continuous wedge for 1/100 second and processed as follows.

The density of each sample thus processed was measured using a green filter.

The processing steps were performed at 38° C.

| | |
|---|---|
| 1 Color Development | 2 min. 45 sec. |
| 2 Bleach | 6 min. 30 sec. |
| 3 Wash | 3 min. 15 sec. |

-continued

| | |
|---|---|
| 4 Fix | 6 min. 30 sec. |
| 5 Wash | 3 min. 15 sec. |
| 6 Stabilization | 3 min. 15 sec. |

The compositions of the processing solutions used above were as follows.

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline Sulfate | 4.5 g |
| Water to make | 1 liter |
| Bleach Solution: | |
| Ammonium Bromide | 160.0 g |
| Aqueous Ammonia (28%) | 25.0 ml |
| Ethylenediaminetetraacetic Acid Sodium Iron Salt | 130 g |
| Glacial Acetic Acid | 14 ml |
| Water to make | 1 liter |
| Fix Solution: | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 liter |
| Stabilization Solution: | |
| Formalin | 8.0 ml |
| Water to make | 1 liter |

Then, the sensitivity and fog were evaluated on the bent portion and unbent portion of each sample thus processed. The relative value of the reciprocal of the exposure amount required to give an optical density of fog +0.1 was shown as the sensitivity.

The results obtained are shown in Table 18.

TABLE 18

| Sample | Halogen conversion Ratio | Non-pressed Portion Fog | Non-pressed Portion Sensitivity | Pressed Portion: Pressing Before Exposure Fog | Pressed Portion: Pressing Before Exposure Sensitivity | Pressed Portion: Pressing After Exposure Fog | Pressed Portion: Pressing After Exposure Sensitivity |
|---|---|---|---|---|---|---|---|
| Em-A (Comparison) | AgCl not used | 0.12 | 100 | 0.24 | 90 | 0.24 | 98 |
| Em-B (Invention) | 12% | 0.12 | 108 | 0.22 | 88 | 0.22 | 97 |
| Em-C (Invention) | 40% | 0.12 | 108 | 0.18 | 85 | 0.18 | 93 |
| Em-D (Invention) | 60% | 0.12 | 108 | 0.16 | 77 | 0.16 | 88 |

From the results shown above, it can be seen that the occurence of pressure fog is reduced by performing the halogen conversion after depositing silver chloride in the inside of the grains. In particular, the formation of pressure fog is more reduced as the halogen conversion rate becomes higher as 40% and 60%.

EXAMPLE 17

Emulsion E (Comparison)

An aqueous solution of 20 g of inert gelatin, 17 g of potassium bromide, 12 g of potassium iodide, and 40 ml of ammonia (25%) dissolved in 1 liter of distilled water was stirred in a reaction vessel at 60° C.

To the solution were simultaneously added 200 ml of an aqueous solution of 50 g of silver nitrate and 200 ml of an aqueous solution of 13 g of potassium bromide over a period of 2 minutes followed by phisical ripening for 20 minutes and thereafter, 40 ml of acetic acid (100 wt. %) was added thereto. Then, 600 ml of an aqueous solution of 100 g of silver nitrate and 400 ml of an aqueous solution of 50 g of potassium bromide were added to the mixture over a period of 40 minutes while keeping pBr at 2.1 until 400 ml of the aqueous silver nitrate solution was consumed. Then, the remaining aqueous silver nitrate solution and 200 ml of an aqueous solution of 24 g of potassium bromide and 1 g of potassium iodide were added to the mixture while keeping pBr at 2.1 until the silver nitrate solution was consumed. Thereafter, the emulsion formed was cooled to 35° C., washed with water by an ordinary floccualtion method, and after adjusting pH and pAg thereof to 6.2 and 9.0, respectively at 40° C., the emulsion was stored in the cold dark.

Emulsion F (Invention)

In the aforesaid procedure for Emulsion E, the step after the addition of acetic acid was performed as follows.

That is, 5.2 g of sodium chloride was added to the mixture and then 130 ml of an aqeous solution obtained by dissolving 100 g of silver nitrate in 600 ml of water was added thereto over a period of 13 minutes. Then, the remaining aqueous silver nitrate solution and 400 ml of an aqueous solution of 50 g of potassium bromide were added to the mixture over a period of 27 minutes while keeping pBr at 2.1 until 270 ml of the silver nitrate solution was consumed. Thereafter, the remaining aqueous silver nitrate solution and 200 ml of an aqueous solution of 24 g of potassium bromide and 1 g of potassium iodide were added thereto at the same pBr as above over a period of 20 minutes until the silver nitrate solution was consumed. Then, the emulsion was treated as in Emulsion E.

Each of Emulsions E and F thus prepared was chemically sensitized and spectrally sensitized as in Example 16.

On Emulsion A in Example 16 and Emulsions E and F described above, the shrpness was measured The measurement of the shrpness was performed by the method described in *Journal of Applied Photographic Engineering*, Vol. 6(1), 1-8(1980). In this case, the photographic processing only was performed as in Example 16. The value of MTF was shown by the relative value in the case of defining that of Emulsion A as 100.

The pressure resisting characteristics were evaluated by the manner as in Example 16. The measurement of the surface iodine content was performed using ESCA.

The results obtained are shown in Table 19.

TABLE 19

| Sample | Surface Iodide Content | MTF | Non-pressed Portion Fog | Non-pressed Portion Sensitivity | Pressed Portion: Pressing Before Exposure Fog | Pressed Portion: Pressing Before Exposure Sensitivity | Pressed Portion: Pressing After Exposure Fog | Pressed Portion: Pressing After Exposure Sensitivity |
|---|---|---|---|---|---|---|---|---|
| Em-A (Comparison) | 2.5 | 100 | 0.12 | 100 | 0.24 | 90 | 0.24 | 98 |
| Em-E (Comparison) | 4.5 | 115 | 0.12 | 102 | 0.27 | 94 | 0.27 | 100 |
| Em-F (Invention) | 4.5 | 115 | 0.12 | 107 | 0.20 | 88 | 0.20 | 97 |

From the comparison of Em-A with Em-A, it can be seen that the sharpness was improved with the increase of the iodine content in the surface but the occurence of pressure fog was increased. On the other hand, by applying the halogen conversion to Em-E, the pressure resistance was also improved with the increase of the sharpness.

EXAMPLE 18

Emulsion G (Invention)

In the procedure for producing Emulsion A in Example 16, the step after the addition of acetic acid was perfromed as follows.

That is, 8.6 g of potassium thiocyanate was added to the mixture and the 130 ml of an aqueous solution obtained by dissolving 100 g of silver nitrate in 600 ml of water was added thereto over a period of 13 minutes. Then, the aforesaid remaining silver nitrate solution and 600 ml of an aqueous solution of 75 g of potassium bromide were added thereto over a period of 27 minutes while keeping pBr at 3.8 until 270 ml of the silver nitrate solution was consumed and after adjusting pBr to 2.1, the remaining silver nitrate solution was added thereto over a period of 20 minutes while keeping the same pBr. Then, the emulsion was treated as in Emulsion A.

The emulsion was chemically sensitized and spectrally sensitized by the manners shown in Example 16 and caoted on a support.

On the coated sample, the pressure resisting characteristics were evaluated by the manner as described in Example 16.

The results obtained are shown in Table 20.

TABLE 20

| Sample | | Non-pressed Portion Fog | Non-pressed Portion Sensitivity | Pressed Portion: Pressing Before Exposure Fog | Pressed Portion: Pressing Before Exposure Sensitivity | Pressed Portion: Pressing After Exposure Fog | Pressed Portion: Pressing After Exposure Sensitivity |
|---|---|---|---|---|---|---|---|
| Em-A (Comparison) | | 0.12 | 100 | 0.24 | 90 | 0.24 | 98 |
| Em-G (Invention) | Thiocyanate Used | 0.12 | 100 | 0.20 | 85 | 0.20 | 92 |

As shown in the above table, it can be seen that the pressure fog was also reduced in the case of the emulsion which was subjected to the halogen conversion after depositing the thicocyaante in the inside of the silver halide grains.

EXAMPLE 19

A multilayer color photographic material having the following layers on a cellulose triacetate film support having subbing layer was prepared.

In this case Em-A in Example 16 or Em-E or Em-F in Example 17 was used for Layer 7 (High-Speed Green-Sensitive Emuslion Layer). Thus, samples 101 to 103 were prepared.

In the following compositions, the coating amount was shown by g/m$^2$ unit as silver on silver halide emulsion and colloid silver, g/m$^2$ on additives and gelatin, and the mole number per mole of silver halide in the same layer on the sensitizing dye.

| | |
|---|---|
| Layer 1 Antihalation Layer | |
| Black Colloid Silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Layer 2 Interlayer | |
| Gelatin | 1.0 |
| UV-1 | 0.03 |
| ExC-1 | 0.02 |
| ExF-4 | 0.004 |
| Solv-1 | 0.1 |
| Solv-2 | 0.1 |
| Layer 3 Low-Speed Red-Sensitive Emulsion Layer | |
| Silver Iodobromide Emulsion (AgI 4 mole %, uniform AgI type, sphere-corresponding diameter 0.5 μm, coeff. of variation of sphere-corresponding diameters 20%, tabular grains, aspect ratio 3.0) | 1.2 |
| Silver Iodobromide Emulsion (AgI 3 mole %, uniform AgI-type, sphere-corresponding diameter 0.3 μm, coeff. of variation of sphere-corresponding diameters 15%, spherical grains, aspect ratio 1.0) | 0.6 |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| Layer 4 High-Speed Red-Sensitive Emulsion Layer | |
| Silver Iodobromide Emulsion (AgI 6 mole %, inside high-AgI type having core/shell ratio of 1:1, sphere-corresponding diameter 0.7 μm, coeff. of variation of sphere-corresponding diameters 15%, tabular grains, aspect ratio 5.0) | 0.7 |
| Gelatin | 1.0 |
| ExS-1 | $3 \times 10^{-4}$ |
| ExS-2 | $2.3 \times 10^{-5}$ |

-continued

| | |
|---|---|
| ExC-6 | 0.11 |
| ExC-7 | 0.05 |
| ExC-4 | 0.05 |
| Solv-1 | 0.05 |
| Solv-3 | 0.05 |
| Layer 5 Interlayer | |
| Gelatin | 0.5 |
| Cpd-1 | 0.1 |
| Solv-1 | 0.05 |
| Layer 6 Low-Speed Green-Sensitive Emulsion Layer | |
| Silver Iodobromide Emulsion (AgI 4 mole %, surface high-AgI type of core/shell ratio of 1:1, sphere-corresponding diameter 0.5 μm, coeff. of variation of sphere-corresponding diameters, tabular grains, aspect ratio 4.0) | 0.35 |
| Silver Iodobromide Emulsion (AgI 3 mole %, uniform AgI type, sphere-corresponding diameter 0.3 μm, coeff. of variation of sphere-corresponding diameters 25%, spherical grains, aspect ratio 1.0) | 0.20 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Layer 7 High-Speed Green-Sensitive Emulsion Layer | |
| Silver Iodobromide Emulsion (Em-A in Example 16 or Em-E or F in Example 17) | 0.8 |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Layer 8 Interlayer | |
| Gelatin | 0.5 |
| Cpd-1 | 0.05 |
| Solv-1 | 0.02 |
| Layer 9 Donner Layer of Double Layer Effect for Red-Sensitive Layer | |
| Silver Iodobromide Emulsion (AgI 2 mole %, inside high-AgI type of core/shell ratio of 2:1, sphere-corresponding diameter 1.0 μm, coeff. of variation of sphere-corresponding diameters 15%, tabular grains, aspect ratio 6.0) | 0.35 |
| Silver Iodobromide Emulsion (AgI 2 mole %, inside high-AgI type of core/shell ratio of 1:1, sphere-corresponding diameter 0.4 μm, coeff. of variation of sphere-corresponding diameters 20%, tabular grains, aspect ratio 6.0) | 0.20 |
| Gelatin | 0.5 |

-continued

| | |
|---|---|
| ExS-3 | $8 \times 10^{-4}$ |
| ExY-13 | 0.11 |
| ExM-12 | 0.03 |
| ExM-14 | 0.10 |
| Solv-1 | 0.20 |
| Layer 10 Yellow Filter Layer | |
| Yellow Colloid Silver | 0.05 |
| Gelatin | 0.5 |
| Cpd-2 | 0.13 |
| Solv-1 | 0.13 |
| Cpd-1 | 0.10 |
| Layer 11 Low-Speed Blue-Sensitive Emulsion Layer | |
| Silver Iodobromide Emulsion (AgI 4.5 mole %, uniform AgI type, sphere-corresponding diameter 0.7 μm, coeff. of variation of sphere-corresponding diameters 15%, tabular grains, aspect ratio 7.0) | 0.3 |
| Silver Iodobromide Emulsion (AgI 3 mole %, uniform AgI type, sphere-corresponding diameter 0.3 μm, coeff. of variation of sphere-corresponding diameters 25%, tabular grains, aspect ratio 7.0) | 0.15 |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Layer 12 High-Speed Blue-Sensitive Emulsion Layer | |
| Silver Iodobromide Emulsion (AgI 10 mole %, inside high-AgI type, sphere-corresponding diameter 1.0 μm, coeff. of variation of sphere-corresponding diameters 25%, multiple twin tabular grains, aspect ratio 2.0) | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| Layer 13 1st Protective Layer | |
| Gelatin | 0.8 |
| UV-4 | 0.1 |
| UV-5 | 0.15 |
| Solv-1 | 0.01 |
| Solv-2 | 0.01 |
| Layer 14 2nd Protective Layer | |
| Fine Grain Silver Iodobromide Emulsion (AgI 2 mole %, uniform AgI type, sphere-corresponding diameter, sphere-corresponding diameter 0.07 μm) | 0.5 |
| Gelatin | 0.45 |
| Polymethyl Methacrylate Particles (diameter 1.5 μm) | 0.2 |
| H-1 | 0.4 |
| Cpd-5 | 0.5 |
| Cpd-6 | 0.5 |

Each layer further contained a stabilizer Cpd-3 (0.04 g/m$^2$) and a surface active agent Cpd-4 (0.02 g/m$^2$) as a coating aid.

The compounds used for the aforesaid samples were as follows.

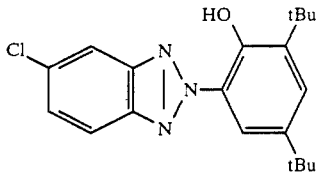

UV-1

-continued
UV-2
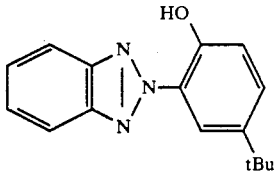
UV-3
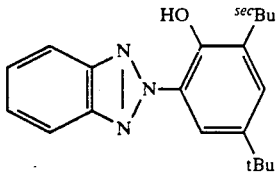
UV-4
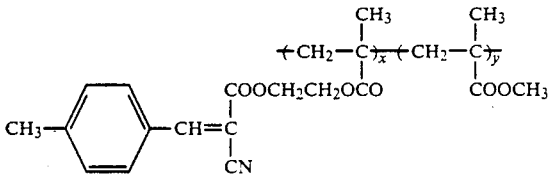
(x/y = 7/3 (weight ratio))
UV-5
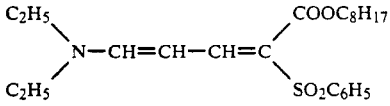
Tricresyl Phosphate — Solv-1
Dibutyl Phthalate — Solv-2
Solv-3
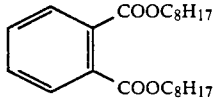
Solv-4
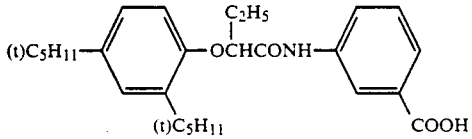
Cpd-1
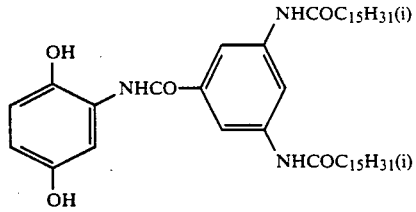
Cpd-2
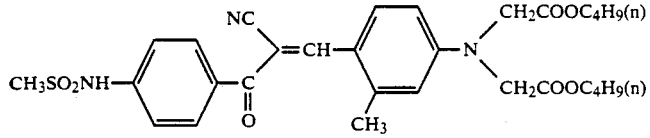
Cpd-3
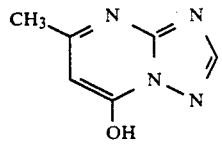

-continued
Cpd-4
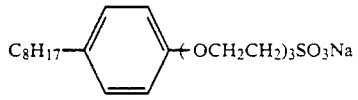
Cpd-5
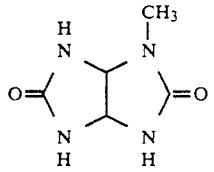
Cpd-6
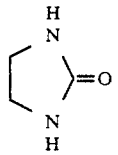
ExC-1
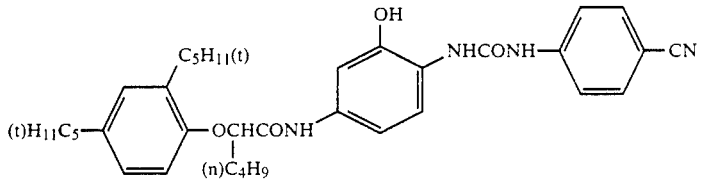
ExC-2
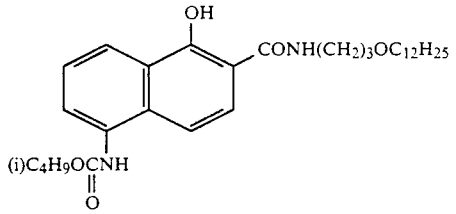
ExC-3
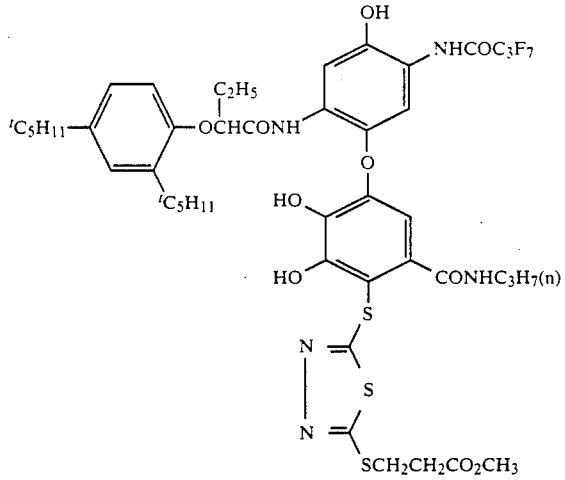
ExC-4
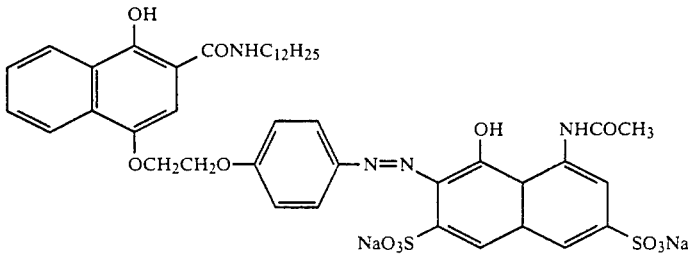

-continued
ExC-5
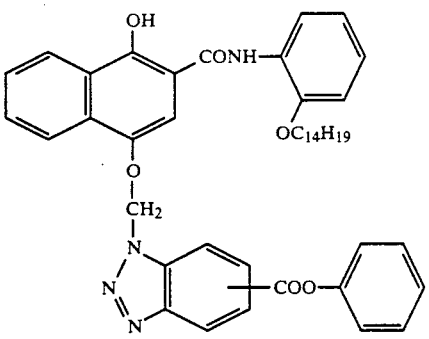
ExC-6
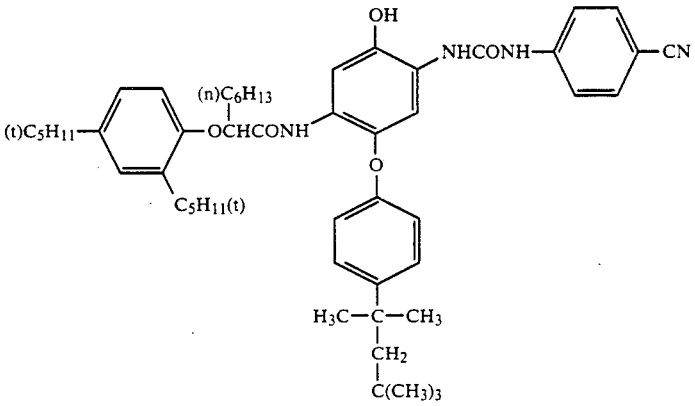
ExC-7
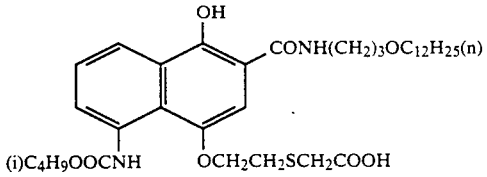
ExM-8
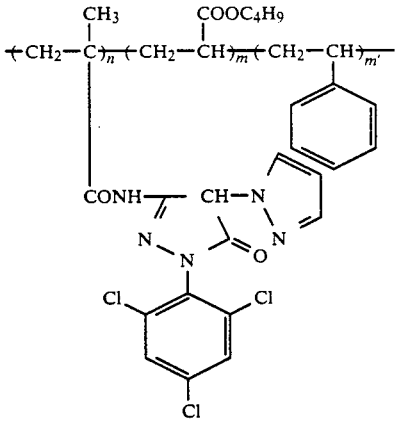
n = 50
m = 25
m' = 25
mol. wt. about 20,000

-continued
ExM-9
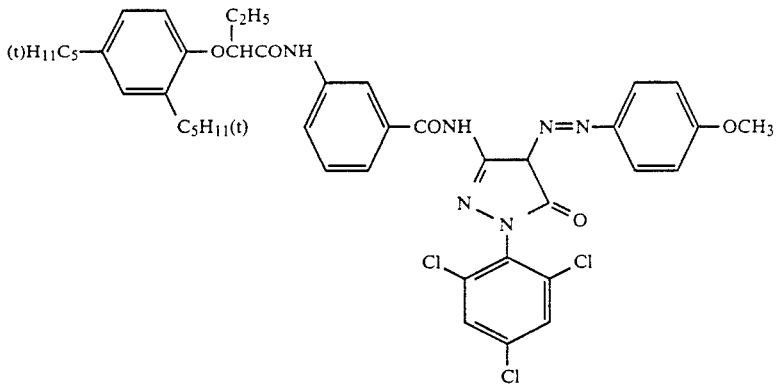
ExM-10
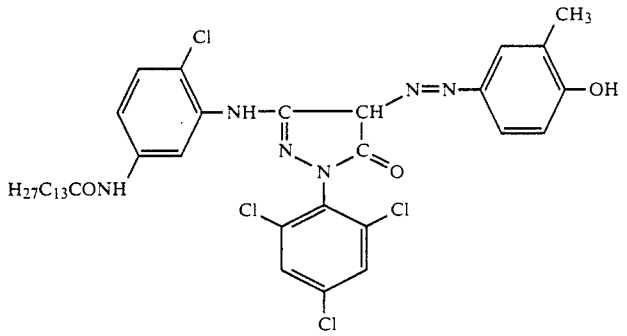
ExY-11
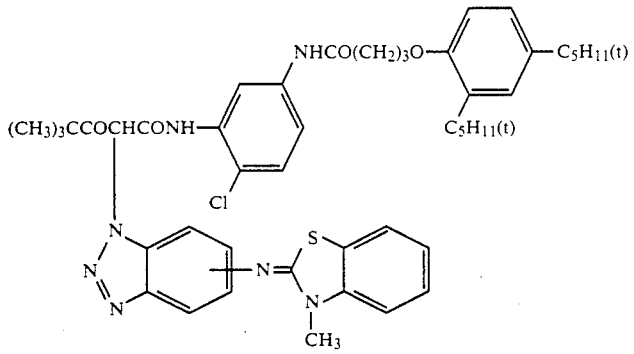
ExM-12
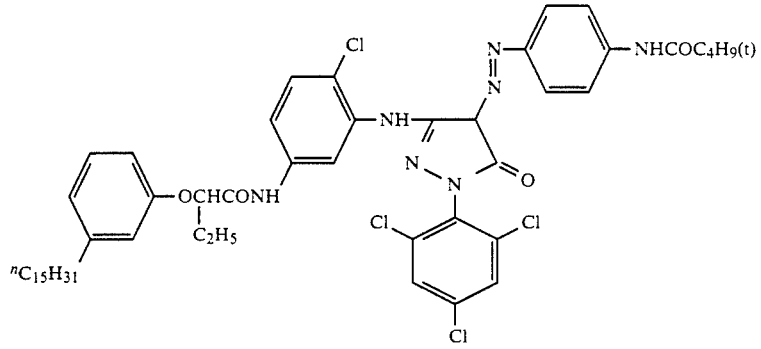

-continued
ExY-13
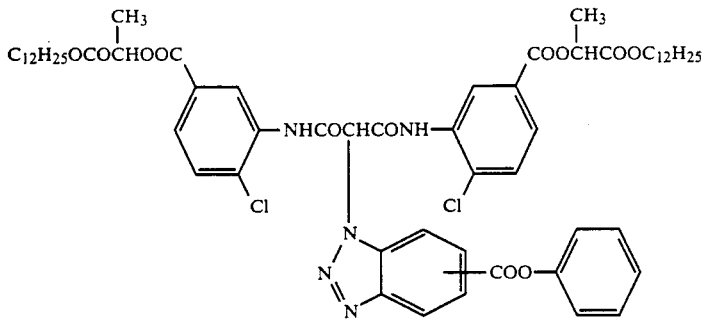
ExM-14
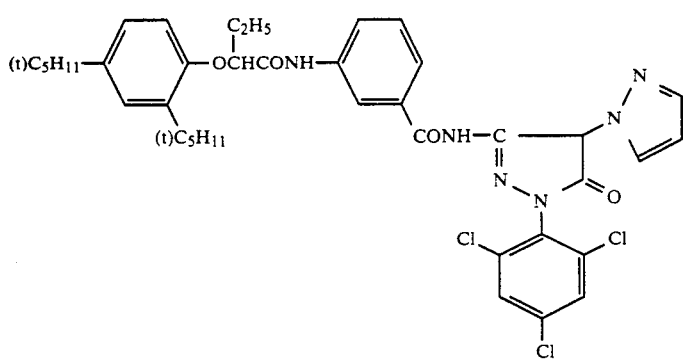
ExY-15
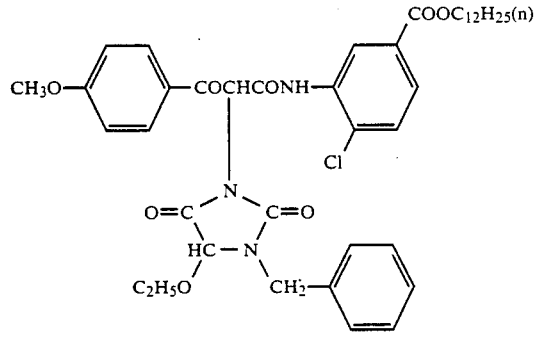
ExC-16
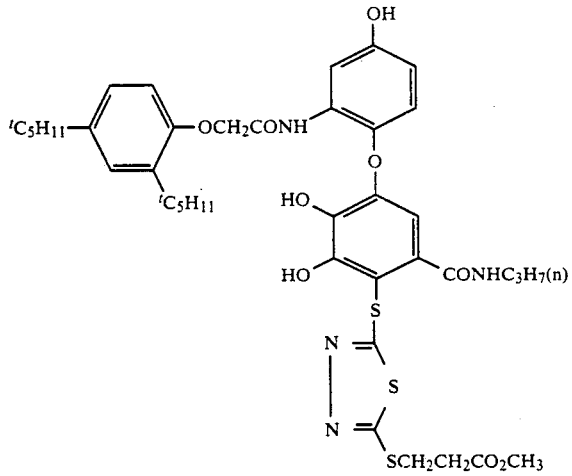
ExS-1
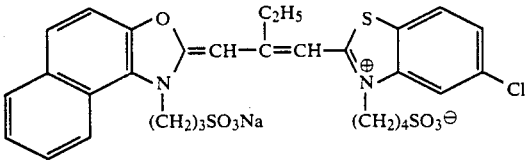

-continued

ExS-2

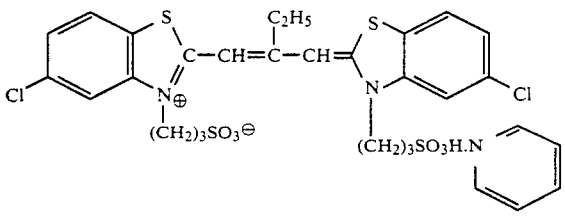

ExS-3

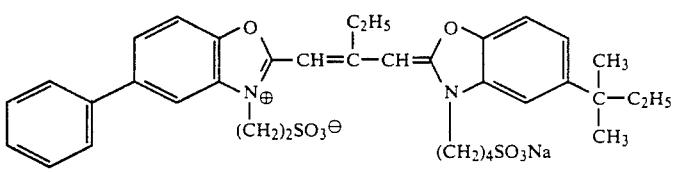

ExS-4

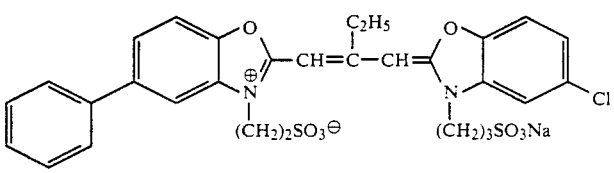

ExS-5

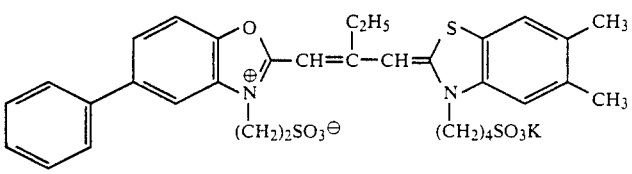

ExS-6

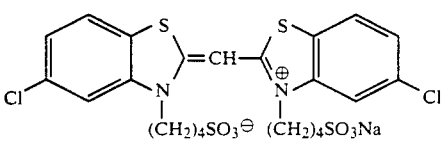

H-1

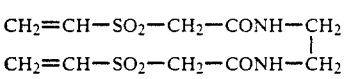

FxF-1

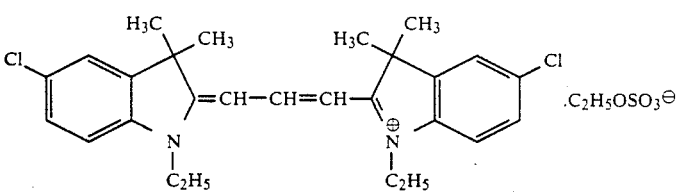

Each of the samples 101 to 103 was exposed to white light for 1/100 second at 10 CMS and processed as in Example 16. Then, the magenta color density was measured and the sensitivity relation by the exposure amount giving a density of fog +0.2 was determined. The relative values with that of sample 101 being defined as 100 were shown in Table 20.

The pressure resisting characteristics were evaluated as follows.

The emulsion layer of each sample was scratched by a metal styrus of 0.1 mm in diameter at a speed of 10 cm/min. while applying a load of 20 g on the styrus under a relative humidity of 40%. In addition, the scratching step was performed before exposure. Furthermore, a bending test as in Example 16 was also performed. The change of the magenta density at the fogged portion in the bending test was measured by a micro densitometer.

The sharpness was evaluated according to the method in Example 17.

The results obtained are shown in Table 21.

TABLE 21

| Sample | Emulsion for Layer 7 | Sensitivity | Sharpness | Change of Fog by Metal Stylus | Change of Fog by Bending |
|---|---|---|---|---|---|
| 101 (Comparison) | Em-A | 100 | 100 | 0.20 | 0.08 |
| 102 (Comparison) | Em-E | 103 | 112 | 0.31 | 0.16 |
| 103 | Em-F | 104 | 111 | 0.12 | 0.05 |

TABLE 21-continued

| Sample | Emulsion for Layer 7 | Sensitivity | Sharpness | Change of Fog by Metal Stylus | Change of Fog by Bending |
|---|---|---|---|---|---|
| (Invention) | | | | | |

As is clear from the above results, it can be seen that by using the emulsion of this invention, a photographic material having a high shrpness and excellent pressure resistance can be obtained.

EXAMPLE 20

A multilayer color photographic material having the following layers on a cellulose triacetate film support having subbing layer was prepared. In this case, Em-A or Em-D in Example 16 was used for Layer 3 (1st Red-Sensitive Emulsion Layer). Thus, samples 201 and 202 were prepared.

| | |
|---|---|
| Layer 1 Antihalation Layer | |
| Black Colloid Silver | 0.18 |
| Gelatin | 0.40 |
| Layer 2 Interlayer | |
| 2,5-Di-t-pentadecylhydroquinone | 0.18 |
| Ex-1 | 0.07 |
| Ex-3 | 0.02 |
| U-1 | 0.08 |
| U-2 | 0.08 |
| HBS-1 | 0.10 |
| HBS-2 | 0.02 |
| Gelatin | 1.04 |
| Layer 3 1st Red-Sensitive Emulsion Layer | |
| Silver Iodobromide Emulsion (Em-A or Em-D in Example 16) | 0.55 as Ag |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| Ex-2 | 0.350 |
| HBS-1 | 0.005 |
| Ex-11 | 0.008 |
| Gelatin | 1.20 |
| Layer 4 2nd Red-Sensitive Emulsion Layer | |
| Silver Iodobromide Emulsion (AgI 8 mole %, mean grain size 0.85 μm) | 1.20 as Ag |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.300 |
| EX-3 | 0.050 |
| Ex-10 | 0.004 |
| HBS-2 | 0.050 |
| Gelatin | 1.30 |
| Layer 5 3rd Red-Sensitive Emulsion Layer | |
| Silver Iodobromide Emulsion (AgI 14 mole %, mean grain size 1.5 μm) | 1.60 as Ag |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-5 | 0.150 |
| EX-3 | 0.055 |
| EX-4 | 0.060 |
| EX-11 | 0.005 |
| HBS-1 | 0.32 |
| Gelatin | 1.63 |
| Layer 6 Interlayer | |
| Gelatin | 1.06 |
| Layer 7 1st Green-Sensitive Emulsion Layer | |
| Silver Iodobromide Emulsion (AgI 6 mole %, mean grain size 0.6 μm) | 0.40 as Ag |
| Sensitizing Dye V | $2.5 \times 10^{-5}$ |
| Sensitizing Dye VI | $8.0 \times 10^{-5}$ |
| Sensitizing Dye VII | $3.0 \times 10^{-4}$ |
| EX-6 | 0.260 |

-continued

| | |
|---|---|
| EX-1 | 0.021 |
| EX-7 | 0.030 |
| EX-8 | 0.025 |
| HBS-1 | 0.100 |
| Gelatin | 0.75 |
| Layer 8 2nd Green-Sensitive Emulsion Layer | |
| Silver Iodobromide Emulsion (AgI 9 mole %, mean grain size 0.85 μm) | 0.80 as Ag |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.150 |
| EX-8 | 0.010 |
| EX-1 | 0.008 |
| EX-7 | 0.012 |
| HBS-1 | 0.60 |
| Gelatin | 1.10 |
| Layer 9 3rd Green-Sensitive Emulsion Layer | |
| Silver Iodobromide Emulsion (AgI 12 mole %, mean grain size 1.3 μm) | 1.2 as Ag |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-1 | 0.025 |
| HBS-2 | 0.55 |
| Gelatin | 1.74 |
| Layer 10 Yellow Filter Layer | |
| Yellow Colloid Silver | 0.05 as Ag |
| 2.5-Di-t-pentadecylhydroquinone | 0.03 |
| Gelatin | 0.95 |
| Layer 11 1st Blue-Sensitive Emulsion Layer | |
| Silver Iodobromide Emulsion (AgI 8 mole %, mean grain size 0.8 μm) | 0.24 as Ag |
| Sensitizing Dye VIII | $0.5 \times 10^{-4}$ |
| EX-9 | 0.85 |
| EX-8 | 0.12 |
| HBS-1 | 0.28 |
| Gelatin | 1.28 |
| Layer 12 2nd Blue-Sensitive Emulsion Layer | |
| Silver Iodobromide Emulsion (AgI 10 mole %, mean grain size 1.0 μm) | 0.45 as Ag |
| Sensitizing Dye VIII | $2.1 \times 10^{-4}$ |
| EX-9 | 0.20 |
| HBS-1 | 0.03 |
| Gelatin | 0.46 |
| Layer 13 3rd Blue-Sensitive Emulsion Layer | |
| Silver Iodobromide Emulsion (AgI 10 mole %, mean grain size 1.8 μm) | 0.77 as Ag |
| Sensitizing Dye VIII | $2.2 \times 10^{-4}$ |
| EX-9 | 0.20 |
| HBS-1 | 0.07 |
| Gelatin | 0.69 |
| Layer 14 1st Protective Layer | |
| Silver iodobromide Emulsion (AgI 1 mole %, mean grain size 0.07 μm) | 0.5 as Ag |
| U-1 | 0.11 |
| U-2 | 0.17 |
| HBS-1 | 0.90 |
| Gelatin | 1.00 |
| Layer 15 2nd Protective Layer | |
| Polymethyl Acrylate Particles (diameter 1.5 μm) | 0.54 |
| S-1 | 0.05 |
| S-2 | 0.20 |
| Gelatin | 0.72 |

Each layer further contained a gelatin hardener H-1 and a surface active agent.

The compounds used for the aforesaid samples were as follows.

U-1
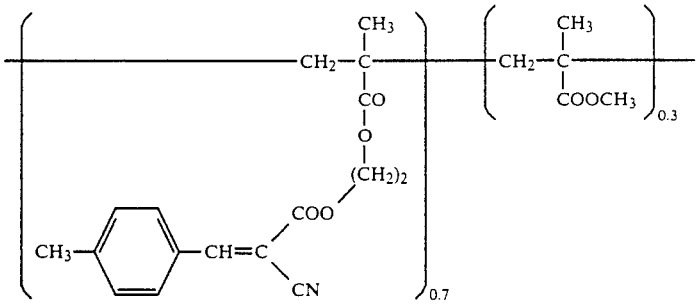
U-2
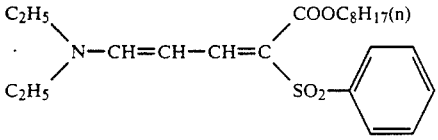
EX-1
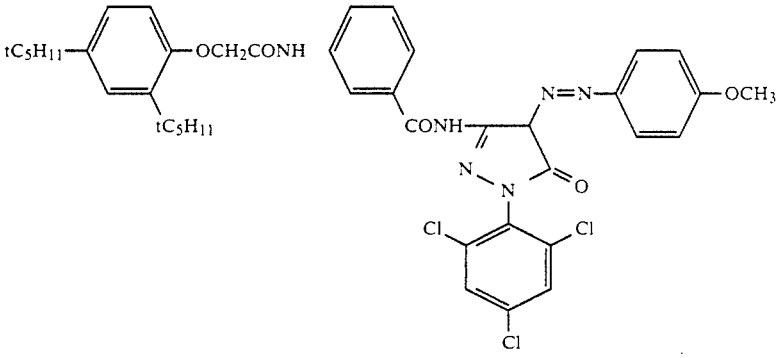
EX-2
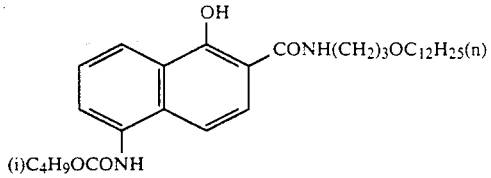
EX-3
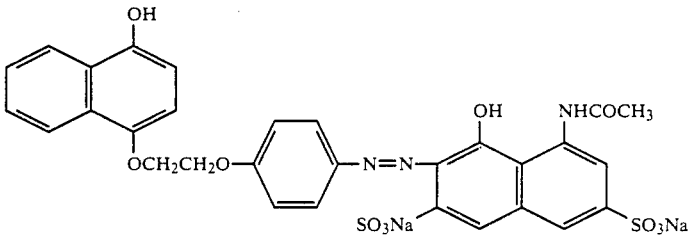
EX-4
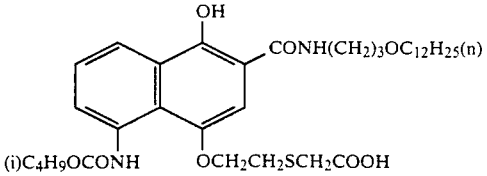

-continued
EX-5
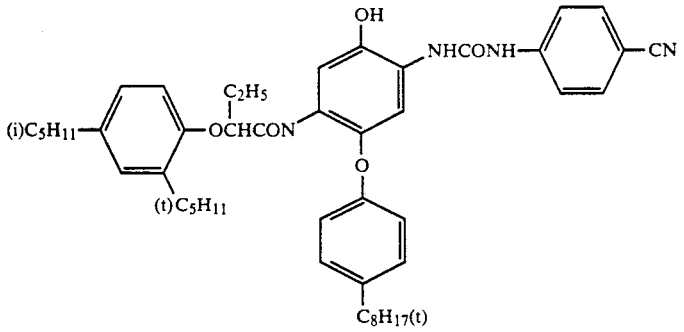
EX-6
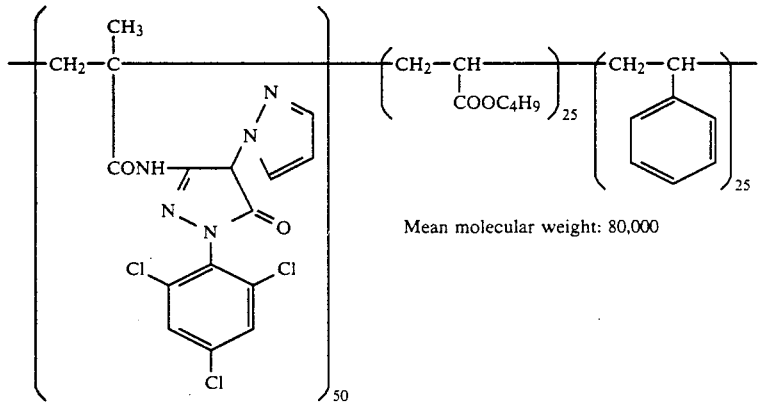
Mean molecular weight: 80,000
EX-7
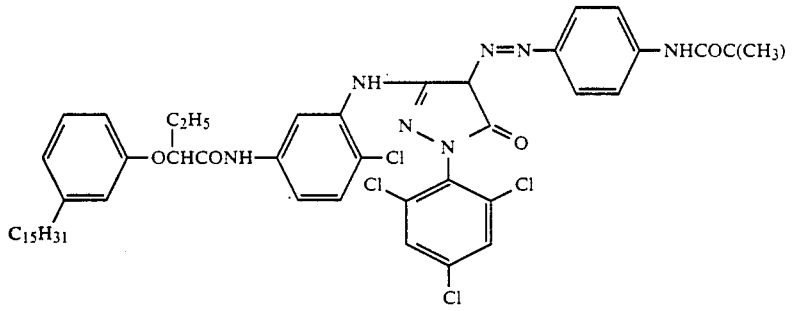
EX-8
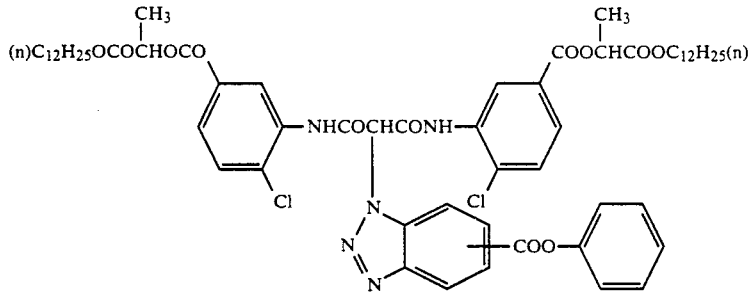
EX-9
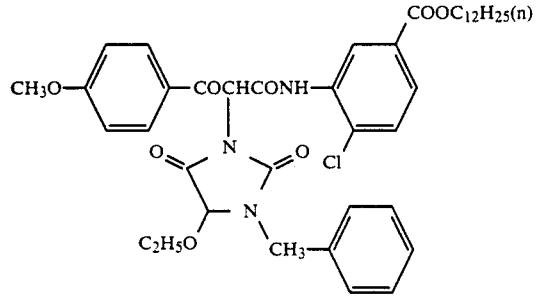

-continued
EX-10
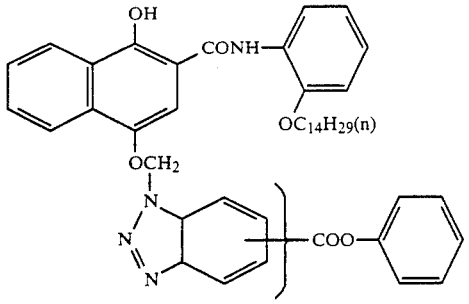
EX-11
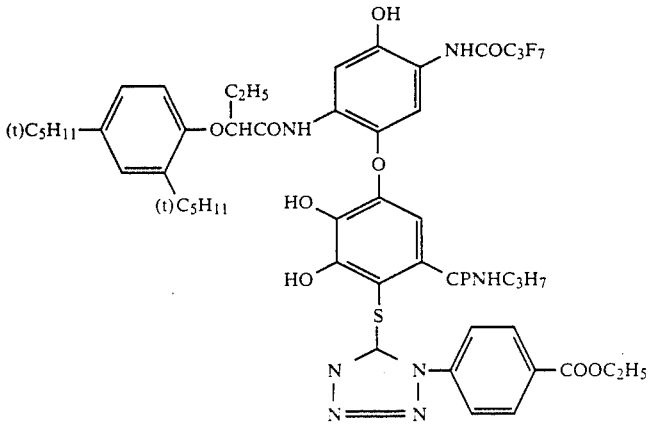
Tricresyl Phosphate HBS-1
Dibutyl Phthalate HBS-2
H-1
$CH_2{=}CH{-}SO_2{-}CH_2CONH{-}CH_2$
$CH_2{=}CH{-}SO_2{-}CH_2CONH{-}CH_2$
Sensitizing Dye
I
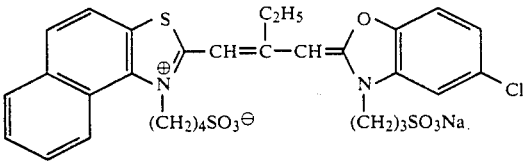
II
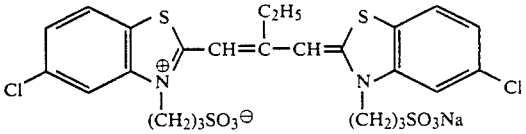
III
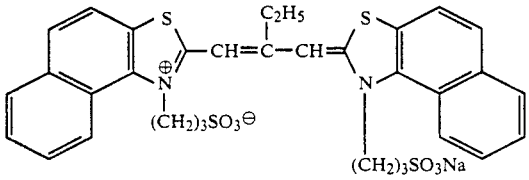

-continued

Sensitizing Dye

S-1

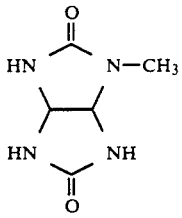

S-2

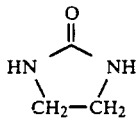

IV

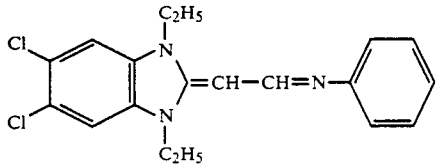

V

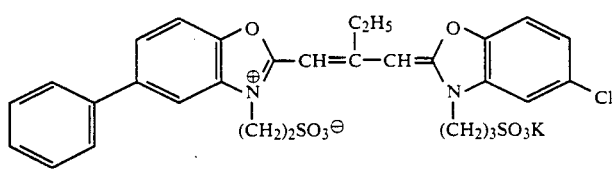

VI

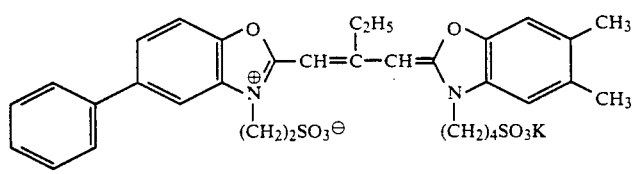

VII

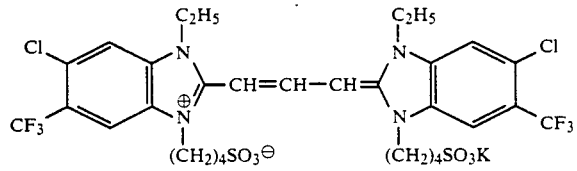

VIII

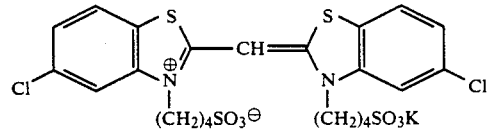

IX

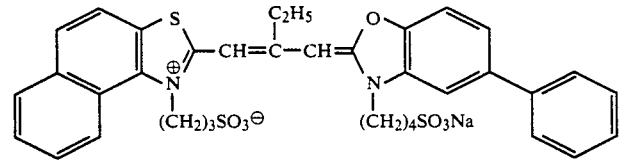

Allowing to stand each sample for 14 hours at 40° C. and 70% in relative humidity, the sample was fixed at an end with the emulsion layer inside and bent along a stainless steel pipe of 10 mm in diameter at 180°. Thereafter, the change in fog density at the bent portion on cyan images was measured.

The results obtained are shown in Table 22.

TABLE 22

| Comparison of Fog Density Change at Bent Portion | | |
|---|---|---|
| Sample | Emulsion | Change of Fog Density at Bent Portion |
| Sample 201 (Comparison) | Em-A | 0.20 |
| Sample 202 | Em-D | 0.14 |

TABLE 22-continued

| Comparison of Fog Density Change at Bent Portion | | |
|---|---|---|
| Sample | Emulsion | Change of Fog Density at Bent Portion |
| (Invention) | | |

From the result shown above, the formation of pressure fog was reduced by the use of the emulsion of this invention.

EXAMPLE 21

A multilayer color photographic material having the following layers on a cellulose acetate film support having subbing layer was prepared In this case Em-A or Em-D in Example 16 was used for Layer 11 (2nd Blue-Sensitive Emulsion Layer). Thus, samples 301 and 302 were prepared.

In the following compositions the coating amount was shown by g/m$^2$ unit as silver on silver halide emulsion and colloid silver, g/m$^2$ unit as couplers, additives and gelatin, and the mole number per mole of silver halide in the same layer on the sensitizing dye.

| | |
|---|---|
| Layer 1 Antihalation Layer | |
| Black Colloid Silver | 0.37 |
| U-1 | 0.027 |
| U-2 | 0.055 |
| U-3 | 0.064 |
| HBS-3 | 0.076 |
| Gelatin | 2.81 |
| Layer 2 Interlayer | |
| U-1 | 0.027 |
| U-2 | 0.054 |
| U-3 | 0.063 |
| HBS-3 | 0.076 |
| Gelatin | 1.52 |
| Layer 3 1st Red-Sensitive Emulsion Layer | |
| Silver Iodobromide Emulsion (AgI 10 mole %, sphere-corresponding diameter 0.9 μm, coeff. of variation 28.8%, aspect ratio 5.1) | 0.43 |
| Silver Iodobromide Emulsion (AgI 4 mole %, sphere-corresponding diameter 0.6 μm, coeff. of variation 36.6%, aspect ratio 3.4) | 0.11 |
| Silver Iodobromide Emulsion (AgI 2 mole %, sphere-corresponding diameter 0.45 μm, coeff. of variation 28%, aspect ratio 2.7) | 0.55 |
| Sensitizing Dye I | $4.7 \times 10^{-3}$ |
| C-1 | 0.14 |
| C-2 | 0.15 |
| C-3 | 0.08 |
| C-5 | 0.08 |
| HBS-1 | 0.06 |
| HBS-2 | 0.13 |
| C-10 | 0.14 |
| Gelatin | 1.66 |
| Layer 4 2nd Red-Sensitive Emulsion Layer | |
| Silver Iodobromide Emulsion (AgI 3.5 mole %, sphere-corresponding diameter 0.35 μm, coeff. of variation 10.6%, aspect ratio 1.0) | 0.73 |
| Sensitizing Dye I | $4.0 \times 10^{-3}$ |
| C-1 | 0.27 |
| C-2 | 0.28 |
| C-3 | 0.07 |
| C-4 | 0.11 |
| HBS-1 | 0.12 |
| HBS-2 | 0.24 |
| C-10 | 0.007 |
| Gelatin | 2.34 |
| Layer 5 Interlayer | |
| Gelatin | 0.92 |

-continued

| | |
|---|---|
| Cpd-1 | 0.10 |
| HBS-1 | 0.053 |
| Dye I | 0.075 |
| U-4 | 0.023 |
| U-5 | 0.036 |
| HBS-4 | $7.7 \times 10^{-3}$ |
| Layer 6 1st Green-Sensitive Emulsion Layer | |
| Silver Iodobromide Emulsion (AgI 3.5 mole %, sphere-corresponding diameter 0.35 μm, coeff. of variation 10.6%, aspect ratio 1.0) | 0.48 |
| Sensitizing Dye II | $3.6 \times 10^{-3}$ |
| Sensitizing Dye III | $1.7 \times 10^{-3}$ |
| C-6 | 0.33 |
| C-7 | 0.077 |
| HBS-1 | 0.29 |
| Gelatin | 1.13 |
| Layer 7 2nd Green-Sensitive Emulsion Layer | |
| Silver Iodobromide Emulsion (AgI 10 mole %, sphere-corresponding diameter 0.9 μm, coeff. of variation 28.8%, aspect ratio 5.1) | 0.21 |
| Silver Iodobromide Emulsion (AgI 4 mole %, sphere-corresponding diameter 0.6 μm, coeff. of variation 36.6%, aspect ratio 3.4) | 0.24 |
| Silver Iodobromide Emulsion (AgI 2 mole %, sphere-corresponding diameter 0.45 μm, coeff. of variation 28%, aspect ratio 2.7) | 0.24 |
| Sensitizing Dye II | $2.2 \times 10^{-3}$ |
| Sensitizing Dye III | $1.0 \times 10^{-3}$ |
| C-6 | 0.20 |
| C-8 | 0.071 |
| C-4 | 0.079 |
| C-5 | 0.038 |
| HBS-1 | 0.18 |
| Gelatin | 0.79 |
| Layer 8 3rd Green-Sensitive Emulsion Layer | |
| Silver Iodobromide Emulsion (AgI 10 mole %, sphere-corresponding diameter 1.2 μm, coeff. of variation 29.4%, aspect ratio 6.3) | 0.44 |
| Sensitizing Dye II | $5.6 \times 10^{-4}$ |
| Sensitizing Dye III | $2.1 \times 10^{-4}$ |
| Sensitizing Dye IV | $3.6 \times 10^{-5}$ |
| C-6 | 0.036 |
| C-5 | 0.020 |
| HBS-1 | 0.032 |
| Gelatin | 0.34 |
| Layer 9 Yellow Filter Layer | |
| Yellow Colloid Silver | 0.11 |
| Cpd-1 | 0.28 |
| HBS-1 | 0.15 |
| Gelatin | 1.19 |
| Layer 10 1st Blue-Sensitive Emulsion Layer | |
| Silver Iodobromide Emulsion (AgI 1 mole %, sphere-corresponding diameter 0.45 μm, coeff. of variation 20.1%, aspect ratio 1.8) | 0.33 |
| Sensitizing Dye V | $1.7 \times 10^{-3}$ |
| C-9 | 0.65 |
| C-11 | 0.10 |
| HBS-1 | 0.22 |
| Gelatin | 0.85 |
| Layer 11 2nd Blue-Sensitive Emulsion Layer | |
| Silver Iodobromide Emulsion containing Sensitizing Dye V at $3.0 \times 10^{-3}$ (AgI 4.1 mole %, sphere-corresponding diameter 0.43 μm, coeff. of variation 25%, aspect ratio 3.6) | 0.17 |
| Silver Iodochloro-bromide Emulsion (Em-A or Em-D) | 0.21 |
| Sensitizing Dye V | $4 \times 10^{-4}$ |
| C-9 | 0.28 |
| C-4 | 0.044 |
| HBS-1 | 0.10 |
| Gelatin | 0.75 |
| Layer 12 1st Protective Layer | |
| Gelatin | 0.60 |

-continued
| | |
|---|---|
| U-4 | 0.10 |
| U-5 | 0.15 |
| HBS-4 | 0.033 |
| Dye II | 0.15 |
| Layer 13 2nd Protective Layer | |
| Polymethyl Methacrylate Particles (diameter about 1.5 μm) | 0.14 |
| Gelatin | 0.87 |
Each layer further contained a gelatin hardener H-1 and a surface active agent. The compounds used for the afroesaid samples were as follows.
Sensitizing Dye
I
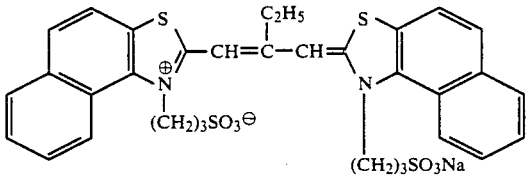
II
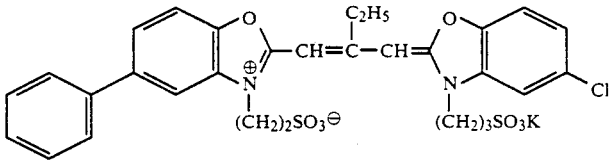
III
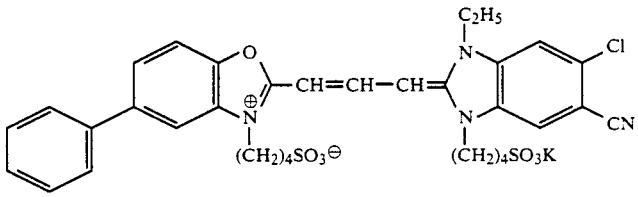
IV
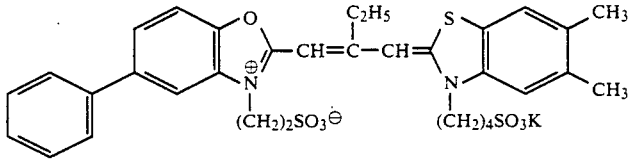
V
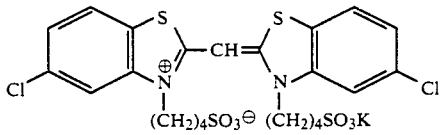
u-1
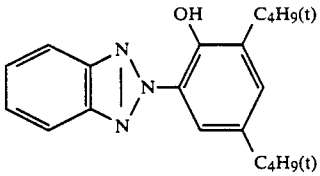
u-2
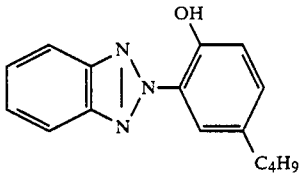
u-3
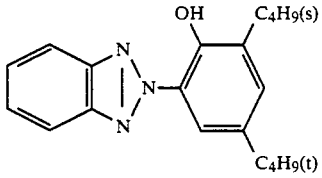

-continued
Sensitizing Dye
u-4
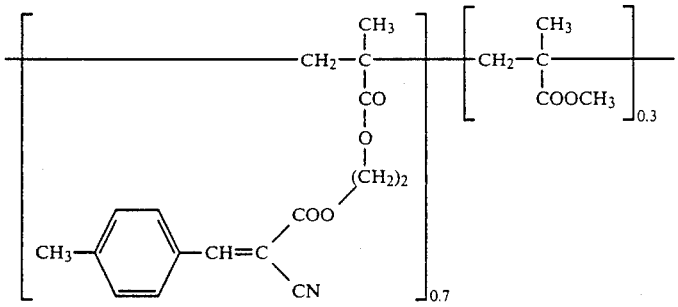
u-5
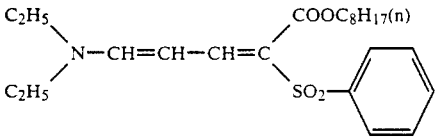
Dye I
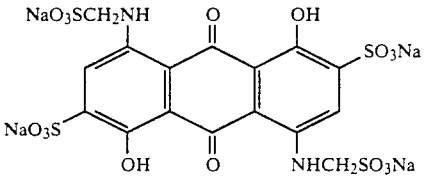
Dye II
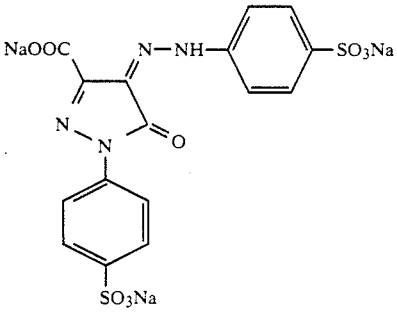
C-1
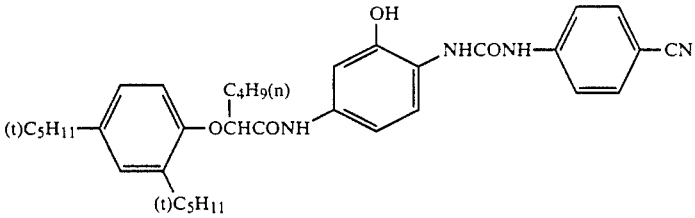
C-2
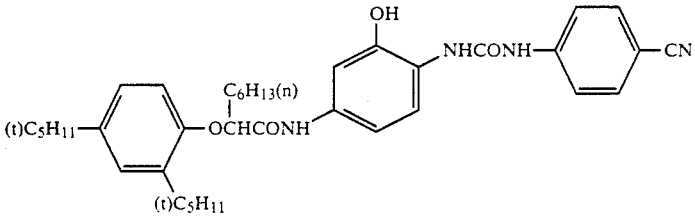

-continued
Sensitizing Dye
C-3
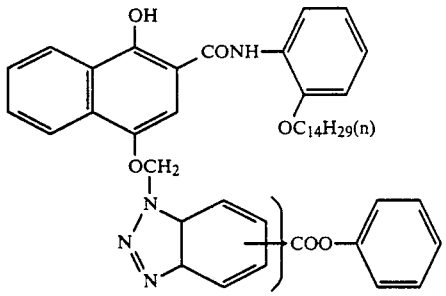
C-4
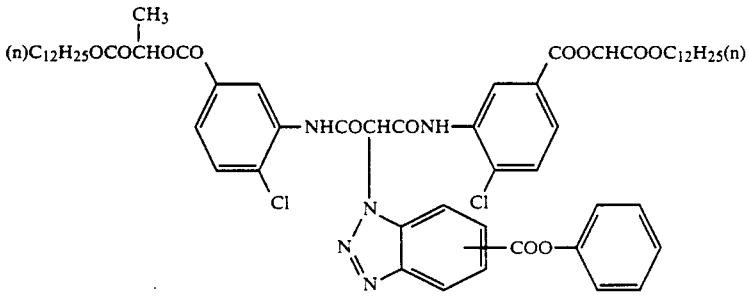
C-5
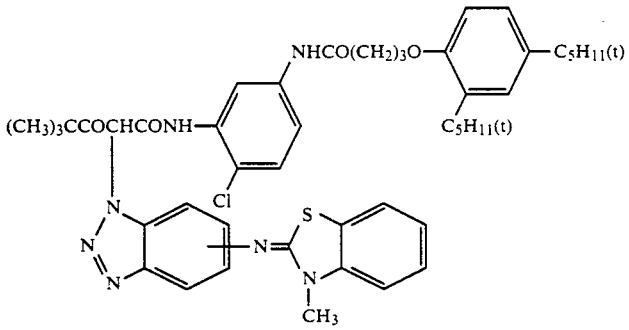
C-6
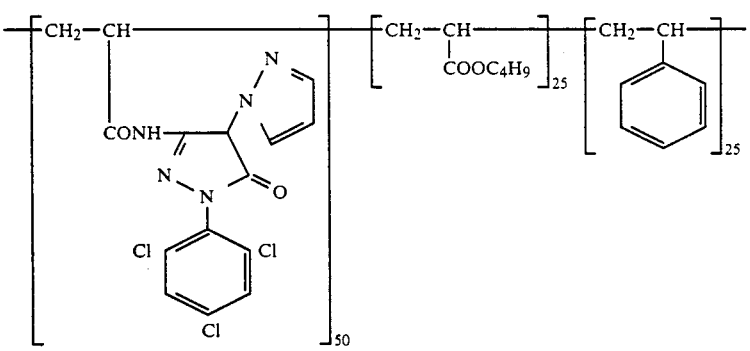
C-7
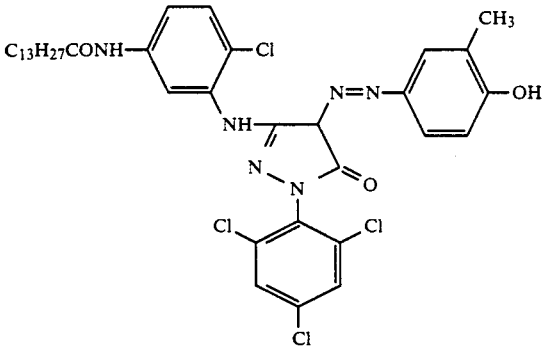

-continued
Sensitizing Dye
C-8
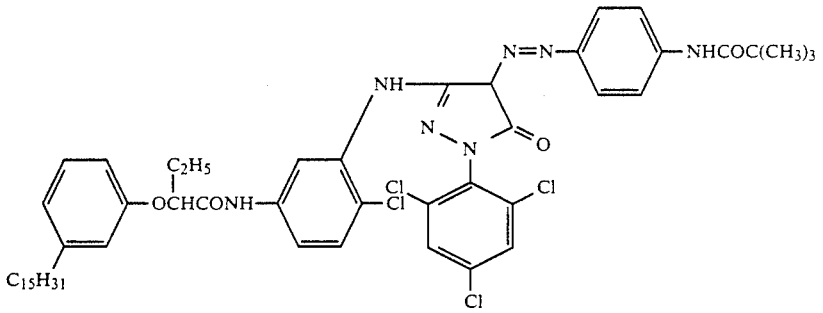
C-9
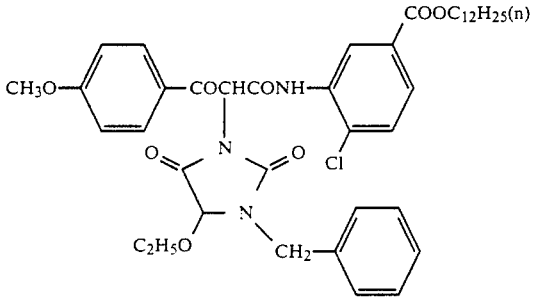
C-10
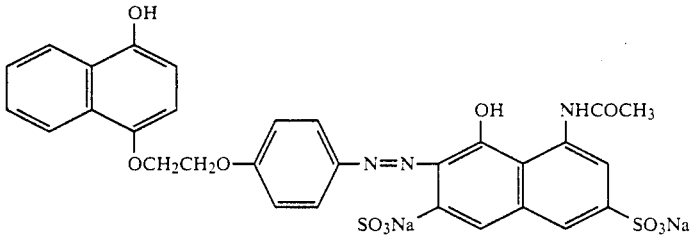
C-11
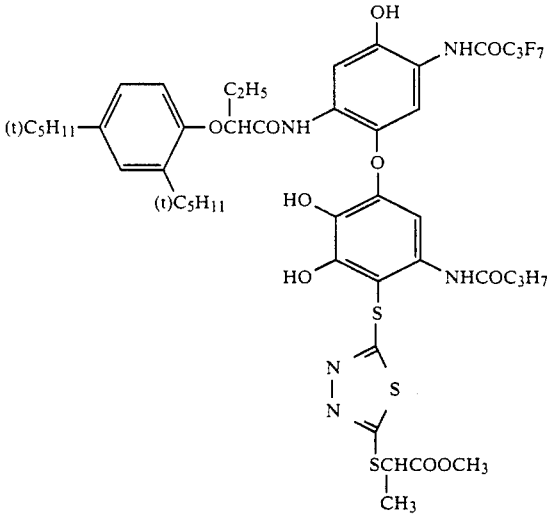
Cpd-1
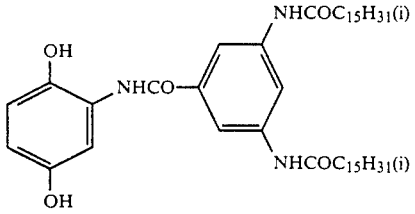

Sensitizing Dye

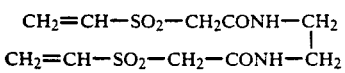

HBS-1: Tricresyl Phosphate
HBS-2: Dioctyl Phthalate
HBS-3: Dibutyl Phthalate
HBS-4: Bis(2-ethylhexyl) Phthalate After allowing to stand these samples for 14 hours at 40° C. and 70% in relative humidity, the sample was exposed through a continuous wedge for 10 seconds and processed as in Example 19 to provide characteristic curves of cyan, magenta, and yellow color images. The sensitivity was shown by the relative value of the reciprocal of the exposure amount giving an optical density of fog density +0.1 in the characteristic curve of yellow color images.

The pressure resisting characteristics were evalauted as follows. The coated sample was fixed with the emulsion layer above under a relative humidity of 40% and the emulsion layer was scratched by a metal styrus of 0.1 mm in diameter. In this case a load of 20 g was applied on the metal styrus. The scratch by the styrus was performed before development and the density change at the scratched portion of the yellow density in fogged portion was measured by a micro densitometer.

The results obtained are shown in Table 23.

TABLE 23

Comparison of pressure Resisting Characteristics and Sensitivity

| Sample | Emulsion for Layer 11 | Yellow Density Sensitivity | Increase of Fog by Scratching |
|---|---|---|---|
| Sample 301 (Comparison) | Em-A | 100 | 0.21 |
| Sample 302 (Invention) | Em-D | 103 | 0.08 |

As shown above, by using the emulsion of this invention, the increase of fog by scratching can be prevented without reducing the sensitivity.

EXAMPLE 22

A multilayer color photogrpahic material having the following layers on a cellulose triacetate film support having subbing layer was prepared. In this case, Em A in Example 16 or Em E or Em F in Example 17 was used for Layer 7 (High-Speed Green-Sensitive Emulsion Layer). Thus, Samples 401, 402, and 403 were prepared.

In the following composition the coating amount was shown by g/m$^2$ unit as silver on silver halide emulsion and colloid silver, by g/m$^2$ unit on additives and gelatin, and by mole unit per mole of silver halide in the same layer on sensitizing dye.

| | |
|---|---|
| Layer 1 Antihalation Layer | |
| Black Colloid Silver | 0.2 |
| Gelatin | 2.6 |
| Cpd-33 | 0.2 |
| Solv-31 | 0.02 |
| Layer 2 Interlayer | |
| Fine Grain Silver Bromide (mean grain size 0.07 μm) | 0.15 |
| Gelatin | 1.0 |
| Layer 3 Low-Speed Red-Sensitive Emulsion Layer | |

-continued

H-1

-continued

| | |
|---|---|
| Mono-dispersed Silver Iodobromide Emulsion (AgI 5.5 mole %, mean grain size 0.3 μm, coeff. of variation on grain sizes (hereinafter, coeff. of variation) 19%) | 1.5 |
| Gelatin | 3.0 |
| ExS-31 | 2.0 × 10$^{-4}$ |
| ExS-32 | 1.0 × 10$^{-4}$ |
| ExS-33 | 0.3 × 10$^{-4}$ |
| ExC-31 | 0.7 |
| ExC-32 | 0.1 |
| ExC-36 | 0.02 |
| Cpd-31 | 0.01 |
| Solv-31 | 0.8 |
| Solv-32 | 0.2 |
| Solv-34 | 0.1 |
| Layer 4 High-Speed Red-Sensitive Emulsion Layer | |
| Mono-dispersed Silver Iodobromide Emulsion (AgI 3.5 mole %, mean grain size 0.7 μm, coeff. of variation 18%) | 1.2 |
| Gelatin | 2.5 |
| ExS-31 | 3 × 10$^{-4}$ |
| ExS-32 | 1.5 × 10$^{-4}$ |
| ExS-33 | 0.45 × 10$^{-4}$ |
| ExC-34 | 0.15 |
| ExC-35 | 0.05 |
| ExC-32 | 0.03 |
| ExC-36 | 0.01 |
| Solv-31 | 0.05 |
| Solv-32 | 0.3 |
| Layer 5 Interlayer | |
| Gelatin | 0.8 |
| Cpd-32 | 0.05 |
| Solv-33 | 0.01 |
| Layer 6 Low-Speed Green-Sensitive Emulsion Layer | |
| Mono-dispersed Silver Iodobromide Emulsion (AgI 5 mole %, mean grain size 0.3 μm, coeff. of variation 19%) | 0.4 |
| Mono-dispersed Silver Iodobromide Emulsion (AgI 7 mole %, mean grain size 0.5 μm) | 0.8 |
| Gelatin | 3.0 |
| ExS-34 | 1 × 10$^{-4}$ |
| ExS-35 | 4 × 10$^{-4}$ |
| ExS-36 | 1 × 10$^{-4}$ |
| ExM-39 | 0.2 |
| ExM-37 | 0.4 |
| ExM-40 | 0.16 |
| ExC-39 | 0.05 |
| Solv-32 | 1.2 |
| Solv-34 | 0.05 |
| Solv-35 | 0.01 |
| Layer 7 High-Speed Green-Sensitive Emulsion Layer | |
| Poly-dispersed Silver Iodobromide Emulsion (Em-A in Example 16 or Em-E or F in Example 17) | 0.9 |
| Gelatin | 1.6 |
| ExS-34 | 0.7 × 10$^{-4}$ |
| ExS-35 | 2.8 × 10$^{-4}$ |
| ExS-36 | 0.7 × 10$^{-4}$ |
| ExM-37 | 0.05 |
| ExM-40 | 0.04 |
| ExC-39 | 0.01 |
| Solv-31 | 0.08 |
| Solv-32 | 0.3 |
| Solv-34 | 0.03 |
| Layer 8 Yellow Filter Layer | |
| Yellow Colloid Silver | 0.2 |
| Gelatin | 0.9 |
| Cpd-32 | 0.2 |
| Solv-32 | 0.1 |
| Layer 9 Low-Speed Blue-Sensitive Emulsion Layer | |

-continued

| | |
|---|---|
| Mono-dispersed Silver Iodobromide Emulsion (AgI 6 mole %, mean grain size 0.3 μm, coeff. of variation 20%) | 0.4 |
| Mono-dispersed Silver Iodobromide Emulsion described in Table | 0.4 |
| Gelatin | 2.9 |
| ExS-37 | $1 \times 10^{-4}$ |
| ExS-38 | $1 \times 10^{-4}$ |
| ExY-40 | 0.8 |
| ExY-41 | 0.4 |
| ExC-33 | 0.05 |
| Solv-32 | 0.4 |
| Solv-34 | 0.1 |
| Layer 10 High-Speed Blue-Sensitive Emulsion Layer | |
| Mono-dispersed Silver Iodobromide Emulsion (AgI 6 mole %, mean grain size 1.5 μm, coeff. of variation 14%) | 0.5 |
| Gelatin | 2.2 |
| ExS-37 | $5 \times 10^{-5}$ |
| ExS-38 | $5 \times 10^{-5}$ |
| ExY-40 | 0.2 |
| ExY-41 | 0.2 |

-continued

| | |
|---|---|
| ExC-33 | 0.02 |
| Solv-32 | 0.1 |
| Layer 11 1st Protective Layer | |
| Gelatin | 1.0 |
| Cpd-33 | 0.1 |
| Cpd-34 | 0.1 |
| Cpd-35 | 0.1 |
| Cpd-36 | 0.1 |
| Solv-31 | 0.1 |
| Solv-34 | 0.1 |
| Layer 12 2nd Protective Layer | |
| Fine Grain Silver Bromide Emulsion (mean grain size 0.07 μm) | 0.25 |
| Gelatin | 1.0 |
| Polymethyl Methacrylate Particles (diameter 1.5 μm) | 0.2 |
| Cpd-38 | 0.5 |

Each layer further contained a surface active agent Cpd-7 and a hardener H-1.

The compounds for the samples were as follows.

ExS-31

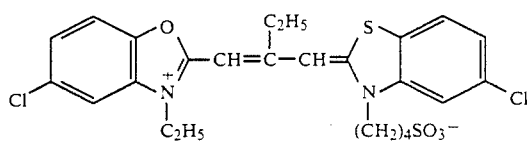

ExS-32

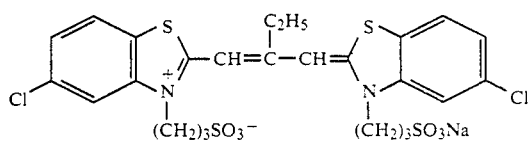

ExS-33

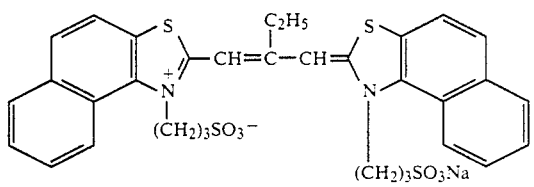

ExS-34

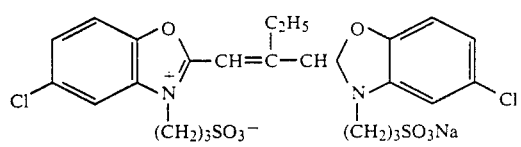

ExS-35

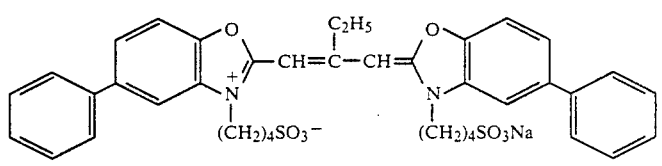

ExS-36

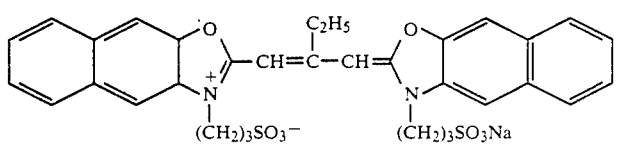

ExS-37

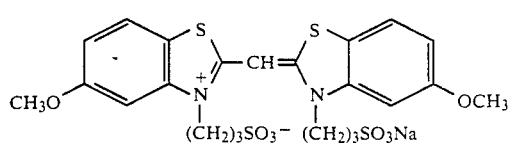

-continued
ExS-38
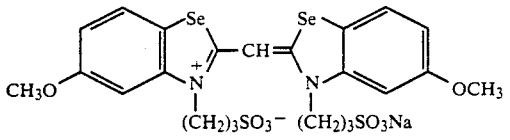
ExC-34
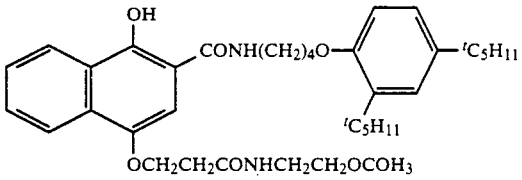
ExC-35
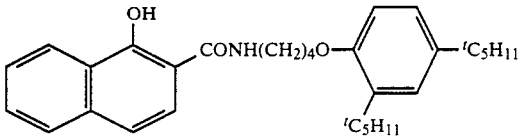
ExC-31
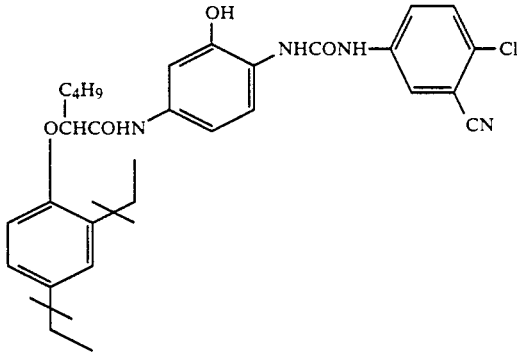
ExC-36
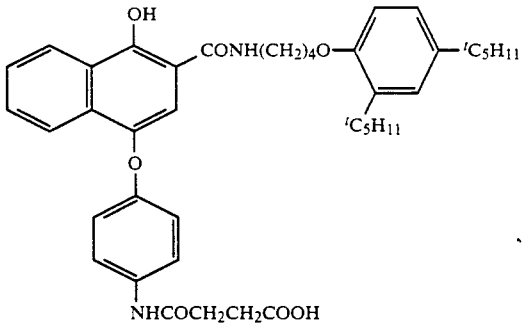
ExM-37
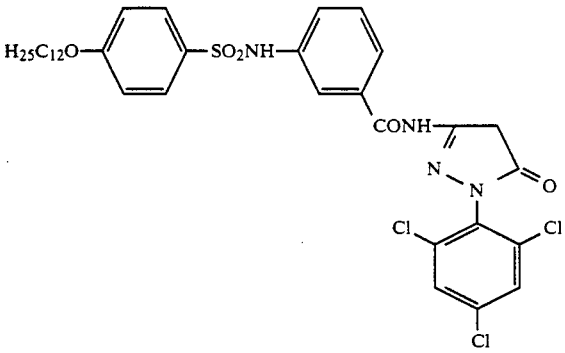

-continued
ExM-39
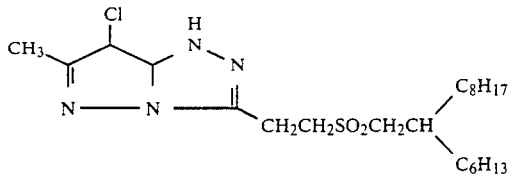
ExM-40
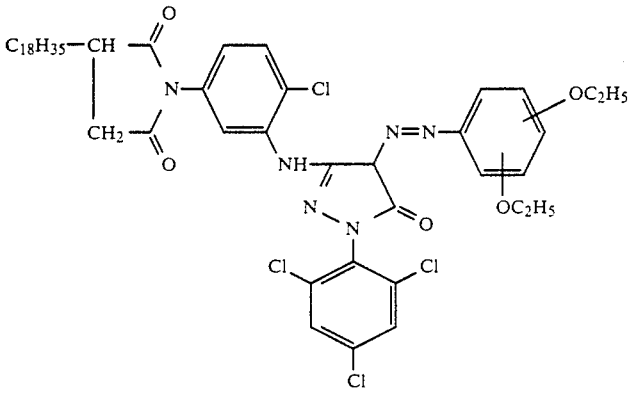
ExC-32
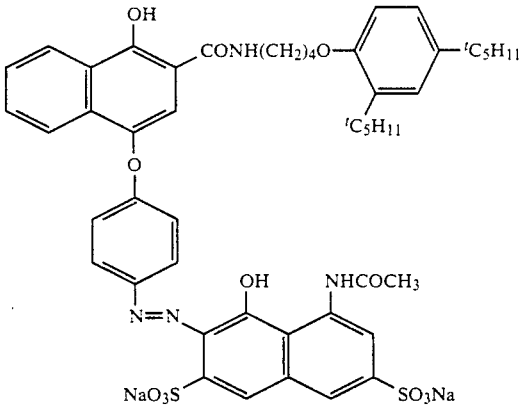
ExY-40
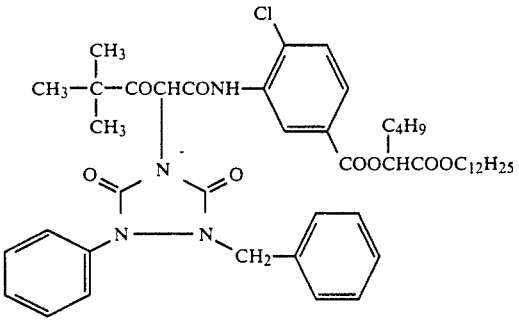
(Illustrated compound A-1)

-continued
ExC-33
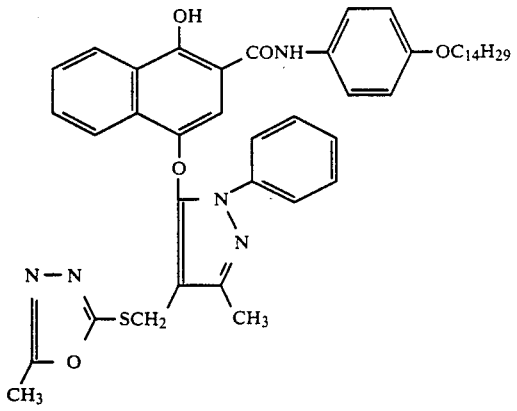
ExY-41
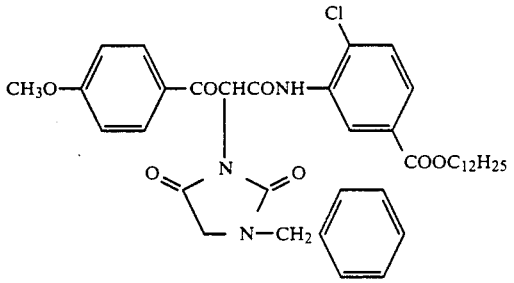
(Illustrated compound A-10)
ExC-39
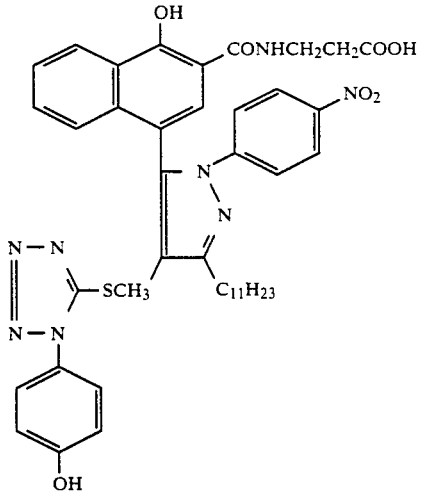
Cpd-31
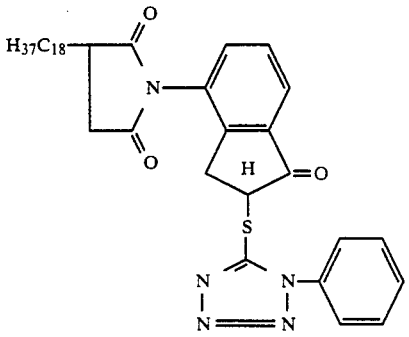

-continued
Cpd-32
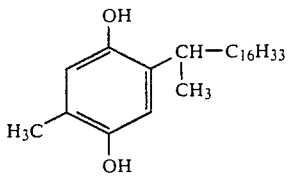
Cpd-33
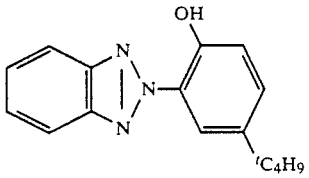
Cpd-34
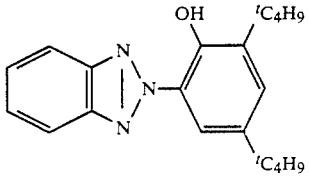
Cpd-35
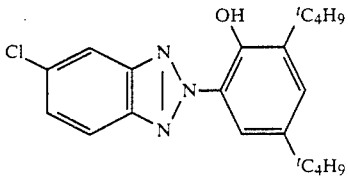
Cpd-36
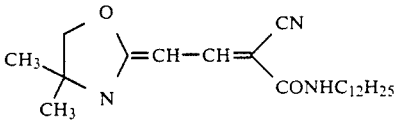
Solv-31
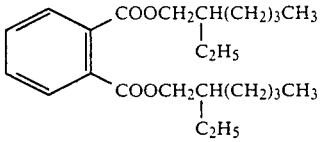
Solv-32
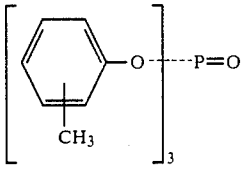
Solv-33
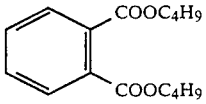
Solv-34
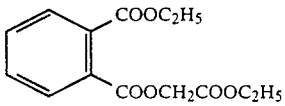
Solv-35
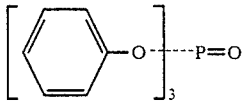

-continued

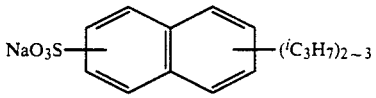

Cpd-37

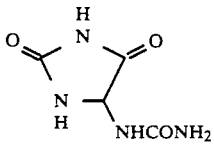

Cpd-38

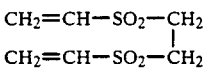

H-1

Each of the samples was imagewise exposed using an Argon light source adjusted to 4800° K. by a color temperature coversion filter at maximum 10 CMS. processed as in Example 4, and the photographic performance was evaluated.

Each of samples 401 to 403 was exposed to white light for 1/100 second at 10 CMS, processed as in Example 16 (wherein, the color development time was 3 min. 15 sec.), and the sensitivity relation was determined by the exposure amount giving a density of fog +0.2 at the measurement of magenta color density. The sensitivity was shown by the relative value in case of defining the sensitivity of sample 101 as 100.

The pressure resistant characteristics were evaluated as follows. The emulsion layer of the sample was scratched by a metal styrus of 0.1 mm in diameter at a rate of 10 cm/min. while applying a load of 20 g onto the styrus under a relative humidity of 40%. In addition, the scratching step was performed before exposure. Furthermore, the bending test along a stainless steel pipe as in Example 16 was also performed. In this case, the change of the magenta density at the fogged portion was measured by a micro densitometer.

The evaluation of the sharpness was performed according to the manner shown in Example 17.

The results are shown in Table 24.

TABLE 24

| Sample | Emulsion for Layer 7 | Sensitivity | Sharpness | Change of Fog by Metal Stylus | Change of Fog by Bending |
|---|---|---|---|---|---|
| 401 (Comparison) | Em-A | 100 | 100 | 0.18 | 0.10 |
| 402 (Comparison) | Em-E | 102 | 115 | 0.30 | 0.18 |
| 403 (Invention) | Em-F | 102 | 114 | 0.14 | 0.07 |

As is clear from the results shown in Table 24, it can be seen that by using the emulsion of this invention, photographic material showing high sharopness of iamges and having excellent pressure resistance is obtaiend.

EXAMPLE 23

Each of samples 101 to 103 prepared in Example 19 above was exposed to white light at 10 CMS for 1/100 second, and processed by the following steps. The results obtained were almost same as those in Example 19.

| Processing Step | Processing Time | Process Temp. |
|---|---|---|
| Color Development | 3 min. 15 sec. | 38° C. |

-continued

| Processing Step | Processing Time | Process Temp. |
|---|---|---|
| Bleach | 1 min. 00 sec. | 38° C. |
| Blix | 3 min. 15 sec. | 38° C. |
| Wash (1) | 40 sec. | 35° C. |
| Wash (2) | 1 min. 00 sec. | 35° C. |
| Stabilization | 40 sec. | 38° C. |
| Drying | 1 min. 15 sec. | 55° C. |

Then, the compositions of the processing solutions used were as follows.

| | | |
|---|---|---|
| Color Developer | | |
| Ethylenetriaminepentaacetic Acid | | 1.0 g |
| 1-Hydroxyethylidene-1,1-diphosphonic Acid | | 3.0 g |
| Sodium Sulfite | | 4.0 g |
| Potassium Carbonate | | 30.0 g |
| Potassium Bromide | | 1.4 g |
| Potassium Iodide | | 1.5 mg |
| Hydroxylamine Sulfate | | 2.4 g |
| 4-[N-Ethyl-N-[β-hydroxyethyl)amino]-2methylaniline Sulfate | | 4.5 g |
| Water to make | | 1.0 liter |
| | pH | 10.05 |
| Bleach Solution | | |
| Ethylenediaminetetraacetic Acid Ferric Ammonium Di-hydrate | | 120.0 g |
| Ethylenediaminetetraacetic Acid Di-sodium Salt | | 10.0 g |
| Ammonium Bromide | | 100.0 g |
| Ammonium Nitrate | | 10.0 g |
| Bleach Accelerator shown below | | 0.005 mole |

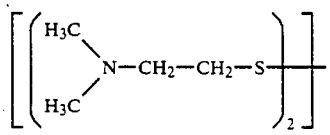

| | | |
|---|---|---|
| Aqueous Ammonia (27%) | | 15.0 ml |
| Water to make | | 1.0 liter |
| | pH | 6.3 |
| Blix Solution | | |
| Ethylenediaminetetraacetic Acid ferric Ammonium Di-hydrate | | 50.0 g |
| Ethylenediaminetetraacetic Acid | | 5.0 g |

-continued

| | | |
|---|---|---|
| Di-sodium Salt | | |
| Sodium Sulfite | 12.0 g | |
| Aqueous Solution of Ammonium Thiosulfate (70%) | 240.0 ml | |
| Aqueous Ammonia (27%) | 6.0 ml | |
| Water to make | 1.0 liter | |
| pH | 7.2 | |

Wash Water

City water was passed through a mixed bed type column packed with a H-type strong acid cation exchange resin (Amberlite IR-120B, trade name, made by Rhom & Haas Co.) and a OH-type anion exchange resin (Amberlite IR-400) to reduce the concentrations of calcium and magnesium below 3 mg/liter, and then 20 ml/liter of sodium dichloroisocyanurate and 1.5 g/liter of sodium sulfate were added to the water.

The pH of the solution was in the range of 6.5 to 7.5.

| Stabilization Solution | |
|---|---|
| Fromalin (37%) | 2.0 ml |
| Polyoxyethylene-p-monononylphenyl Ethyl (mean polymerization degree 10) | 0.3 |
| Ethylenediaminetetraacetic Acid Di-sodium Salt | 0.05 |
| Water to make | 1.0 liter |
| pH | 5.0 to 8.0 |

EXAMPLE 24

When samples 101 to 103 prepared in Example 19 were exposed to white light for 1/100 second at 10 CMS and then processed by the following processing steps, almost same results as in Example 19 were obtained.

| Processing Step | Processing Time | Processing Temp. |
|---|---|---|
| Color Development | 2 min. 30 sec. | 40° C. |
| Blix | 3 min. 00 sec. | 40° C. |
| Wash (1) | 20 sec. | 35° C. |
| Wash (2) | 20 sec. | 35° C. |
| Stabilization | 20 sec. | 35° C. |
| Drying | 50 sec. | 65° C. |

Then, the compositions of the processing solutions used for the above steps were as follows.

| | | |
|---|---|---|
| Color Developer: | | |
| Diethylenetriaminepentaacetic Acid | 2.0 g | |
| 1-Hydroxyethylidene-1,1-diphosphonic Acid | 3.0 g | |
| Sodium Sulfite | 4.0 g | |
| Potassium Carbonate | 30.0 g | |
| Potassium Bromide | 1.4 g | |
| Potassium Iodide | 1.5 mg | |
| Hydroxylamine Iodide | 1.5 mg | |
| Hydroxylamine Sulfate | 2.4 g | |
| 4-[N-Ethyl-N-(β-hydroxyethyl)amino]-2-methylaniline Sulfate | 4.5 g | |
| Water to make | 1.0 liter | |
| pH | 10.05 | |
| Blix Solution | | |
| Ethylenediaminetetraacetic Acid Ferric Ammonium Di-hydrate | 50.0 g | |
| Ethylenediaminetetraacetic Acid Di-sodium Salt | 5.0 g | |
| Sodium Sulfite | 12.0 g | |
| Aqueous Solution of Ammonium Thiosulfate (70%) | 260.0 ml | |
| Acetic Acid (98%) | 5.0 ml | |

-continued

| | | |
|---|---|---|
| Bleach Accelerator | 0.01 mole | |

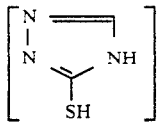

| | | |
|---|---|---|
| Water to make | 1.0 liter | |
| pH | 6.0 | |
| Wash Water: City water treated as in Example 23 | | |
| Stabilization Solution | | |
| Formalin (37%) | 2.0 ml | |
| Polyoxyethylene-p-monononylphenyl ether (mean polymerization degree 10) | 0.3 | |
| Ethylenediaminetetraacetic Acid Di-sodium Salt | 0.05 | |
| Water to make | 1.0 liter | |
| pH | 5.0 to 8.0 | |

According to this invention, an emulsion having silver halide grains having improved pressure resisting characteristics, high sensitivity and high contrast, and improved graininess can be obtained.

Furthermore, according to this invention, a silver halide emulsion simultaneously attaining the improvement of sensitivity including the improvement of color increasing efficiency by sensitizing dye(s), the improvement of the relation of sensitivity/graininess, the improvement of sharpness, the improvement of covering power, and the improvement of pressure resisting characteristics can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing silver halide grains comprising a silver halide base grain substantially composed of silver bromide, a partially halogen-converted silver salt phase of a deposited layer of a silver salt more water soluble than that of the base grain deposited on the base grain and a silver halide shell portion deposited on the partially halogen-converted silver salt phase, wherein said silver salt phase comprises silver halochloride, silver thiocyanate or silver citrate, and wherein the deposited amount of the silver salt in the partially halogen-converted silver salt phase is about 3 mol % to about 30 mol % as silver based on the amount of silver in the base grain.

2. The silver halide photographic emulsion as claimed in claim 1, wherein said partially halogen-converted silver salt phase is obtained by a replacement of said silver salt with silver halide in an amount of 10 mole % or more based on the silver of the salt.

3. The silver halide photographic emulsion as claimed in claim 1, wherein said partially halogen-converted silver salt phase is obtained by a replacement of said silver salt with silver halide in an amount of 20 mole % or more based on the silver of the salt.

4. The silver halide photographic emulsion as claimed in claim 1, wherein said silver salt is silver halochloride.

5. The silver halide photographic emulsion as in claim 1, wherein said emulsion contains an antifoggant or stabilizer which is added to the emulsion during chemical ripening or before the initiation of chemical ripening.

6. The silver halide photographic emulsion as claimed in claim 1, wherein said base grain has a volume of 20% or more of the volume of said silver halide grain produced.

7. The silver halide photographic emulsion as claimed in claim 1, wherein said base grain has a volume of 85% or less of the volume of silver halide grain produced.

8. The silver halide photographic emulsion as claimed in claim 1, wherein said base grain contains at least 2 mole % of iodide ion based on silver of said base grain.

9. The silver halide photographic emulsion as in claim 1, wherein said silver halide grains contain 60 mole % or more of silver bromide.

10. The silver halide photographic emulsion as claimed in claim 2, wherein the pAg condition for the halogen conversion is 7.0 or more.

11. The silver halide photographic emulsion as claimed in claim 2, wherein the pAg is 8.0 or more.

12. The silver halide photographic emulsion as claimed in claim 1, wherein said silver halide grains are tabular silver halide grains having an aspect ratio of at least 3.

13. The silver halide photographic emulsion as claimed in claim 1, wherein said silver halide grains are mono-dispersed grains having a coefficient of variation in mean grain size of about 30% or less.

14. The silver halide photographic emulsion as claimed in claim 1, wherein said silver halide grains are mono-dispersed grains having a coefficient of variation in mean grain size of about 20% or less.

15. The silver halide photographic emulsion as claimed in claim 1, wherein said silver halide grains are mono-dispersed tabular grains having a coefficient of variation in mean grain size of about 30% or less.

16. The silver halide photographic emulsion as claimed in claim 1, wherein said base grain contains about 10 to 45 mole % of silver iodide based on the base grain.

17. The silver halide photographic emulsion as in claim 1, wherein said silver halide grains contain at least 3 mole % silver iodide at the surface layer of the grains.

18. The silver halide photographic emulsion as in claim 1, wherein said silver halide grains contain at least 5 mole % silver iodide at the surface layer of the grains.

19. The silver halide photographic emulsion as in claim 1, wherein said emulsion contains a spectral sensitizing dye which is added to the emulsion either during or before chemical ripening.

20. A process for preparing silver halide grains for a silver halide photographic emulsion comprising forming silver halide base grains substantially composed of silver bromide, depositing thereon a silver salt having a higher solubility in water than silver bromide, halogen converting by depositing silver halide on the layer of the silver salt, and further depositing silver halide substantially composed of silver bromide on the halogen converted layer.

* * * * *